US008651318B2

(12) United States Patent
Brandtner

(10) Patent No.: US 8,651,318 B2
(45) Date of Patent: Feb. 18, 2014

(54) BEVERAGE CAN HAVING DEFLECTING CLOSURE ELEMENT

(75) Inventor: Wladimir Brandtner, Grabenstätt (DE)

(73) Assignee: WB Innovations Limited, Birmingham (GB)

( * ) Notice: Subject to any disclaimer, the term of this patent is extended or adjusted under 35 U.S.C. 154(b) by 0 days.

(21) Appl. No.: 13/036,231

(22) Filed: Feb. 28, 2011

(65) Prior Publication Data

US 2011/0155737 A1 Jun. 30, 2011

Related U.S. Application Data

(63) Continuation of application No. PCT/EP2009/006224, filed on Aug. 27, 2009.

(30) Foreign Application Priority Data

Aug. 29, 2008 (DE) ..... 10 2008 044 981

(51) Int. Cl.
*B65D 43/18* (2006.01)

(52) U.S. Cl.
USPC ..... 220/821; 220/254.4; 220/269; 220/906

(58) Field of Classification Search
USPC ..... 220/269, 254.3, 254.4, 254.7, 821, 906, 220/254.9, 254.5
See application file for complete search history.

(56) References Cited

U.S. PATENT DOCUMENTS

| | | | | |
|---|---|---|---|---|
| 3,400,851 | A | 9/1968 | Morikawa et al. | |
| 3,559,843 | A | 2/1971 | Kern | |
| 3,839,106 | A | 10/1974 | De Prisque et al. | |
| 4,673,099 | A | 6/1987 | Wells | |
| 4,720,022 | A | 1/1988 | Gomes | |
| 4,723,683 | A * | 2/1988 | Colbert | 220/268 |
| 4,821,912 | A | 4/1989 | Wells | |
| 5,813,559 | A | 9/1998 | Cho | |

(Continued)

FOREIGN PATENT DOCUMENTS

| | | | |
|---|---|---|---|
| DE | 7410137 | U | 7/1974 |
| DE | 2715890 | A1 | 10/1978 |

(Continued)

*Primary Examiner* — J. Gregory Pickett
*Assistant Examiner* — James Way
(74) *Attorney, Agent, or Firm* — Alan Kamrath; Kamrath IP Lawfirm, P.A.

(57) ABSTRACT

A beverage can closure element (10) with a cover element (12) is specified for configuring in an opening in a beverage can (30) and a locking mechanism (16) embodied and/or configured on the cover element (12) which is embodied and/or configured in a manner that the beverage can closure element (10) configured in an opening in a beverage can (30) can be locked in an opening of a beverage can (30). The cover element (12) is embodied and configured so that, if the beverage can closure element (10) is configured in an opening of a beverage can (30), the cover element (12) is elastically deformable between at least two states. The locking mechanism (16) is configured and embodied in such a manner on the cover element (12) that the locking mechanism (16) in at least one state of the cover element (12) of the at least two states of the cover element (12) is configured further inwards in a radial direction relative to the cover element (12) than in at least one other of the at least two states of the cover element (12).

23 Claims, 43 Drawing Sheets

(56) References Cited

U.S. PATENT DOCUMENTS

| | | | | |
|---|---|---|---|---|
| 6,003,713 | A * | 12/1999 | Derving | 220/269 |
| 7,407,061 | B2 * | 8/2008 | Fares et al. | 220/254.4 |
| 2011/0155737 | A1 | 6/2011 | Brandner | |
| 2011/0240645 | A1 | 10/2011 | Schley et al. | |

FOREIGN PATENT DOCUMENTS

| | | | |
|---|---|---|---|
| DE | 3703875 | A1 | 8/1988 |
| DE | 4035395 | A1 | 5/1992 |
| DE | 9403674 | U1 | 5/1994 |
| DE | 29617664 | U1 | 3/1997 |
| DE | 19912880 | A1 | 1/2000 |
| FR | 2826940 | A1 | 1/2003 |
| WO | WO2005026004 | A1 | 3/2005 |
| WO | WO2006009483 | A2 | 1/2006 |
| WO | WO2011107558 | A1 | 9/2011 |

* cited by examiner

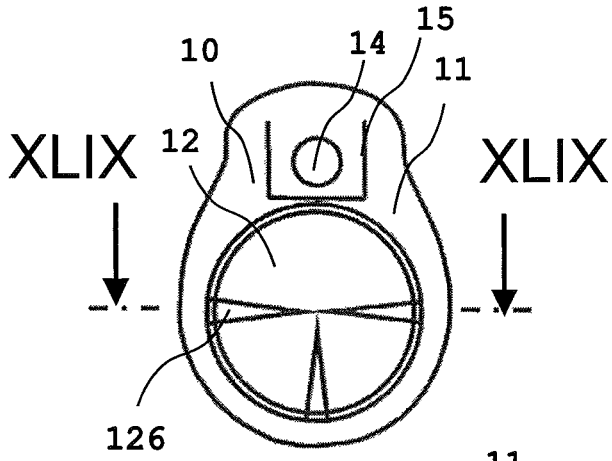
Fig. 48
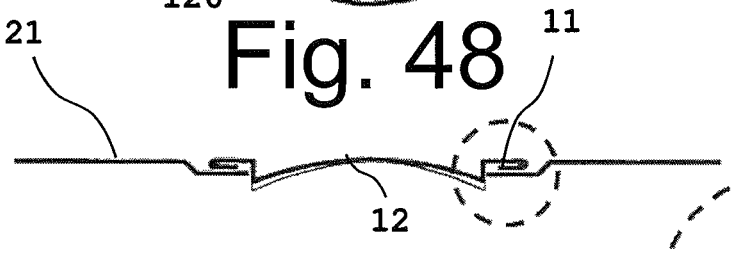
Fig. 49
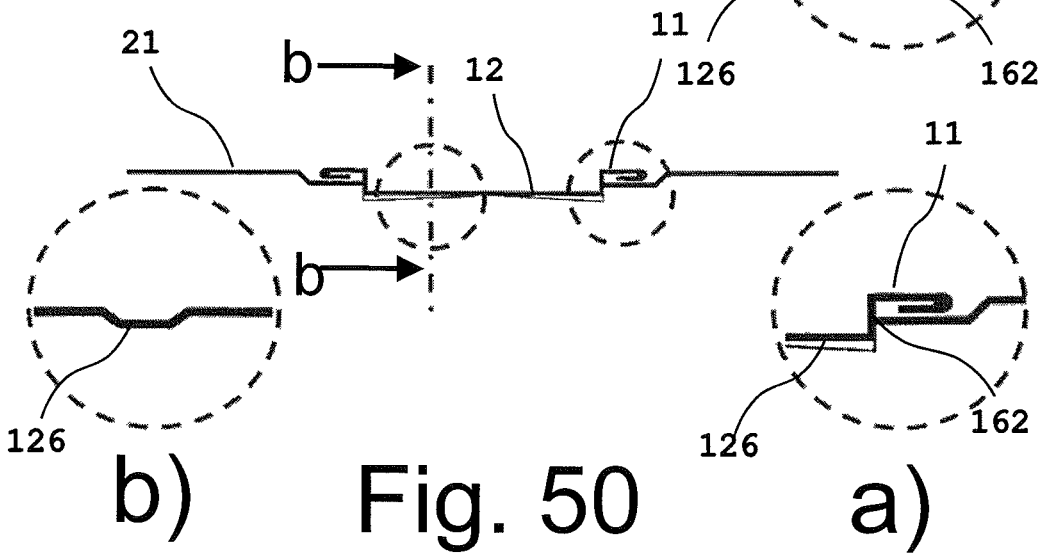
b) Fig. 50 a)

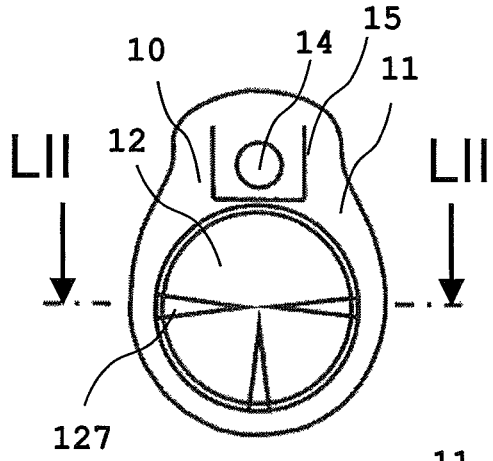
Fig. 51
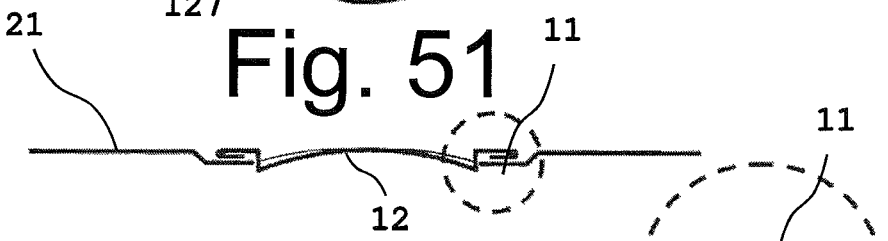
Fig. 52
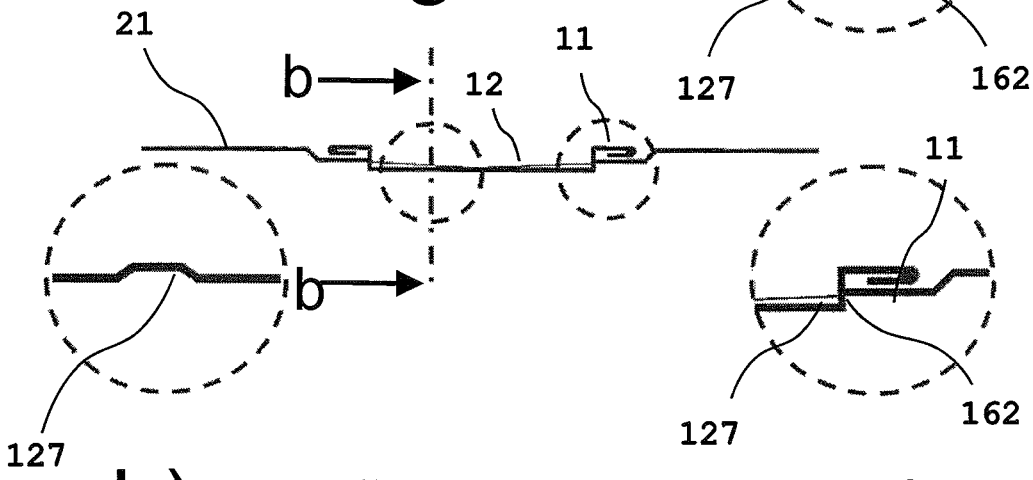
b) Fig. 53 a)

BEVERAGE CAN HAVING DEFLECTING CLOSURE ELEMENT

CROSS REFERENCE

The present application is a continuation of International Application No. PCT/EP09/06224 filed on Aug. 27, 2009.

The invention relates to a beverage can closure element.

The invention relates to a beverage can lid with a beverage can closure element and a beverage can with a beverage can lid of this type.

Next to bottles, beverage cans are the most important retail packaging for beverages and generally also serve as a drinking vessel. They are primarily used for carbonated beverages such as canned beer and soft drinks.

Beverage cans generally consist of a single-piece, cylindrical container made of aluminium or tinplate, a seamed lid made of aluminium with an oval scored line or rupture line and a riveted metal tab which, when raised, depresses the scored oval into the interior of the can through lever action, thus creating a pouring or drinking opening.

The invention relates to a beverage can closure element which is capable of closing and locking an opening of any type and releasing said opening again, all in a simple manner. The invention relates in particular to a lid for a container such as a beverage can, where the lid consists of plate, preferably tinplate. Beverage cans generally have a rupture line in the lid. An opening tab fixed to the lid can produce a dispensing opening by the action of a rupture lever on the rupture line.

Beverage cans of this type primarily contain liquids such as beer, lemonade, fruit juices, mineral water or similar, but can also be used for sauces, herb mixtures, grated cheese, nuts or similar.

The disadvantage of conventional beverage cans is that they cannot be closed again after opening. Thus, there is a risk of residual contents being spilt in the workplace, in vehicles, when playing, etc. Furthermore, contaminants and insects may enter the can.

WO 2006/009483 reveals a reclosable lid. In this embodiment of the lid, the opening tab can be pivoted after opening to close the dispensing opening. The opening tab has a ring-shaped sealing medium, such as a magnet, adhesive, rubber or plastic seal, on its underside for this purpose. As several materials are used in the manufacture of the lid, the production of a lid of this type is cost and labour-intensive.

U.S. Pat. No. 4,673,099 also reveals a reclosable lid. The opening tab is slanted outwards on its underside to close the dispensing opening. This slant enables it to engage in the dispensing opening. A separate sealing material (e.g. elastomer) is also used to ensure the achievement of an effective seal. Consequently, the manufacture of the lid is also cost and labour-intensive in this case.

The object of the invention is therefore to further develop a lid of the type mentioned above in such a way as to enable its cost-effective manufacture, and, whereby, the dispensing opening is easy to close and lock and also easy to reopen again.

The object of the invention is achieved with a beverage can closure element.

According to the invention, a beverage can closure element with a cover element is specified for configuring in an opening in a beverage can and a locking mechanism embodied and/or configured on the cover element which is embodied and/or configured in a manner that the beverage can closure element configured in an opening in a beverage can can be locked in an opening of a beverage can. The cover element is embodied and configured so that, if the beverage can closure element is configured in an opening of a beverage can, the cover element is elastically deformable between at least two states. Whereby, the locking mechanism is configured and embodied in such a manner on the cover element that the locking mechanism in at least one state of the cover element of the at least two states of the cover element is configured further inwards in a radial direction relative to the cover element than in at least one other of the at least two states of the cover element.

According to the invention, the cover element can be elastically deformable through the external application of force between the at least two states.

According to the invention, the cover element can be elastically deformable through interaction with the beverage can between the at least two states.

According to the invention, the locking mechanism can be configured and/or embodied on the underside of the cover element. The underside of the cover element is the side of the cover element turned towards the contents of the beverage can when the beverage can closure element is configured in the opening of the beverage can to close the beverage can again.

Alternatively or additionally, the locking mechanism can be configured and/or embodied on the upper side of the cover element.

Alternatively or additionally, the locking mechanism can be configured and/or embodied on the upper side of the cover element.

According to the invention, the cover element can be embodied as a disc spring design.

According to the invention, the cover element can exhibit a surface section embodiment which is curved upwards in one of the states and curved downwards in another of the states. Variants and alternatives are conceivable. For example, depressions or level sections or grooves and/or ribs can be included in the curvature. The transition from a level surface to an curved surface or vice versa is also conceivable. The transition from a gentler curvature to a more severe curvature or from a more severe curvature to a gentler curvature is also conceivable.

According to the invention, the cover element can exhibit at least one and preferably several reinforcing ribs and/or reinforcing grooves.

According to the invention, the locking mechanism can exhibit at least one and preferably several locking elements which should preferably be embodied as a completely or partially circumferential rim or rims that run or runs around the cover element and/or as a lug or lugs.

Locking mechanism locking elements of this type can be preferably embodied and configured so that they engage behind the rim of the beverage can opening in the locked state and, consequently, can lock the beverage can closure element in the opening.

According to the invention, the locking mechanism can comprise one and preferably several extensions configured on the cover element.

According to the invention, the cover element can be configured in a ring-like component that encloses the rim of the cover element. Extensions are preferably embodied on the cover element, which are accommodated in slots embodied in the ring-like component.

The extensions can act as a locking mechanism in this embodiment of the invention in that they move outwards in a radial direction through the slots of the ring-like component when the cover element is pressed, resulting in the locking of the beverage can closure element in the dispensing opening. In the case of this embodiment of the invention, the cover element and its extensions and the ring-like component should preferably be manufactured with the same material as the beverage can lid and the beverage can. However, it would also be conceivable that the components could be made of other materials, for example and preferably plastic which is compatible with foodstuffs. The components can be made of the same or different materials in this respect.

According to the invention, the beverage can closure element can exhibit an unlocking mechanism embodied and configured so that the locking mechanism is unlocked when the unlocking mechanism is actuated, preferably through elastic deformation of the cover element in the state in which the locking elements are still configured inwards in a radial direction.

Thus, the beverage can opening can be cleared again after the unlocking mechanism is actuated. In other words, the elastic deformation of the cover element that occurs during locking can be reversed again with the unlocking mechanism by applying a force to the cover element in such a manner that the cover element reverts from one stable state (i.e. the locking state, for example) to another stable state (i.e. the unlocking state, for example) which corresponds to the state in which the cover element was configured for locking in the opening of the beverage can. The cover element can be removed again from the beverage can opening following unlocking and pivoted into another position to clear the opening again to enable further dispensing of the contents of the beverage can.

According to the invention, the unlocking mechanism can encompass a lever configured on the beverage can closure element or a mechanism with one or more wings configured on the beverage can closure element.

Alternatively or additionally, the reversal of the elastic deformation of the cover element of the beverage can closure element can be achieved by actuating the beverage can closure element itself.

According to the invention, the cover element can exhibit a curved surface or partial surface, preferably an upwardly curving surface or partial surface. The embodiment of the surface and/or partial surface is preferably round, oval, trapezoidal with rounded corners, bridge shaped, groove shaped, rectangular, square, triangular, polygonal or similar.

The curved surface or partial surface of the cover element can, of course, also exhibit any other suitable shape and, particularly, a shape with rounded corners.

According to the invention, the cover element can exhibit a curved surface or partial surface directed downwards, or can exhibit an upwardly curving surface which in part encompasses a surface directed downwards.

According to the invention, the cover element can exhibit a rim as a locking element, and the rim is a completely or partially circumferential rim or encompasses one or more projecting parts.

According to the invention, the cover element can exhibit a completely or partially circumferential reinforcing groove and/or reinforcing rib, such as, for example, in the form of an offset.

This embodiment has the advantage that the stability of the cover element is enhanced, and locking in the dispensing opening is easier to manage and more reliable.

According to the invention, the rim of the cover element can exhibit one or more lugs.

This enables the achievement of better (i.e. simpler) and more reliable locking of the cover element in the dispensing opening.

According to the invention, the cover element can exhibit a level surface or a surface protruding from a level surface, and the surface protruding from the level surface is preferably a curved surface or a surface with multiple curves.

The preferred embodiment of the cover element is such that it is the part of the opening tab or the beverage can closure element, which can close the dispensing opening of the beverage can again.

The invention also relates to a beverage can lid with a beverage can closure element according to the invention, and preferably, with a rupture line defining a dispensing opening for dispensing the contents of the beverage can.

According to the invention, the beverage can closure element can be configured and embodied as an opening tab for opening the beverage can by pressing in the beverage can lid on the rupture line.

This is the preferred embodiment of the invention. Alternatively, the beverage can closure element can also be planned as a component or part separate from an opening tab. It is evident that, according to the invention, the beverage can closure element can also be planned as a part separate from the beverage can. However, an embodiment of the beverage can opening tab as a beverage can closure element according to the invention is preferred. To this end, the beverage can closure element has the double function of an opening tab for the initial opening of the beverage can and an element to close the beverage can again, locking the beverage can closure element in the beverage can opening created by opening the beverage can along the rupture line.

According to the invention, the beverage can closure element can be configured and embodied in such a manner on the beverage can lid that, following opening of the dispensing opening, the beverage can closure element can be configured over the dispensing opening, either through pivoting and/or folding down the beverage can closure element to cover and close the dispensing opening again.

According to the invention, the rim of the beverage can closure element can be configured and embodied in such a manner that it snaps into the dispensing opening when closing the dispensing opening, is clamped tightly in the dispensing opening or engages in said dispensing opening.

According to the invention, the reopening mechanism can consist of a rupture lever exhibited by the beverage can closure element which is used as a reopening lever. Alternatively, the reopening mechanism consists of one or more wings fixed to the opening tab or embodied as a single part with the opening tab, and the wing(s) is/are manufactured from the same material as the opening tab or a material other than that of the opening tab.

Alternatively or additionally, the reopening mechanism can also consist of the configuration of an opening mechanism on the other side of the opening tab opposite the rupture lever which can be used as an auxiliary opening mechanism or a main opening mechanism, and the rim of the opening tab or one or more wings can be used for reopening.

According to the invention, the upper side of the opening tab or beverage can closure element can, in terms of shape and surface quality, be designed so that it can be used for advertising purposes, images, logos, numbering, etc.

The invention also relates to a beverage can with a beverage can lid according to the invention and/or a beverage can closure element according to the invention.

According to the invention, the beverage can can be manufactured from metal, preferably tinplate, and/or plastic and/or a combination of different materials.

According to the invention, the beverage can can be used for beverages, granular and/or powdered products, sauces, nuts or other products.

The beverage can lid according to the invention can, for example, be produced in a manner where the lid is initially pressed in a conventional manner, but forming the opening tab so that it can be inserted into the dispensing opening and locked and so that it can be raised easily out of the dispensing opening again to clear the opening. The rim provided for locking can be embodied as a completely or partially circumferential rim in this respect, or consist of one or more projecting parts. A completely or partially circumferential reinforcing groove can be provided which ensures greater opening tab stability and better locking in the dispensing opening. Furthermore, the opening tab can be pressed in a manner where one or more wings is/are moulded as a single part or that one or more wings is/are fixed to the opening tab.

When handling the beverage can according to the invention, the beverage can can be opened using the opening tab, after which the opening tab is pivoted or folded through 180° to close and lock the dispensing opening. The locking elements of the beverage can closure element are, through deformation of a beverage can closure element surface, moved outwards in a radial direction relative to the surface to lock the dispensing opening, and the mechanism for reversing this deformation is actuated by moving the locking elements inwards in a radial direction relative to the surface to clear the opening again.

In some embodiments of the invention, an upwardly curving surface of the opening tab can be pressed downwards to lock the dispensing opening in a manner in which the curvature reverses, and the opening tab snaps into the dispensing opening and locks the lid. Alternately, the upwardly curving surface is pressed downwards in a manner in which the curvature is lessened or becomes completely flat. The opening tab stretches and the rim of the opening tab is pressed outwards, and whereby the opening tab snaps into the dispensing opening and locks the lid.

In some embodiments of the invention, the lug or lugs can clamp on the rim of the opening tab or engage in this position to lock the dispensing opening.

The opening tab or the cover element can, for example, be pressed downwards to lock the dispensing opening. This is realised in a manner that causes the curvatures of the curved surface to reverse (i.e. the upwardly curving surface curves downwards and the downwardly curving surface or partial surface curves upwards), and the opening tab or the cover element or the beverage can closure element snaps into the dispensing opening and locks.

The rupture lever can be used as a reopening lever to reopen the beverage can. The rupture lever, which was pivoted together with the opening tab or beverage can closure element, is pressed downwards, the snapped-in rim is pressed inwards again and the curved surface, which was less curved or even flat in the snapped-in state, is pressed upwards again, and the opening tab and beverage can closure element are released from the dispensing opening and can be pivoted or folded back.

Alternatively or additionally, an opening mechanism can be provided or used for reopening which is located on the other side of the opening tab opposite the rupture lever. The rim of the opening tab or one or more wings can be used to loosen the opening tab.

The wing(s) can be pressed downwards to reopen the container. The opening tab or the beverage can closure element returns to its original shape, or the wing(s) is/are raised and pulled upwards.

Following opening of the beverage can, the opening tab or beverage can closure element can be pivoted or folded and pressed into the dispensing opening. Locking elements can be provided to avoid situations where the opening tab or the beverage can closure element loosens out of the dispensing opening. A reopening mechanism can be provided to enable clearing of the dispensing opening again.

The opening tab used for reclosing or the beverage can closure element used for reclosing can be accommodated without difficulty in the disc-shaped cavity which opens upwards and is formed between the central lid component and the upper can rim, particularly if the tab or closure element consists of a thin plate stamped part. According to the invention, the lid can be produced by conventional machines without the need for major adaptations.

The dispensing opening can be reliably closed and locked, and dirt, dust and pests (i.e. insects) cannot penetrate into the can after it has been opened. The contents can no longer be spilled in appreciable quantities in the workplace, when playing or when travelling in moving vehicles. The subject matter of the invention can even be closed and locked to a degree that prevents the contents of the can being spilled in appreciable quantities if the can topples over. A can equipped in this manner is also very environmentally friendly, as the opening tab or the beverage can closure element used for reclosing is continually connected to the can.

The embodiment of the locking elements is such that the opening tab or beverage can closure element snaps into the dispensing opening and locks during reclosing. The opening tab or beverage can closure element should preferably exhibit an upwardly curving surface or partial surface in this respect and should preferably have a circumferential rim which can snap into the dispensing opening. The surface or partial surface can be round, oval, trapezoidal with rounded corners, bridge shaped, groove shaped, rectangular, square, triangular, polygonal or similar, with rounded corners if necessary. The surface or partial surface can also consist of combinations of different shapes (e.g. angular and rounded shapes).

The curved surface or partial surface can also be directed downwards, or the upwardly curving surface can in part exhibit a surface directed downwards. The surface or partial surface directed downwards facilitates reclosing and locking.

Locking can be achieved as follows in the case of some embodiments of the invention: the upwardly curving surface is pressed downwards in a manner in which, due to this deformation, the curved surface presses the rim of the opening tab or beverage can closure element outwards in a radial direction, and the opening tab or the beverage can closure element snaps into the dispensing opening and shuts the lid. The engaging rim can be a completely or partially circumferential rim, or can consist of one or more projecting parts. A completely or partially circumferential reinforcing groove (e.g. in the form of an offset, a depression or an elevation) can ensure greater stability of the opening tab or beverage can closure element and improved engaging in the dispensing opening.

In the case of some embodiments of the invention, the reopening mechanism can involve use of a rupture lever (i.e. the lever used to break open the rupture line) as a reopening lever. The rupture lever which was pivoted or folded back together with the opening tab or beverage can closure element is pressed downwards, the snapped-in and locked rim is pressed inwards again, and the curved surface, which is directed downwards in the snapped-in and locked state, is pressed upwards again. The opening tab or beverage can closure element releases itself from the dispensing opening in this manner. The opening tab or beverage can closure element can therefore be pivoted or folded back to permit further emptying of the beverage can. The curved surface, which was pressed downwards for locking, can also be less downwardly curving or even flat in the locked state.

Alternatively, the locking mechanism can consist of an embodiment of the dispensing opening rim which enables firm clamping or engaging of the opening tab or beverage can closure element in the dispensing opening during reclosure. The rim of the opening tab or beverage can closure element exhibits one or more lugs for locking in the dispensing opening.

Alternatively, the reopening mechanism can consist of one or more wings fixed to the opening tab or beverage can closure element or embodied as a single part with the opening tab or beverage can closure element. The wing(s) is/are manufactured from the same material as the opening tab or beverage can closure element or a material other than that of the opening tab or beverage can closure element.

The part of the opening tab or beverage can closure element which can reclose the dispensing opening should preferably have a level surface or a surface raised above the level surface. This surface protruding from the level surface can be a curved surface or a surface with multiple curves and can preferably constitute the cover element or a considerable part of the cover element.

Additionally, the upper side of the opening tab or beverage can closure element can, in terms of shape and surface quality, be designed so that it can be used for advertising purposes, images, logos, numbering, etc.

The invention also relates to a container with a closure element or lid according to the invention, and the container can be manufactured from an environmentally friendly material such as metal, preferably tinplate, or plastic or a combination of different materials. A container of this type can be used for beverages, granular or powdered products, sauces, nuts or other products.

Where the container is a beverage can, the lid, and particularly the opening tab or beverage can closure element, can exhibit a hole or several holes through which tubular objects (e.g. drinking straws) can be inserted.

The invention also encompasses a process for the manufacture of a lid. The lid is initially pressed in a conventional manner, but forms the opening tab or beverage can closure element so that it can be inserted into the dispensing opening. The opening tab or beverage can closure element exhibits a circumferential rim in this respect which can snap into or engage in the dispensing opening, or be clamped firmly therein. Alternatively, the rim of the opening tab or beverage can closure element can exhibit one or more lugs.

The invention also encompasses a process for opening, reclosing and reopening the container. The rupture lever, for example, can be pressed downwards for reopening, the rim locked though snapping, engaging or clamping is released and the opening tab or beverage can closure element can be pivoted or folded back. Alternatively, one or more wings can be provided for opening and also reopening the container to enable release of the opening tab or beverage can closure element.

Although the invention relates in particular to a lid for a beverage can, other applications are also possible, e.g. as a beverage can closure element for temporarily closing bottles or similar containers or as a cover for objects such as camera lenses or similar.

The invention is described in greater detail below on the basis of the embodiment examples illustrated in the figures.

Figure 24:
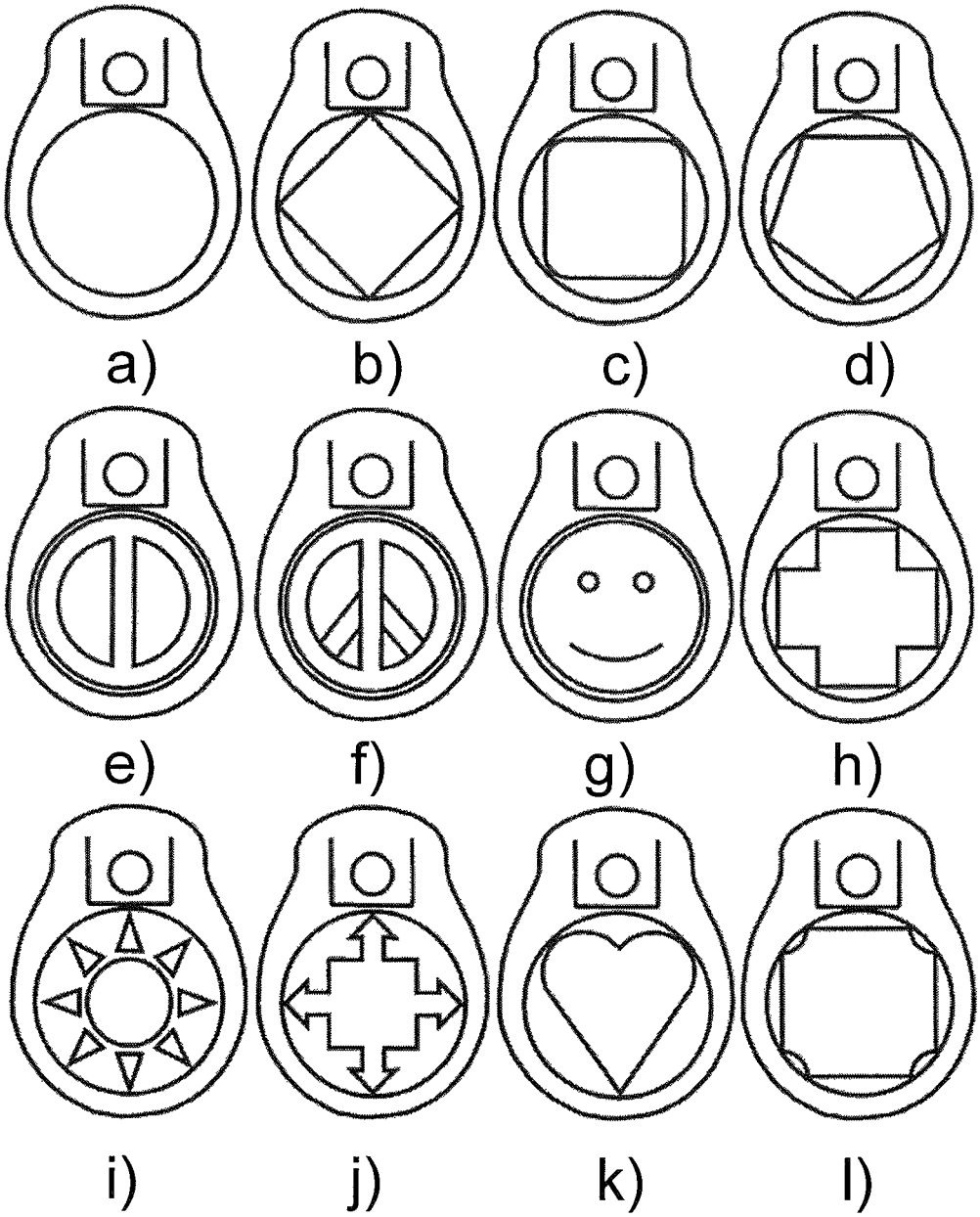
Figure 25:
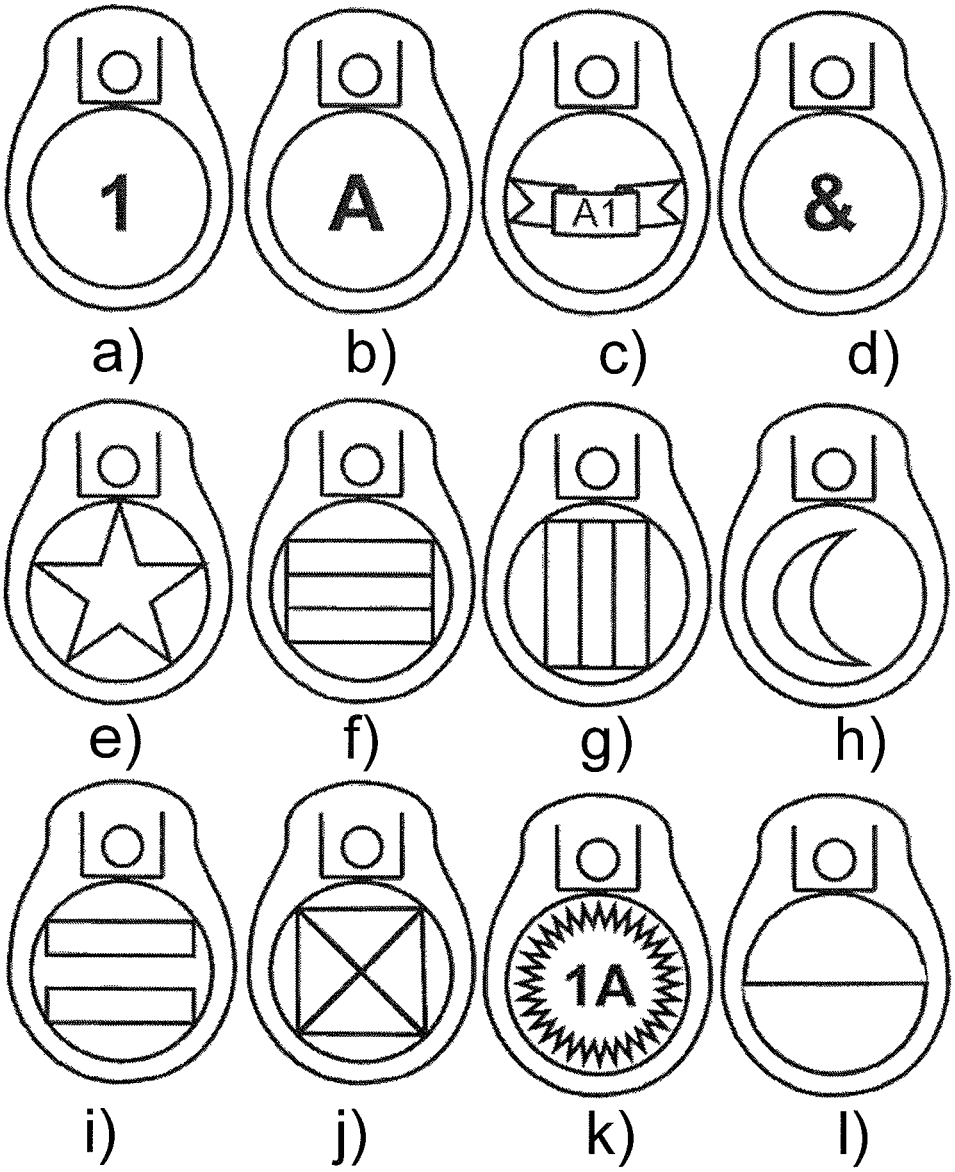
Figure 26:
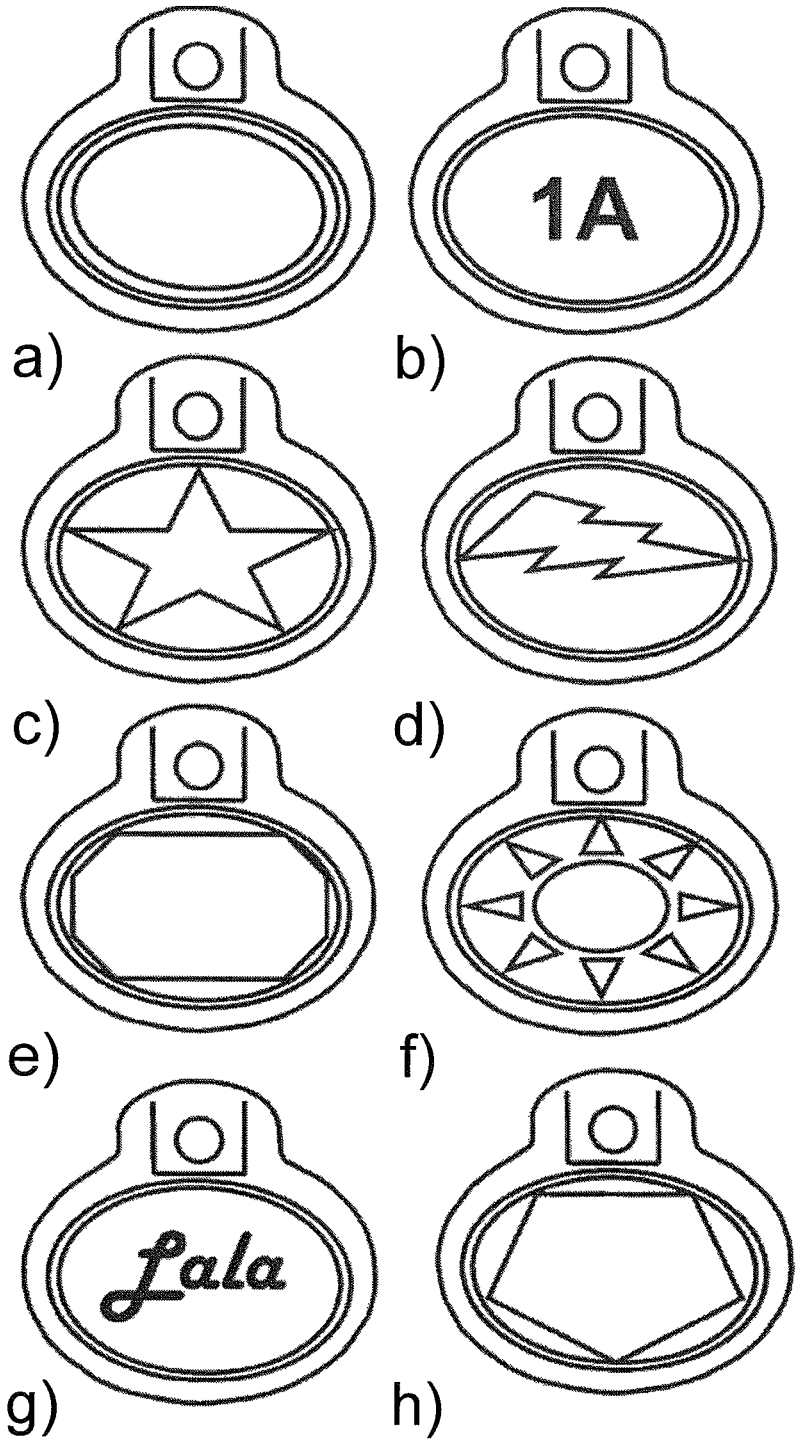

FIGS. 24*a*) to *l*), 25*a*) to *l*) and 26*a*) to *h*) illustrate top views of beverage can closure element variants.

FIGS. 27*a*) to *i*) illustrate partial sectional views of beverage can closure element variants.

Figure 28A:
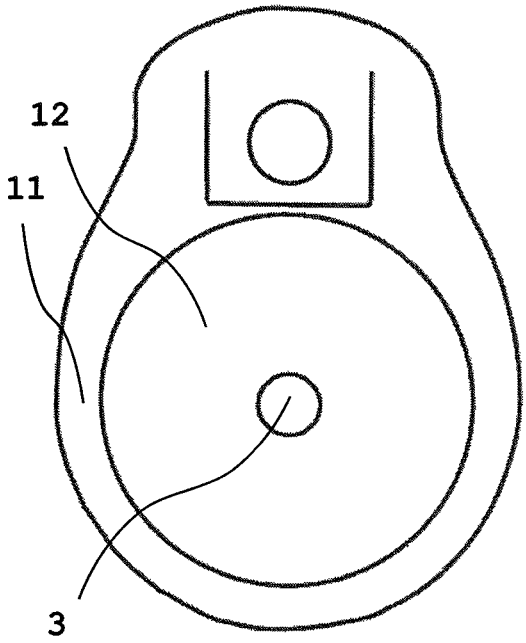
Figure 28B:
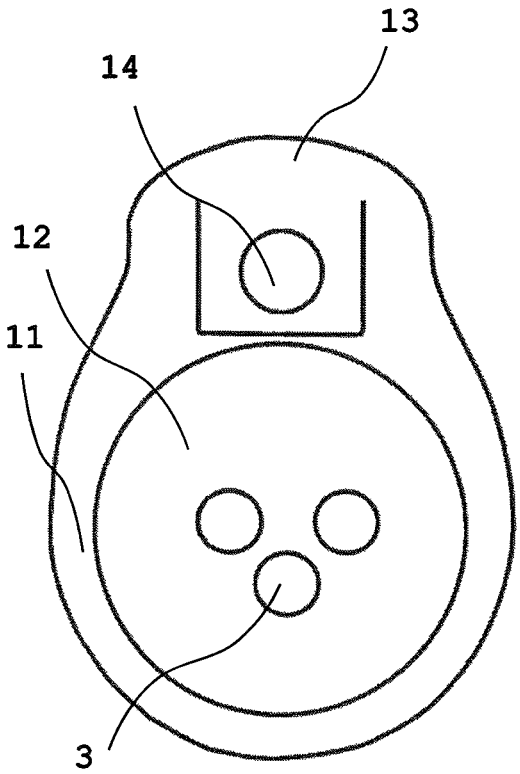

FIGS. 28*a* and 28*b* illustrate top views of beverage can closure element variants with drinking straw openings in the cover element.

Figure 29:
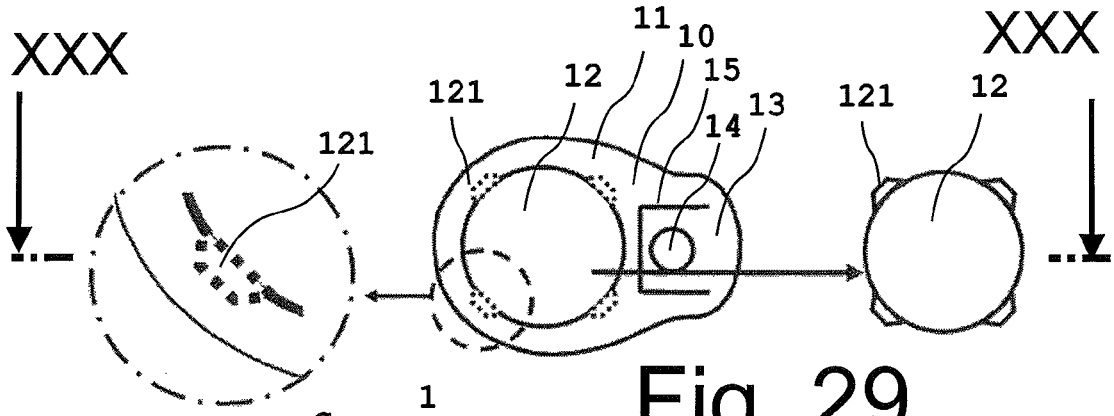

FIG. 29 illustrates a top view of a further embodiment example of a beverage can closure element according to the invention in an unlocked state.

Figure 30:
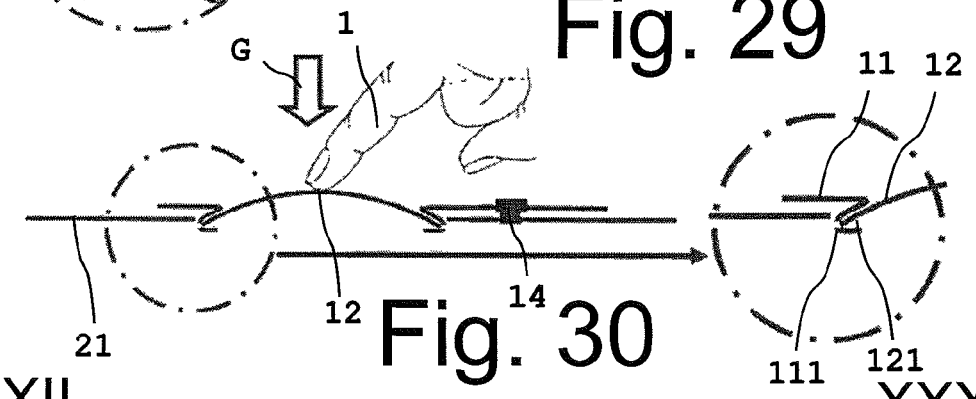

FIG. 30 illustrates a partial sectional view of the beverage can closure element from FIG. 29 with a beverage can lid along the line XXX-XXX from FIG. 29.

Figure 31:
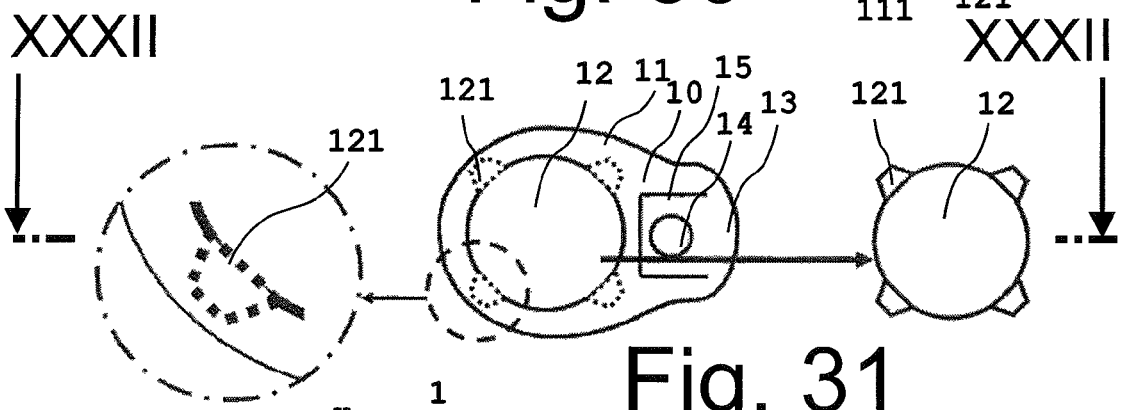

FIG. 31 illustrates a top view of the beverage can closure element from FIG. 29 in a locked state.

Figure 32:
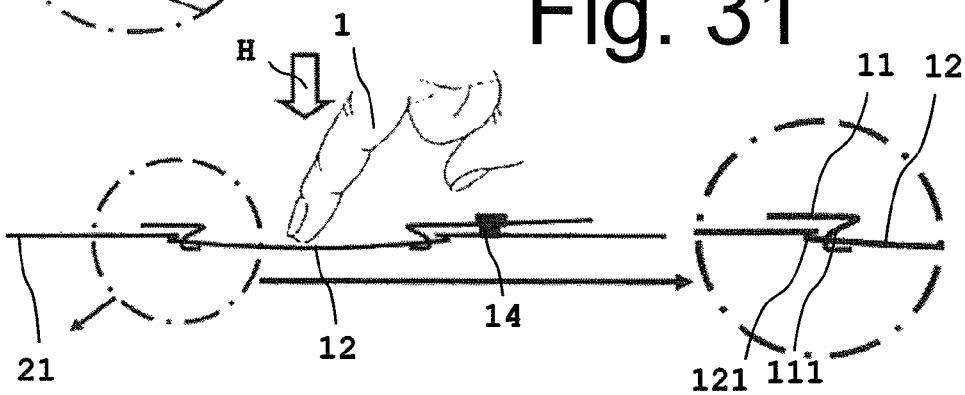

FIG. 32 illustrates a partial sectional view of the beverage can closure element from FIG. 31 with a beverage can lid along the line XXXII-XXXII from FIG. 31.

Figure 33:
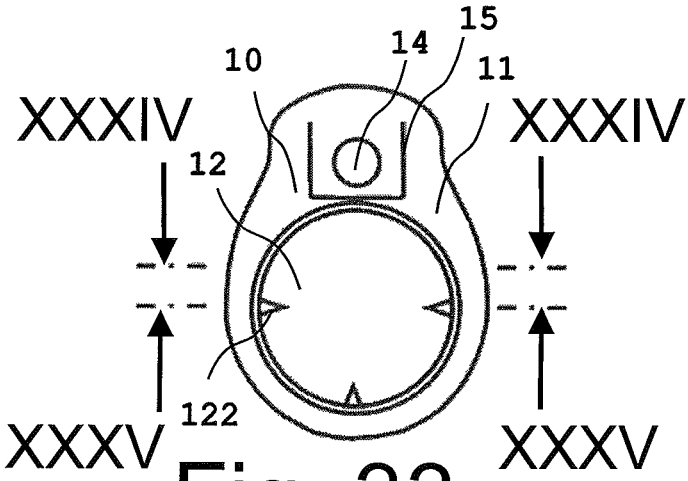

FIG. 33 illustrates a top view of a further embodiment example of a beverage can closure element according to the invention in an unlocked state.

Figure 34:
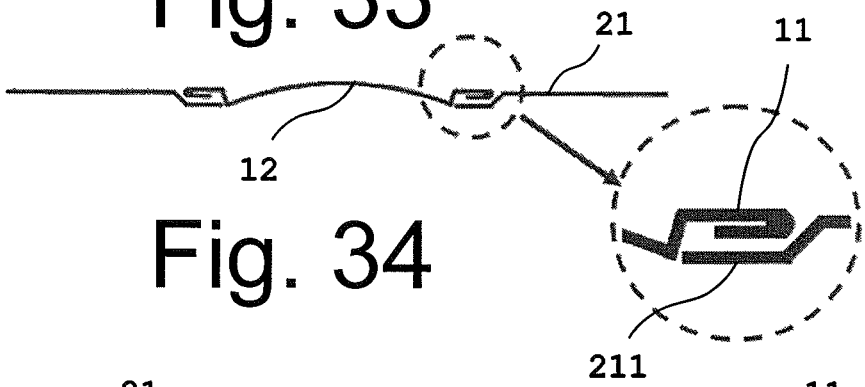

FIG. 34 illustrates a partial sectional view of the beverage can closure element from FIG. 33 with a beverage can lid along the line XXXIV-XXXIV from FIG. 33.

Figure 35:
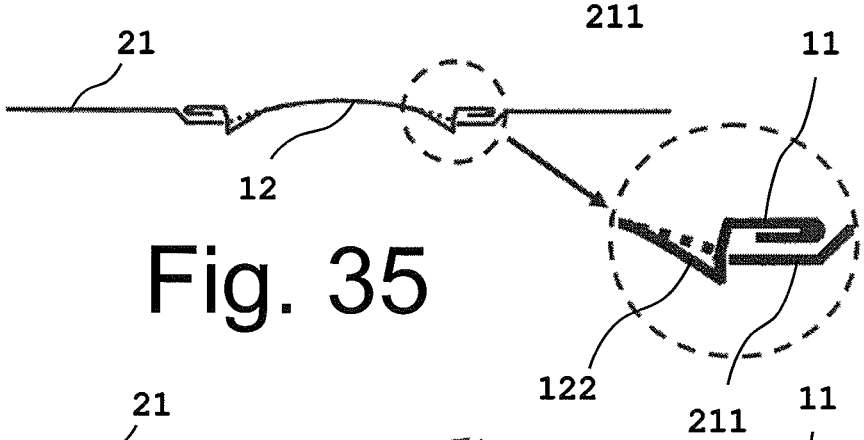

FIG. 35 illustrates a partial sectional view of the beverage can closure element from FIG. 33 with a beverage can lid along the line XXXV-XXXV from FIG. 33 in an unlocked state.

Figure 36:
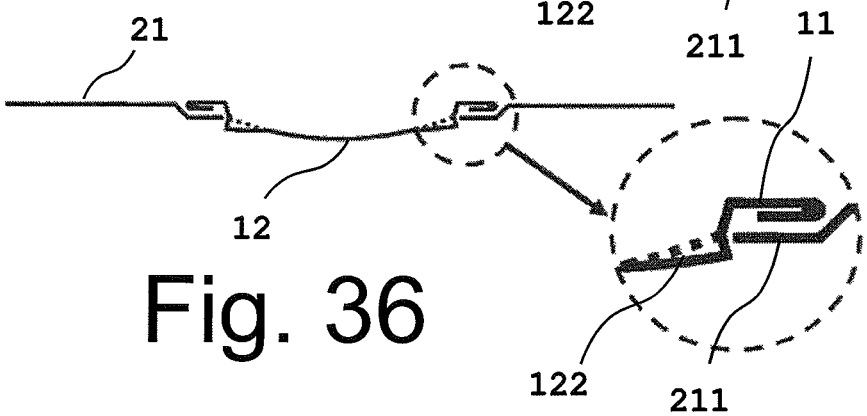

FIG. 36 illustrates a partial sectional view according to FIG. 35 of the beverage can closure element from FIG. 33 in a locked state.

Figure 37:
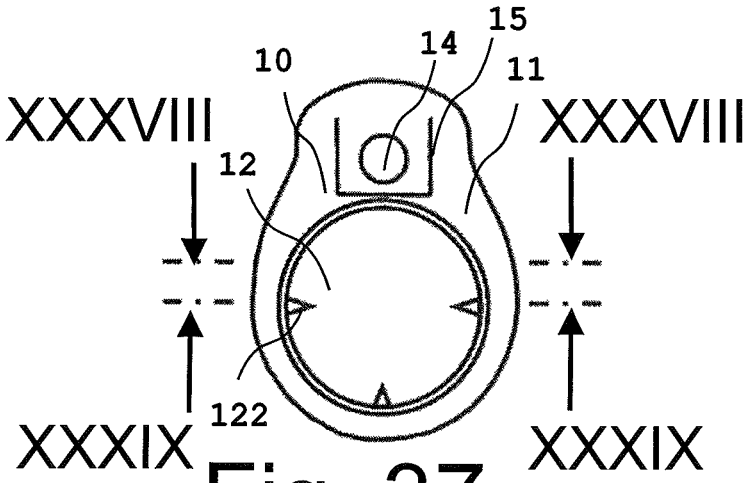

FIG. 37 illustrates a top view of a further embodiment example of a beverage can closure element according to the invention in an unlocked state.

Figure 38:
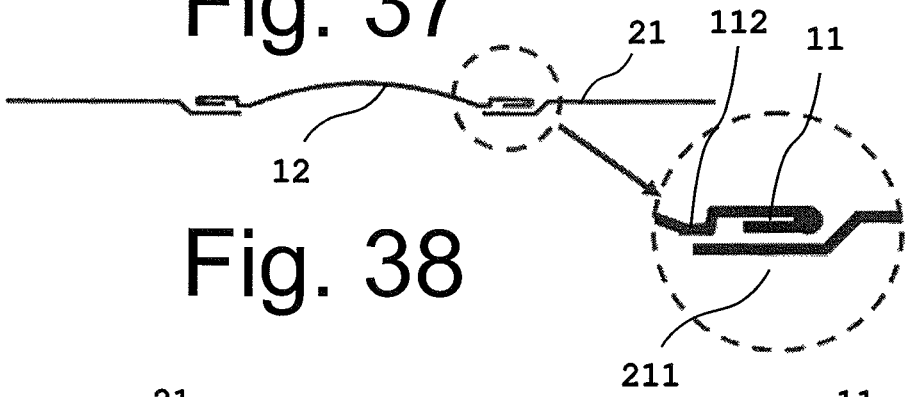

FIG. 38 illustrates a partial sectional view of the beverage can closure element from FIG. 37 with a beverage can lid along the line XXXVIII-XXXVIII from FIG. 37.

Figure 39:
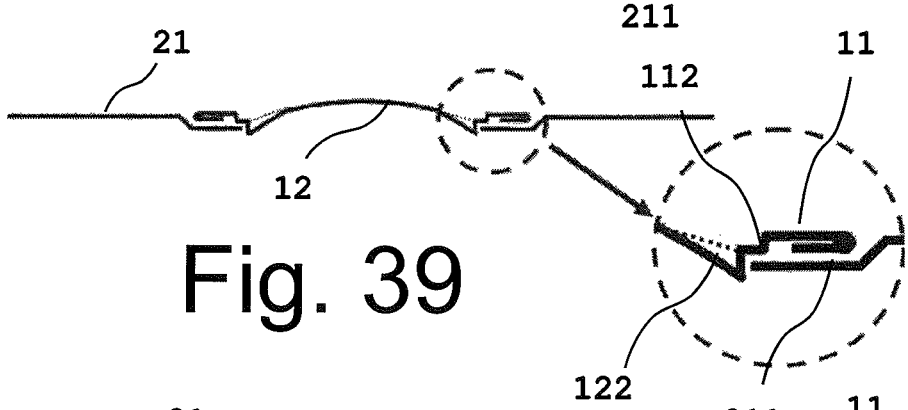

FIG. 39 illustrates a partial sectional view of the beverage can closure element from FIG. 37 with a beverage can lid along the line XXXIX-XXXIX from FIG. 37 in an unlocked state.

Figure 40:
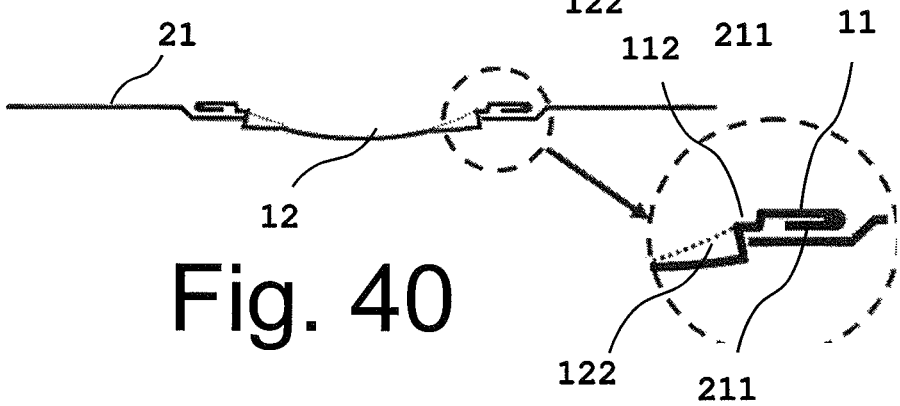

FIG. 40 illustrates a partial sectional view according to FIG. 39 of the beverage can closure element from FIG. 37 in a locked state.

Figure 41:
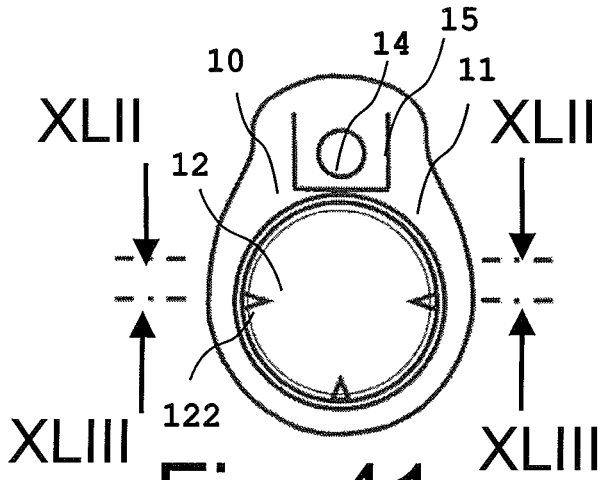

FIG. 41 illustrates a top view of a further embodiment example of a beverage can closure element according to the invention in an unlocked state.

Figure 42:
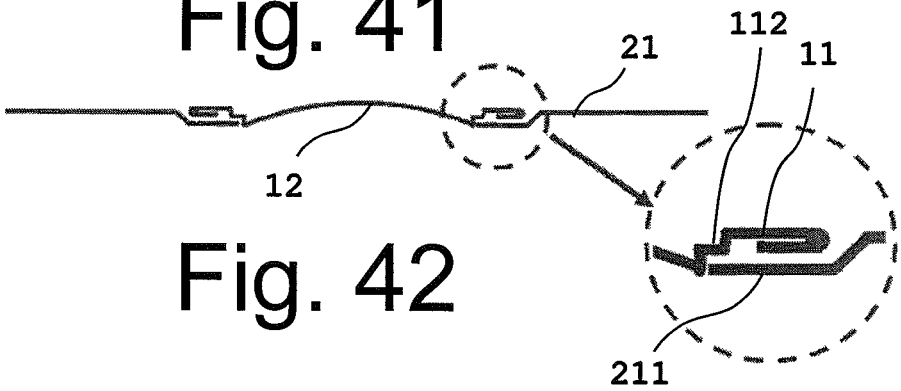

FIG. 42 illustrates a partial sectional view of the beverage can closure element from FIG. 41 with a beverage can lid along the line XLII-XLII from FIG. 41.

Figure 43:
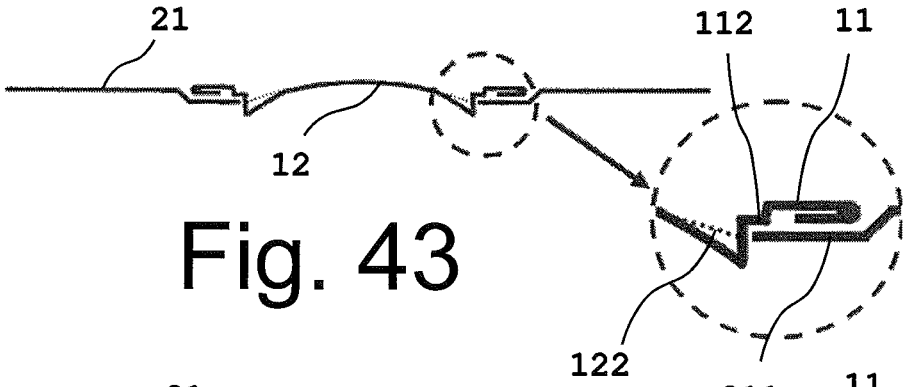

FIG. 43 illustrates a partial sectional view of the beverage can closure element from FIG. 41 with a beverage can lid along the line XLIII-XLIII from FIG. 41 in an unlocked state.

Figure 44:
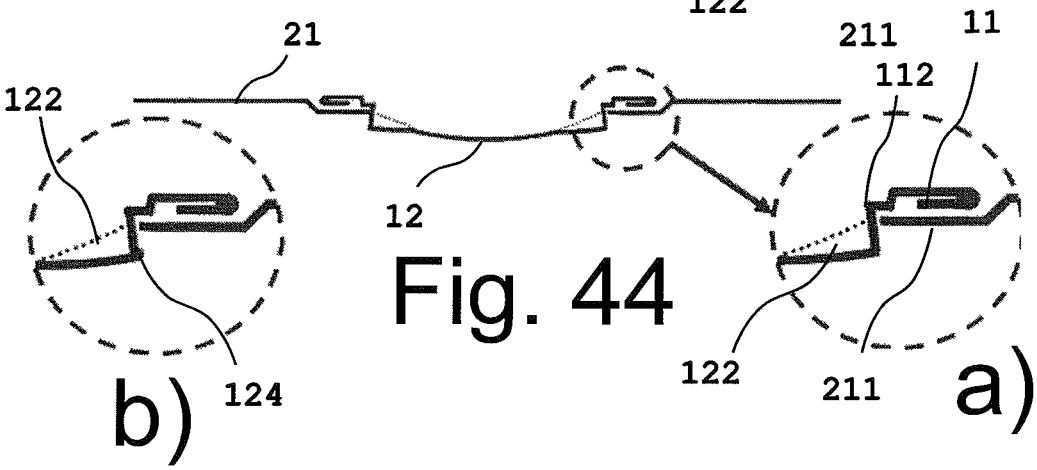

FIG. 44 illustrates a partial sectional view according to FIG. 43 of the beverage can closure element from FIG. 41 in a locked state, with a variant with an additional lug illustrated in circle b).

Figure 45:
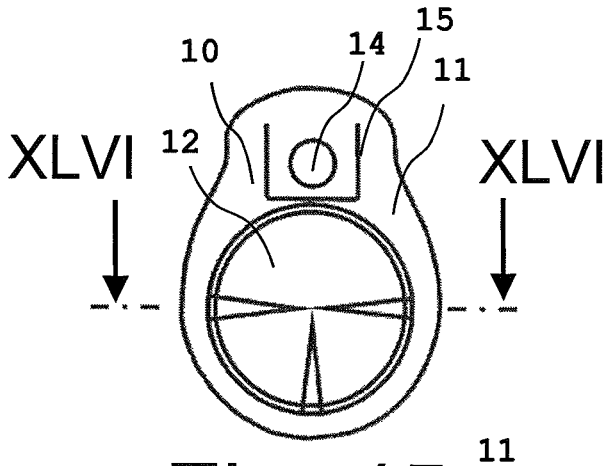

FIG. 45 illustrates a top view of a further embodiment example of a beverage can closure element according to the invention in an unlocked state.

Figure 46:
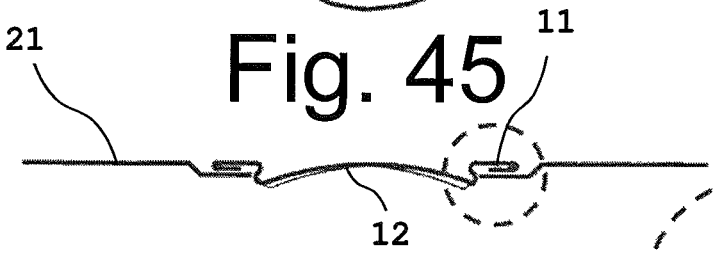

FIG. 46 illustrates a partial sectional view of the beverage can closure element from FIG. 45 with a beverage can lid along the line XLVI-XLVI from FIG. 45 in an unlocked state.

Figure 47:
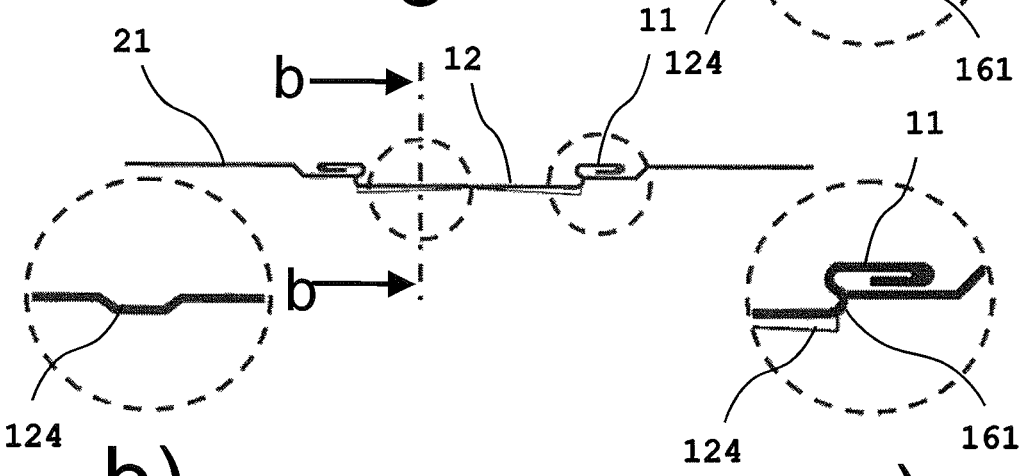

FIG. 47 illustrates a partial sectional view according to FIG. 46 of the beverage can closure element from FIG. 45 in a locked state, with a partial sectional view along the line b-b from FIG. 47 illustrated in circle b).

FIG. 48 illustrates a top view of a further embodiment example of a beverage can closure element according to the invention in an unlocked state.

FIG. 49 illustrates a partial sectional view of the beverage can closure element from FIG. 48 with a beverage can lid along the line XLIX-XLIX from FIG. 48 in an unlocked state.

FIG. 50 illustrates a partial sectional view according to FIG. 49 of the beverage can closure element from FIG. 48 in a locked state, with a partial sectional view along the line b-b from FIG. 50 illustrated in circle b).

FIG. 51 illustrates a top view of a further embodiment example of a beverage can closure element according to the invention in an unlocked state.

FIG. 52 illustrates a partial sectional view of the beverage can closure element from FIG. 51 with a beverage can lid along the line LII-LII from FIG. 51 in an unlocked state.

FIG. 53 illustrates a partial sectional view according to FIG. 52 of the beverage can closure element from FIG. 51 in a locked state, with a partial sectional view along the line b-b from FIG. 53 illustrated in circle b).

Figure 54:
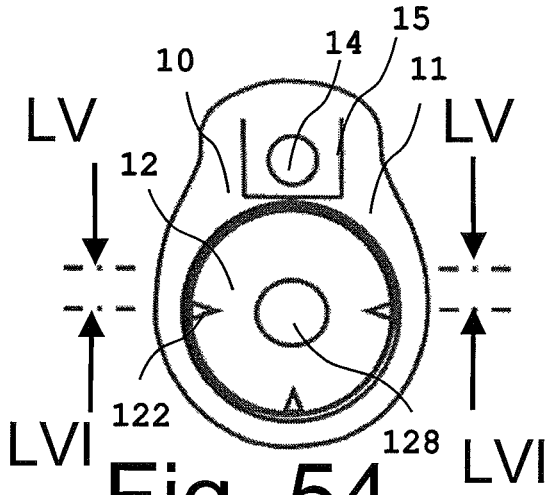

FIG. 54 illustrates a top view of a further embodiment example of a beverage can closure element according to the invention in an unlocked state.

Figure 55:
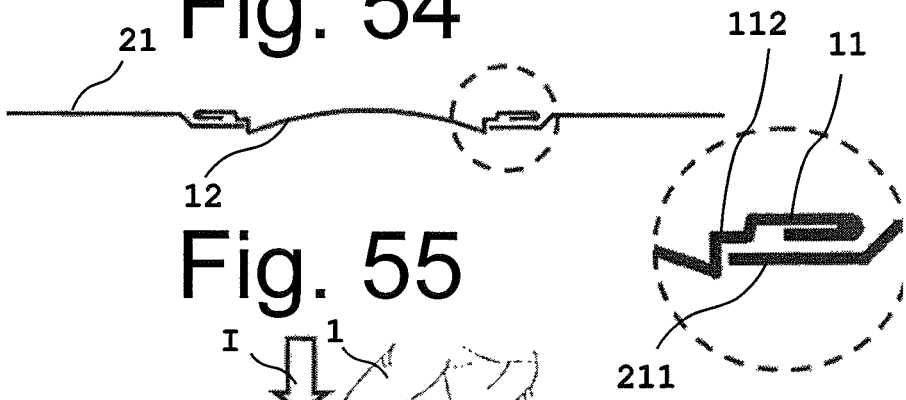

FIG. 55 illustrates a partial sectional view of the beverage can closure element from FIG. 54 with a beverage can lid along the line LV-LV from FIG. 54.

Figure 56:
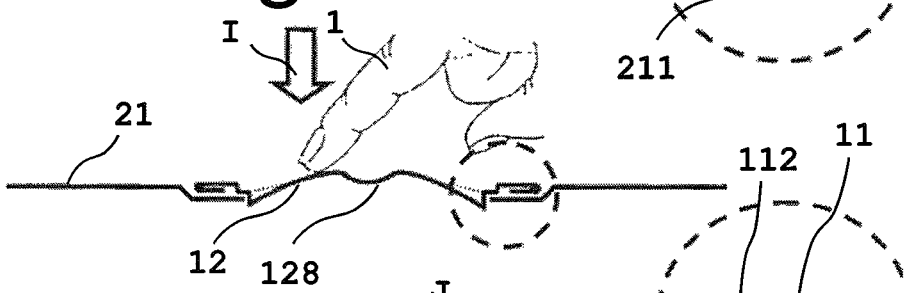

FIG. 56 illustrates a partial sectional view of the beverage can closure element from FIG. 54 with a beverage can lid along the line LVI-LVI from FIG. 54 in an unlocked state.

Figure 57:
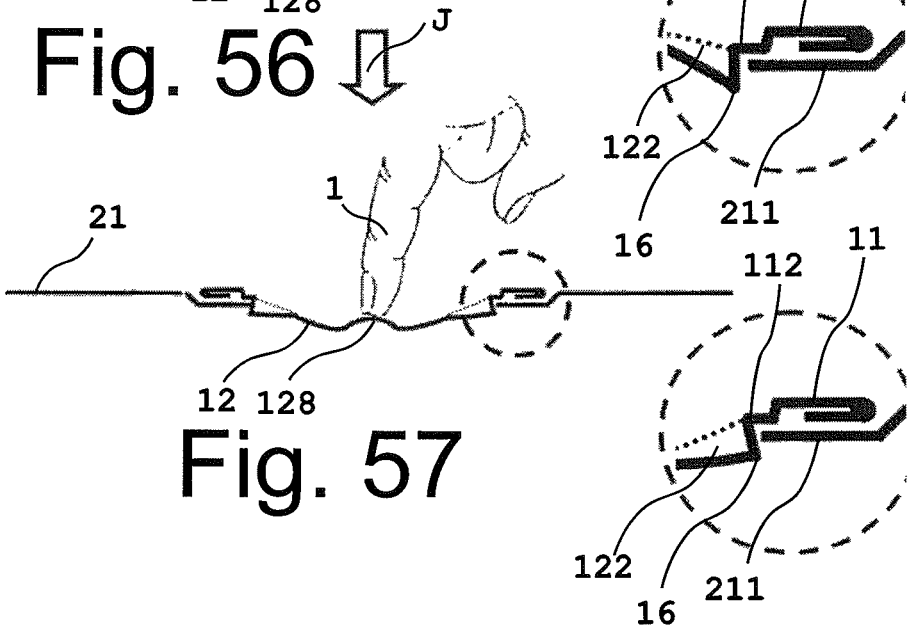

FIG. 57 illustrates a partial sectional view according to FIG. 56 of the beverage can closure element from FIG. 54 in a locked state.

Figure 58:
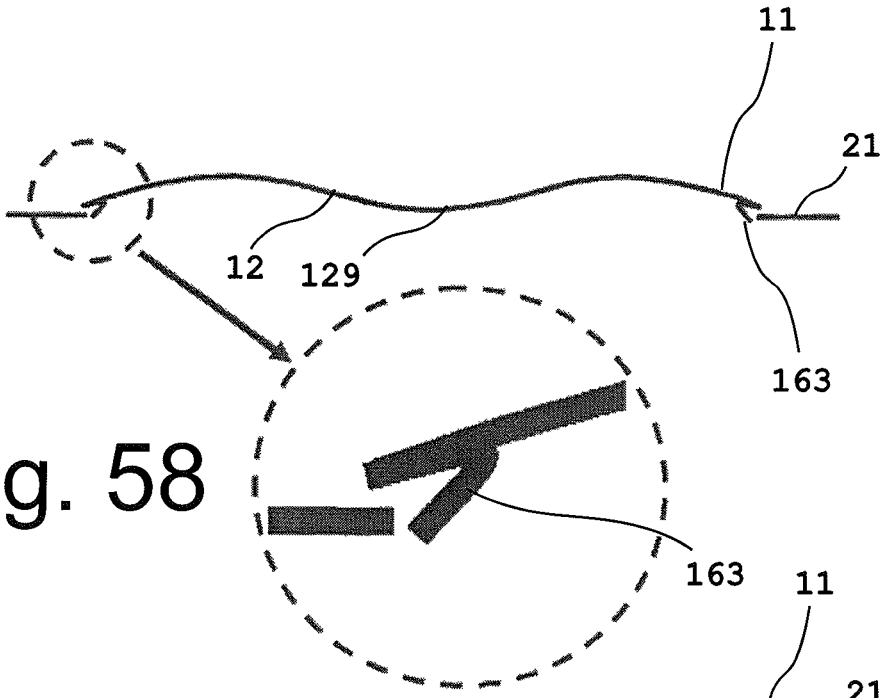

FIG. 58 illustrates a partial sectional view of a further embodiment example of a beverage can closure element according to the invention in an unlocked state.

Figure 59:
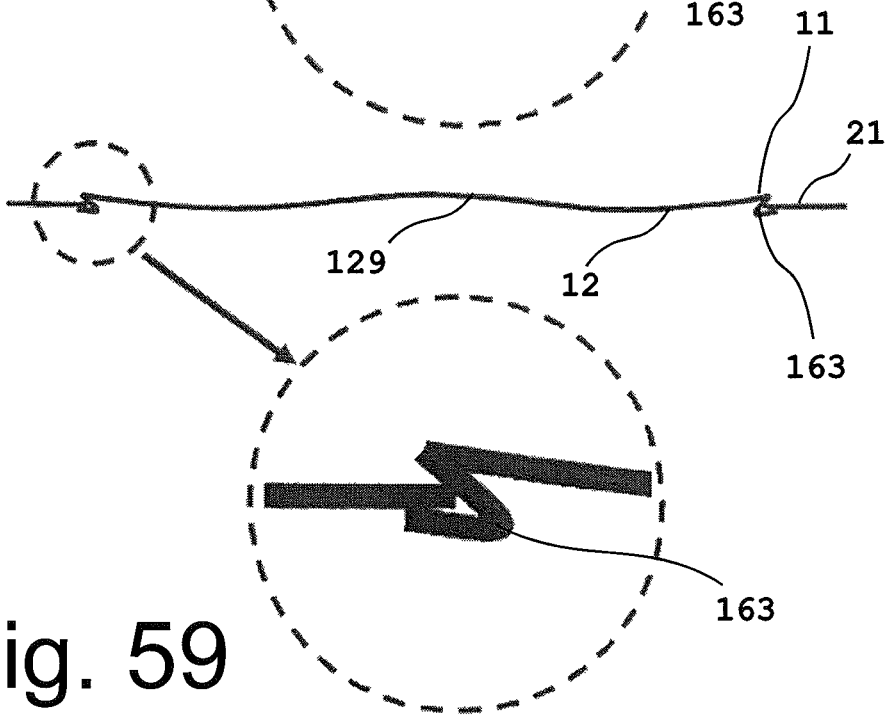

FIG. 59 illustrates a partial sectional view according to FIG. 58 of the beverage can closure element from FIG. 58 in a locked state.

Figure 60:
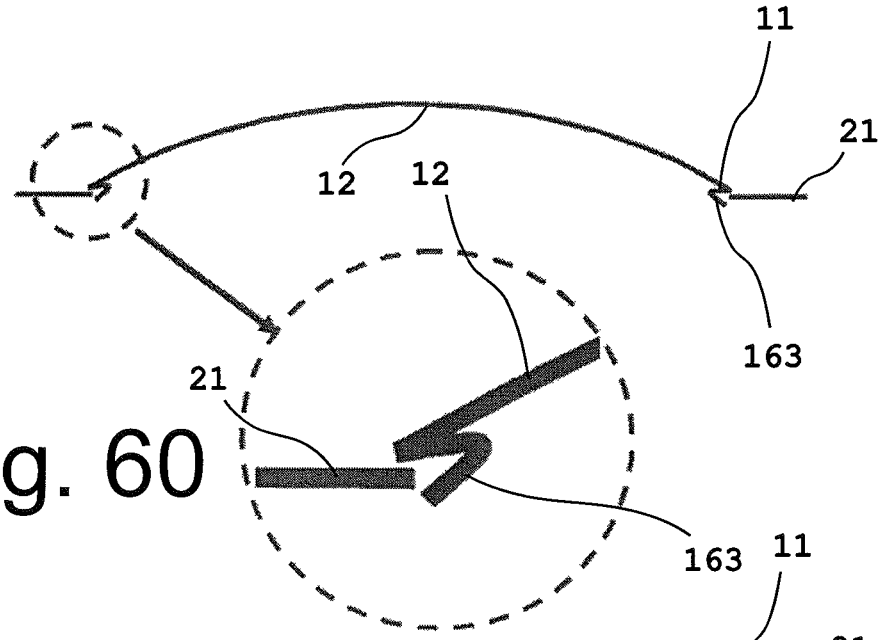

FIG. 60 illustrates a partial sectional view of a further embodiment example of a beverage can closure element according to the invention in an unlocked state.

Figure 61:
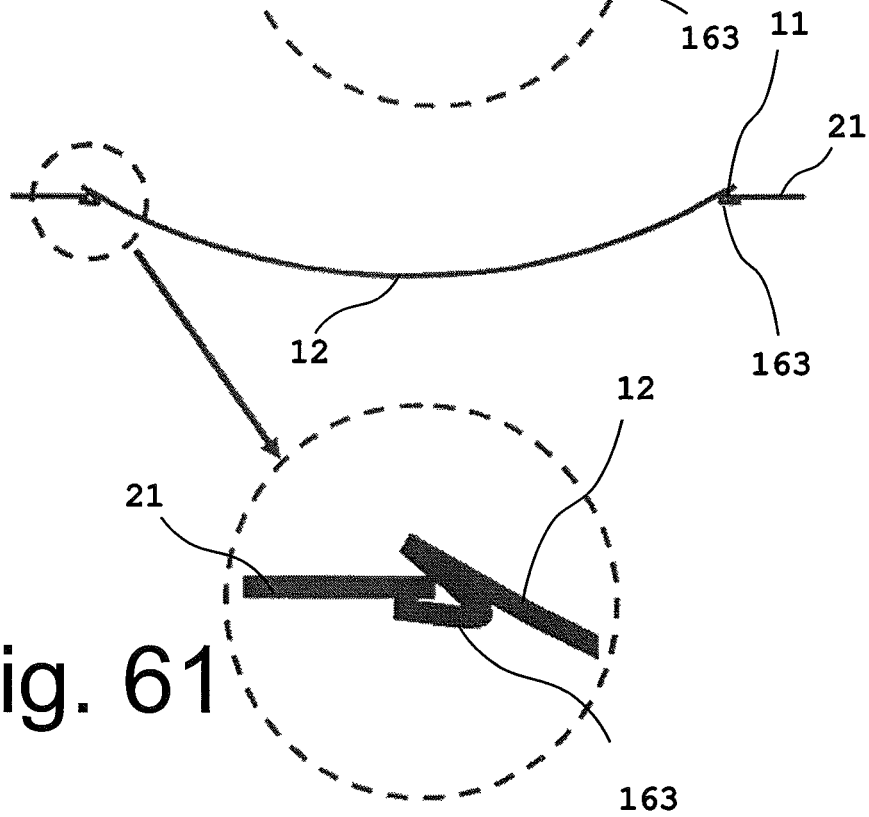

FIG. 61 illustrates a partial sectional view according to FIG. 60 of the beverage can closure element from FIG. 60 in a locked state.

Figure 62:
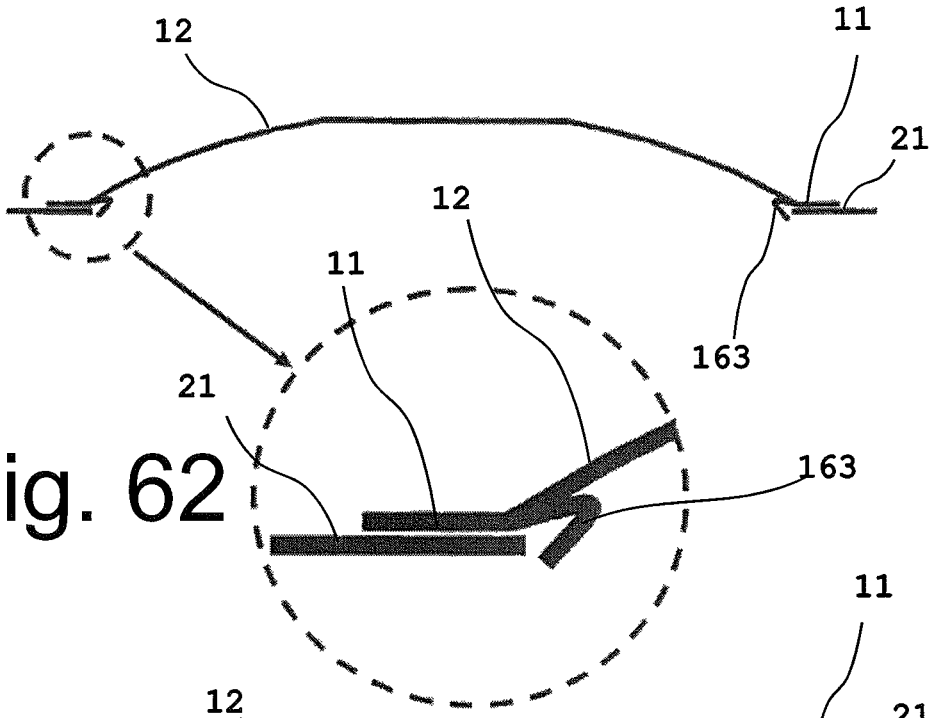

FIG. 62 illustrates a partial sectional view of a further embodiment example of a beverage can closure element according to the invention in an unlocked state.

Figure 63:
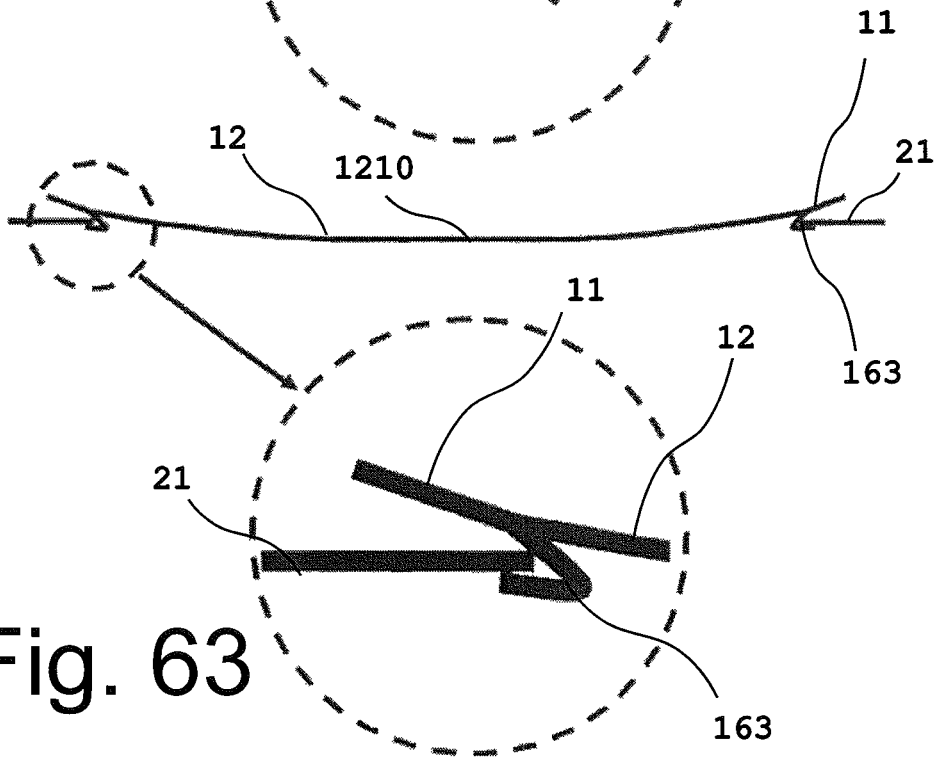

FIG. 63 illustrates a partial sectional view according to FIG. 62 of the beverage can closure element from FIG. 62 in a locked state.

Figure 64:
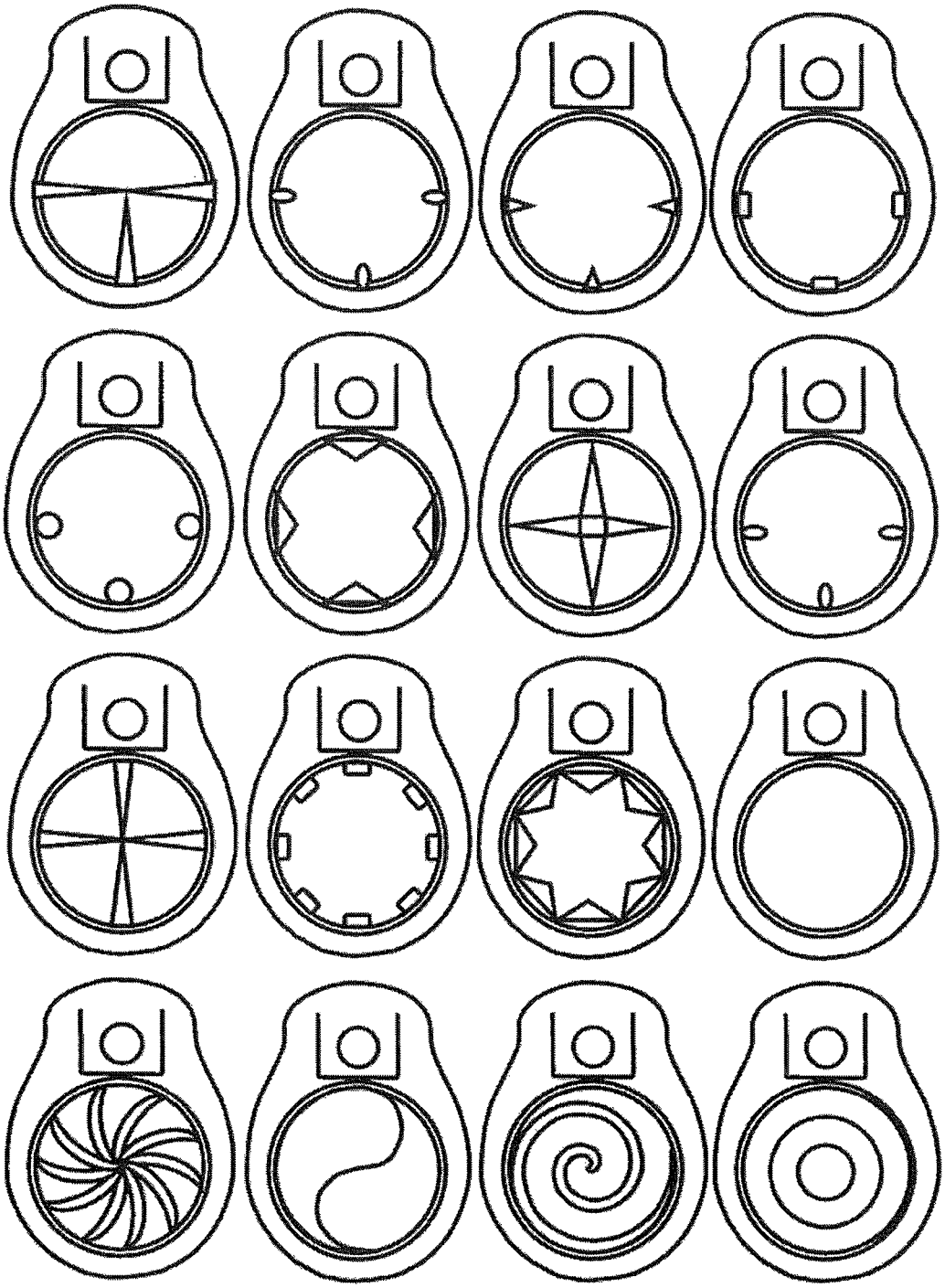

FIG. 64 illustrates 16 further variants with possible lug shapes which, for example, can be alternatively or additionally used in the embodiment examples of the invention illustrated in FIGS. 33 to 53.

Figure 65:
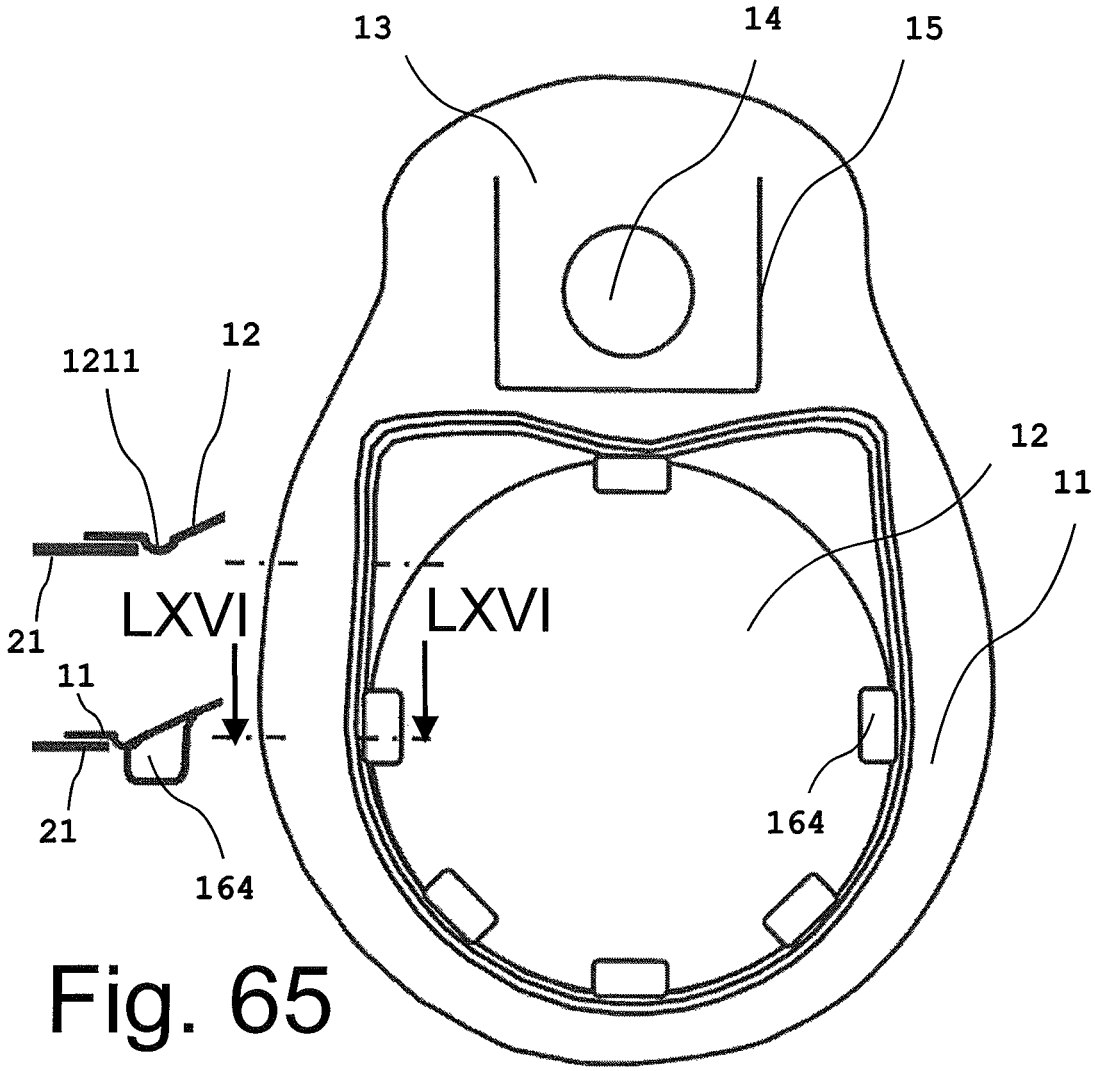

FIG. 65 illustrates a top view of a further embodiment example of a beverage can closure element according to the invention in an unlocked state, with two partial sectional views corresponding to the dotted lines illustrated on the right-hand rim.

Figure 66:
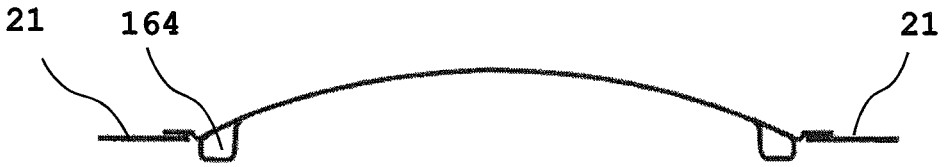

FIG. 66 illustrates a partial sectional view of the beverage can closure element from FIG. 65 with a beverage can lid along the line LXVI-LXVI from FIG. 65 in an unlocked state.

Figure 67:
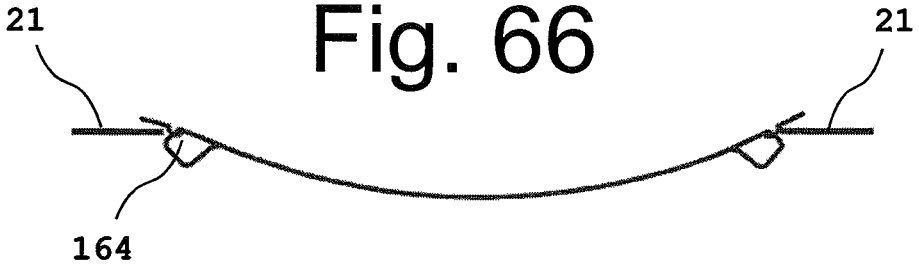

FIG. 67 illustrates a partial sectional view according to FIG. 66 of the beverage can closure element from FIG. 65 in a locked state.

Figure 68:
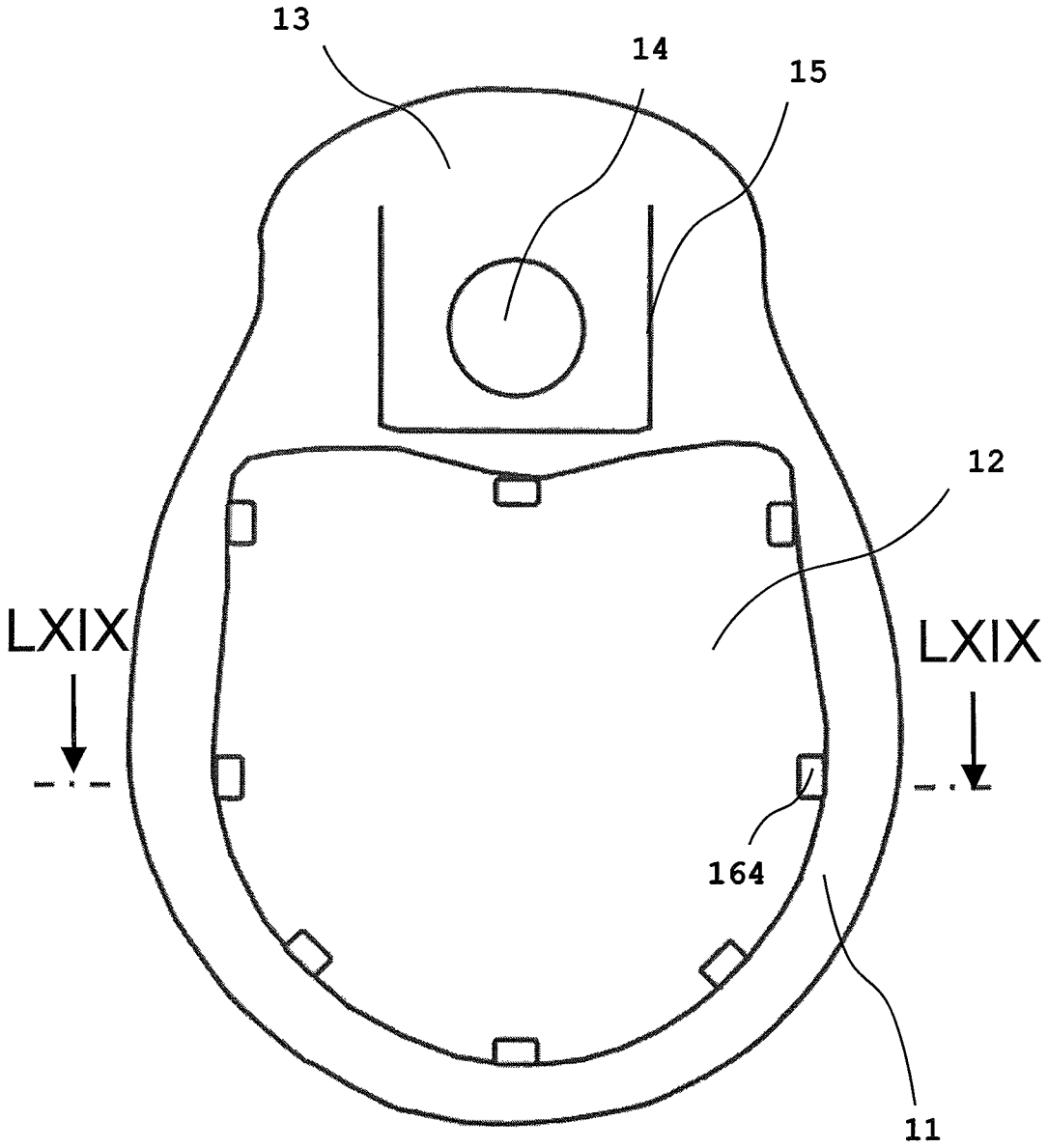

FIG. 68 illustrates a top view of a further embodiment example of a beverage can closure element according to the invention in an unlocked state.

Figure 69:
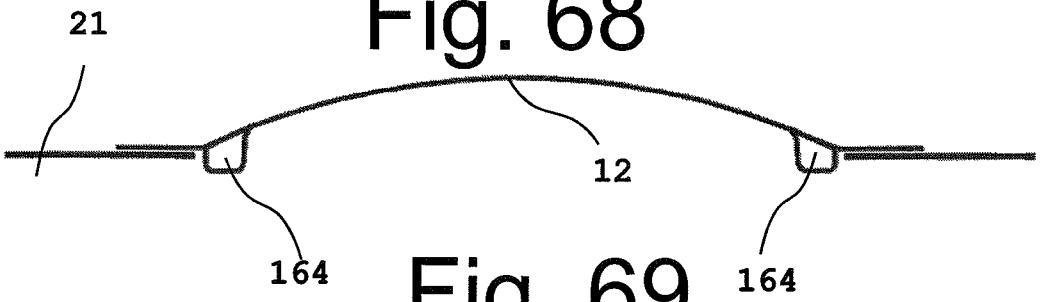

FIG. 69 illustrates a partial sectional view of the beverage can closure element from FIG. 68 with a beverage can lid along the line LXIX-LXIX from FIG. 68 in an unlocked state.

Figure 70:
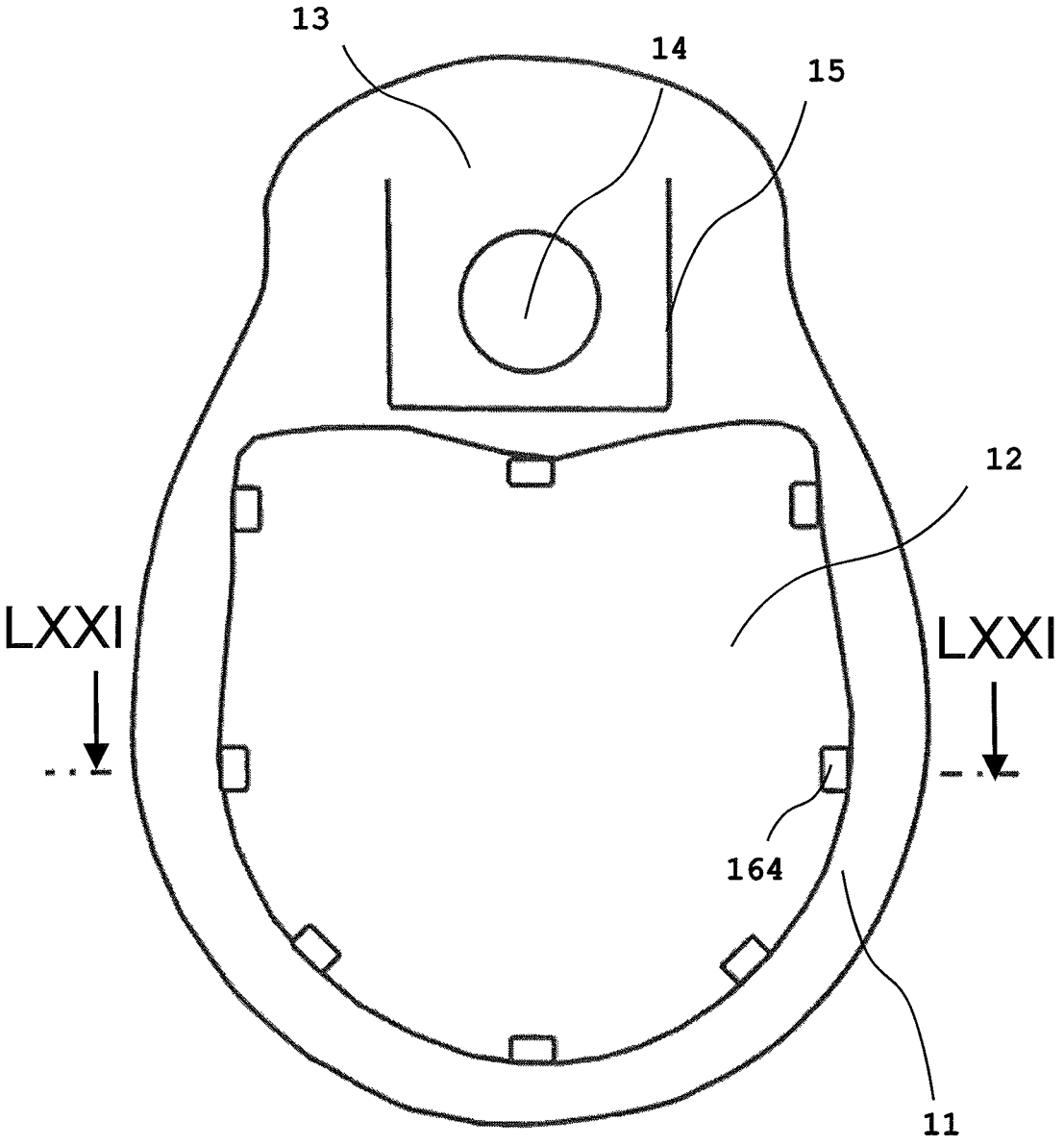

FIG. 70 illustrates a top view of the embodiment example of a beverage can closure element from FIG. 68 in a locked state.

Figure 71:
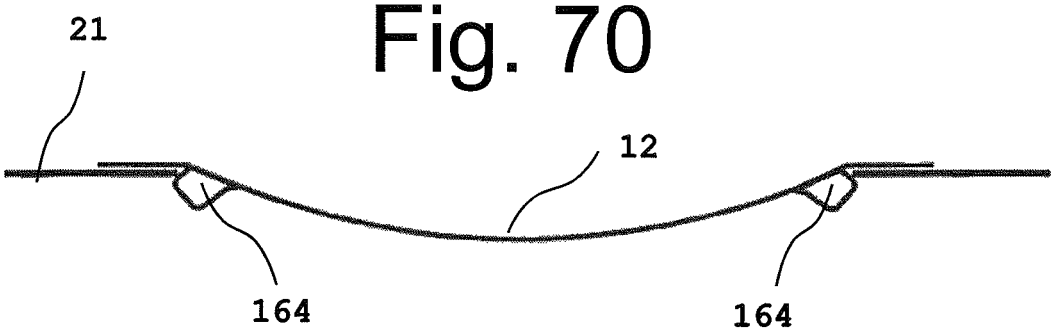

FIG. 71 illustrates a partial sectional view according to FIG. 69 of the beverage can closure element from FIG. 68 with a beverage can lid along the line LXXI-LXXI in a locked state.

Figure 72:
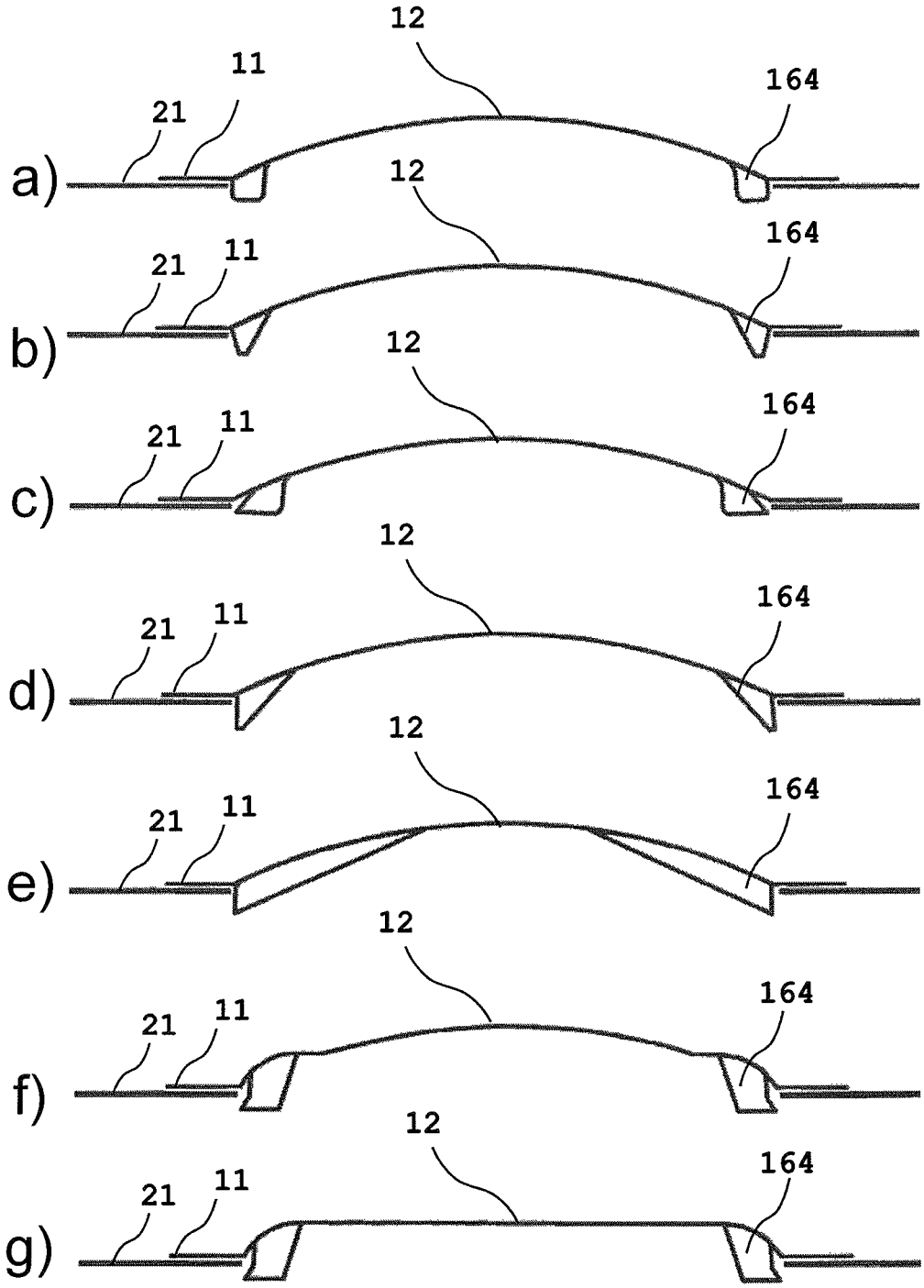

FIGS. 72*a*) to *g*) illustrate variants of partial sectional views of a beverage can closure element in a depiction according to FIG. 69 with a beverage can lid which are preferable alternatives to the partial sectional views illustrated in FIG. 66 or 69 in unlocked states.

FIGS. 73*a*) to *g*) illustrate variants of FIGS. 72*a*) to *g*) in a locked state.

FIGS. 74*a*) to *e*) illustrate variants of side views of beverage can closure elements according to the invention with a partially illustrated beverage can lid.

Figure 74:
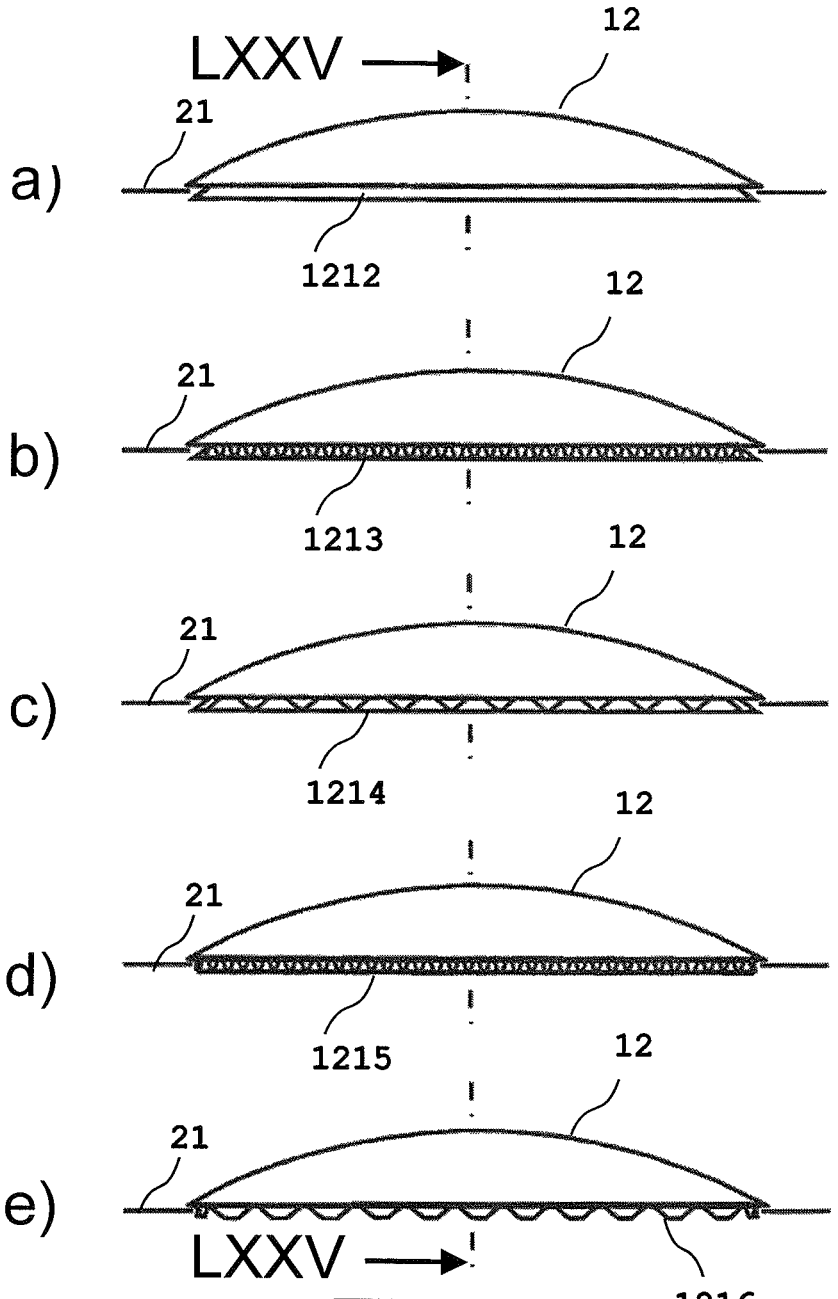
Figure 75:
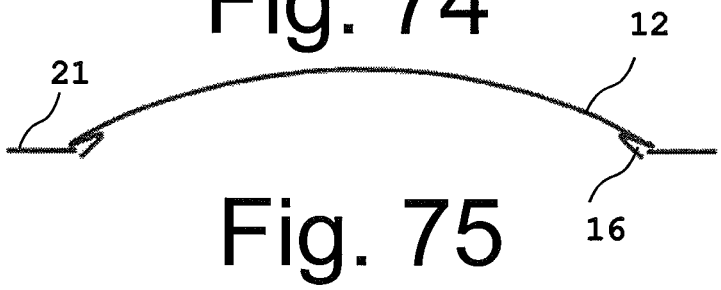

FIG. 75 illustrates a section along the line LXXV-LXXV from FIG. 74.

Figure 76:
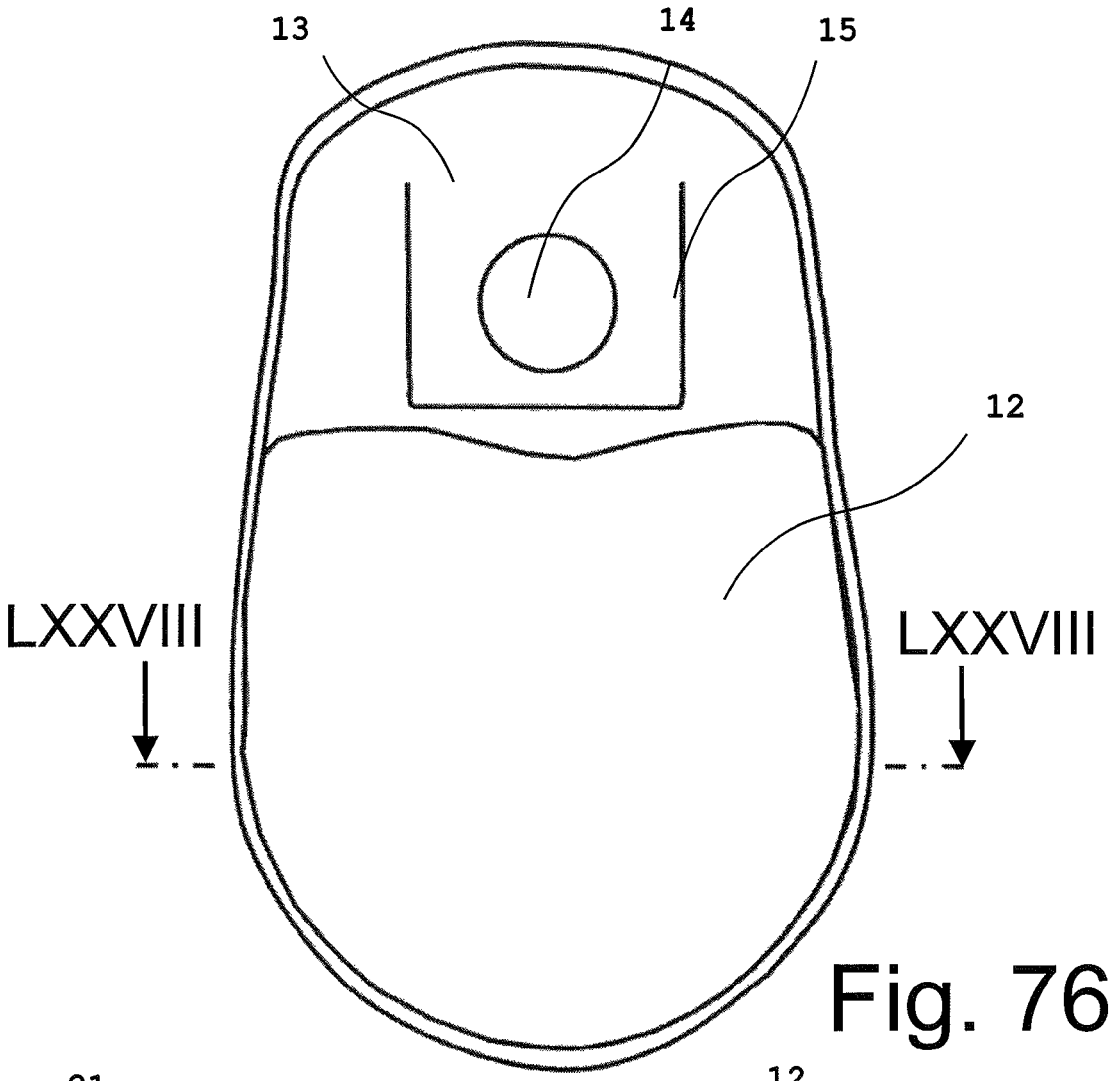

FIG. 76 illustrates a top view of a further embodiment example of a beverage can closure element according to the invention in an unlocked state.

Figure 77:
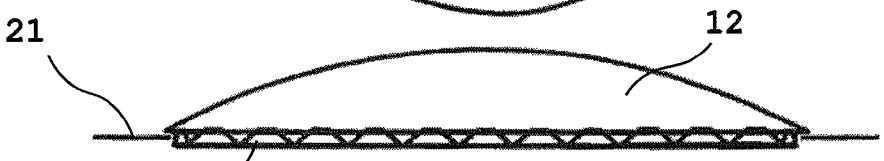

FIG. 77 illustrates a side view of the beverage can closure element with a beverage can lid in a view according to FIGS. 74*a*) to *e*).

Figure 78:
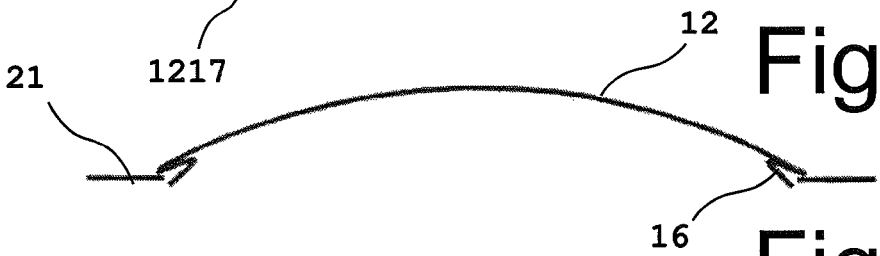

FIG. 78 illustrates a partial sectional view of the beverage can closure element from FIG. 76 with a beverage can lid along the line LXXVIII-LXXIII from FIG. 76 in an unlocked state.

Figure 79:
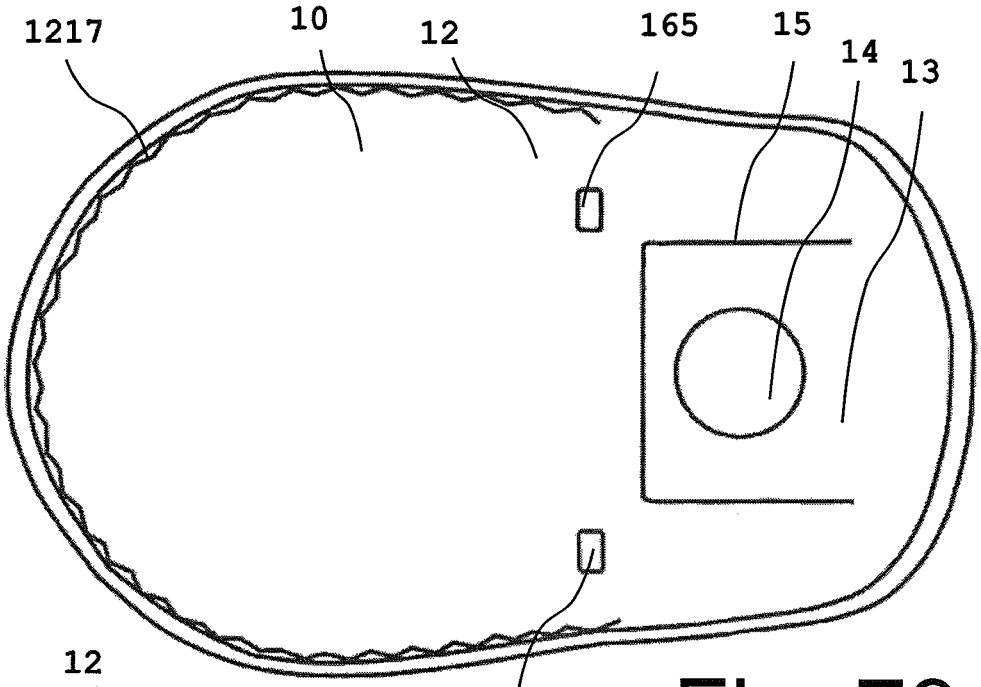

FIG. 79 illustrates a top view of a further embodiment example of a beverage can closure element according to the invention in an unlocked state.

Figure 80:
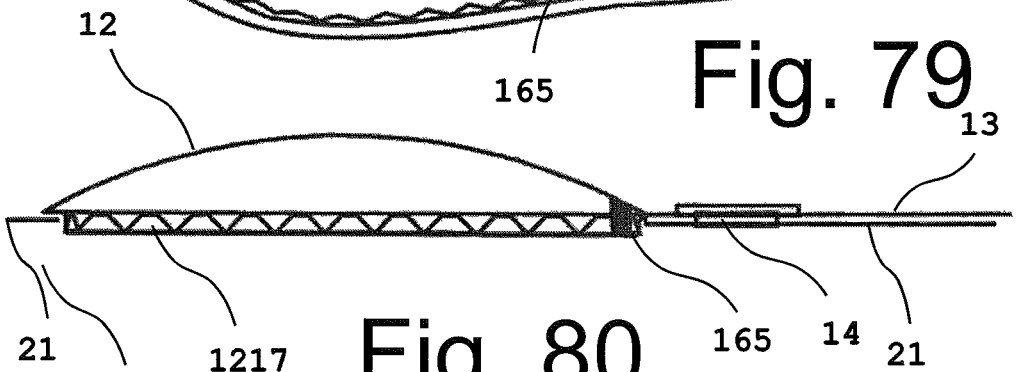

FIG. 80 illustrates a side view of the beverage can closure element with a beverage can lid in a view according to FIGS. 74*a*) to *e*) in an unlocked state.

Figure 81:
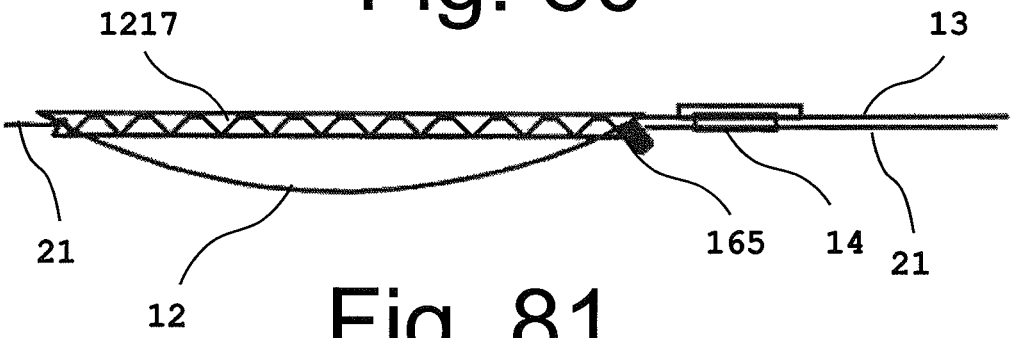

FIG. 81 illustrates a side view of the beverage can closure element with a beverage can lid in a view according to FIG. 80, but in a locked state.

Figure 82:
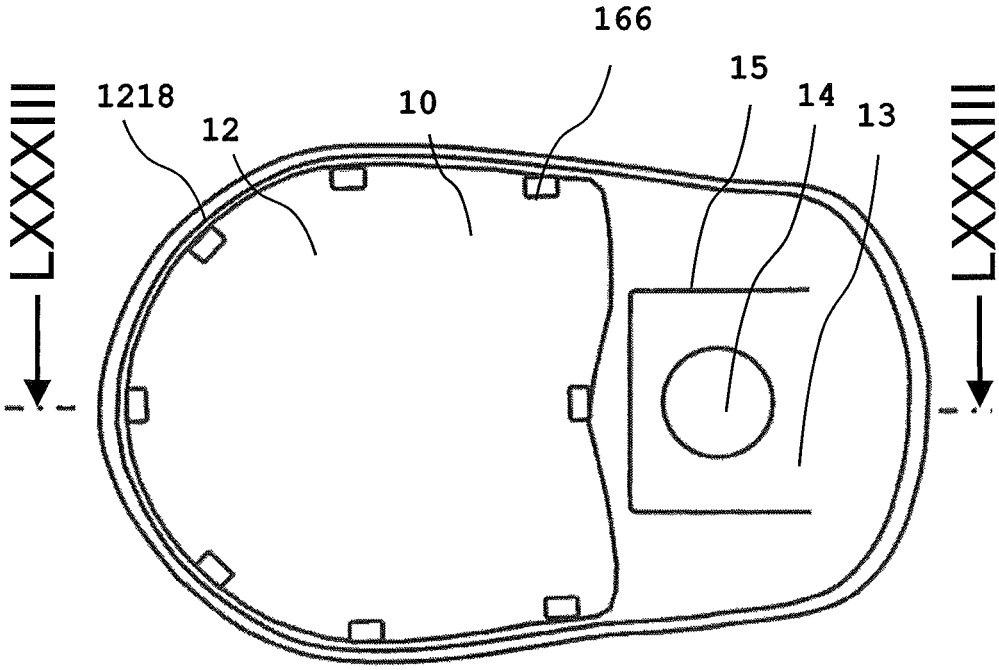

FIG. 82 illustrates a top view of a further embodiment example of a beverage can closure element according to the invention in an unlocked state.

Figure 83:
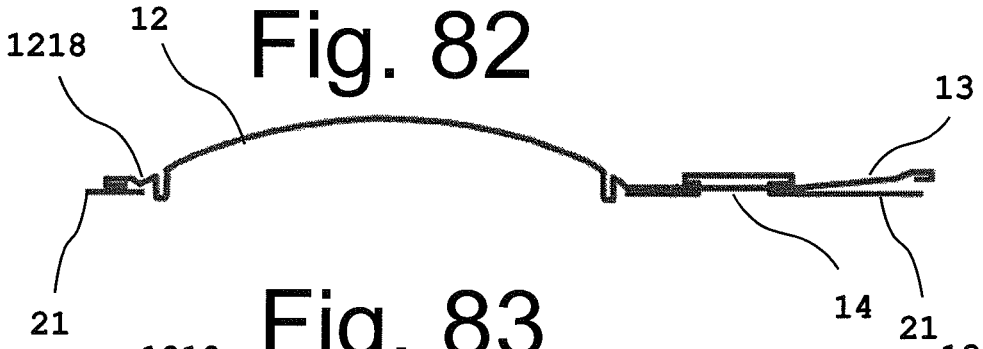

FIG. 83 illustrates a partial sectional view of the beverage can closure element from FIG. 82 with a beverage can lid along the line LXXXIII-LXXXIII from FIG. 82 in an unlocked state.

Figure 84:
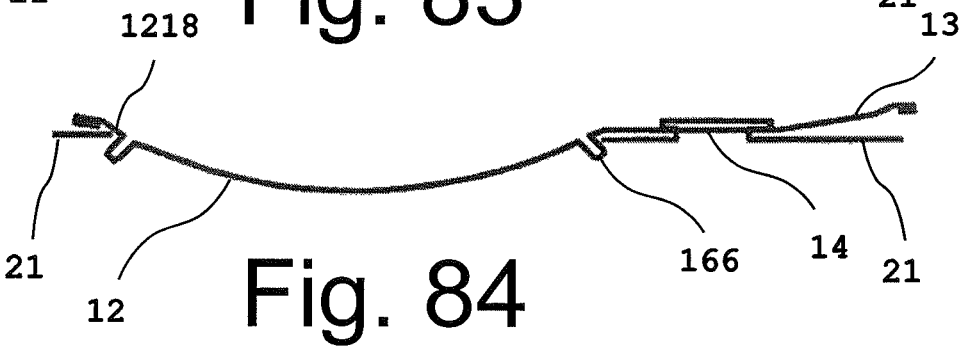

FIG. 84 illustrates a partial sectional view according to FIG. 83 of the beverage can closure element from FIG. 82 with a beverage can lid along the line LXXXIII-LXXXIII in a locked state.

Figure 85:
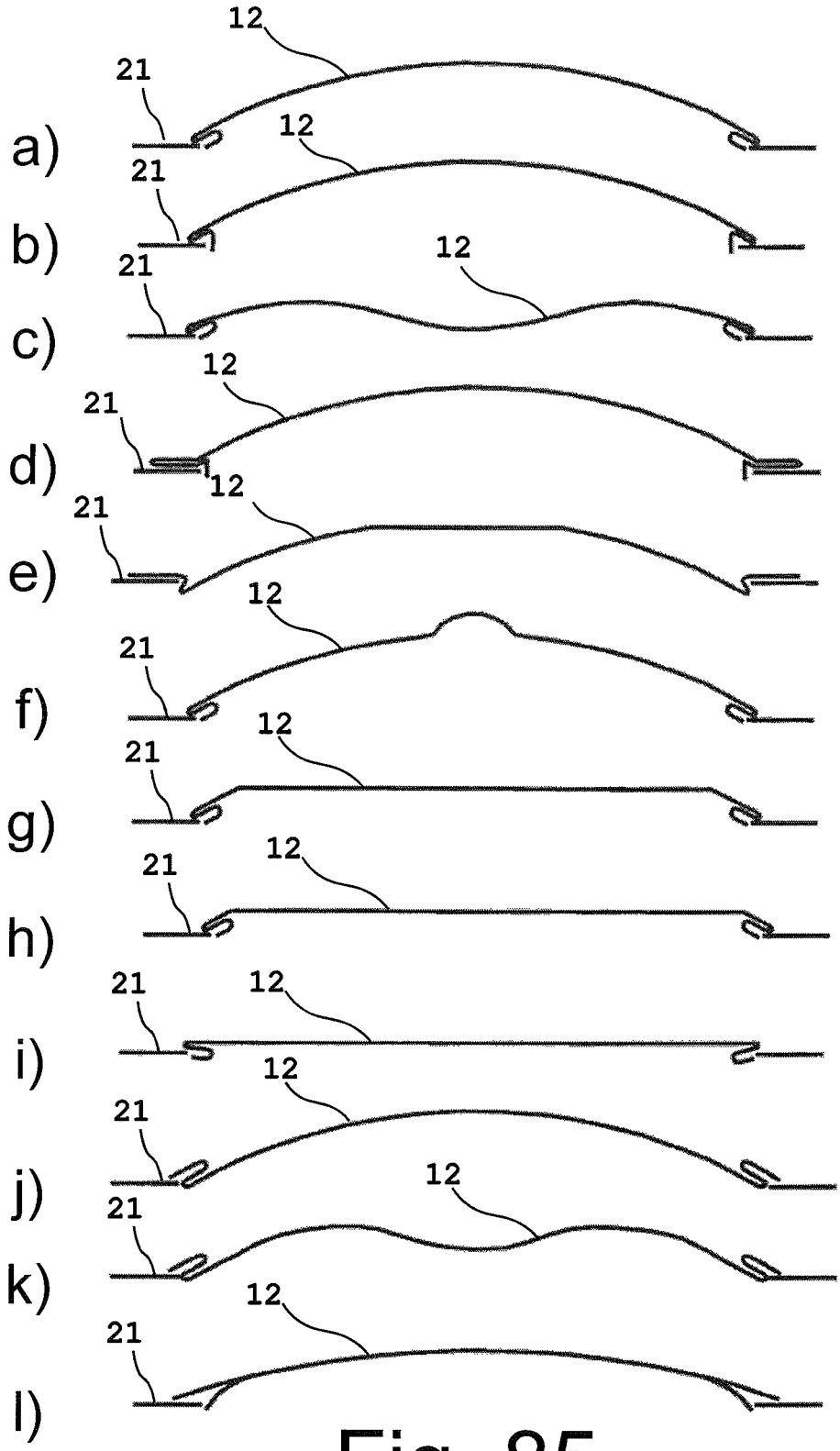

FIGS. 85*a*) to *l*) illustrate partial sectional views of alternative beverage can closure elements in a depiction according to FIG. 83 with a beverage can lid in an unlocked state.

Figure 86A:
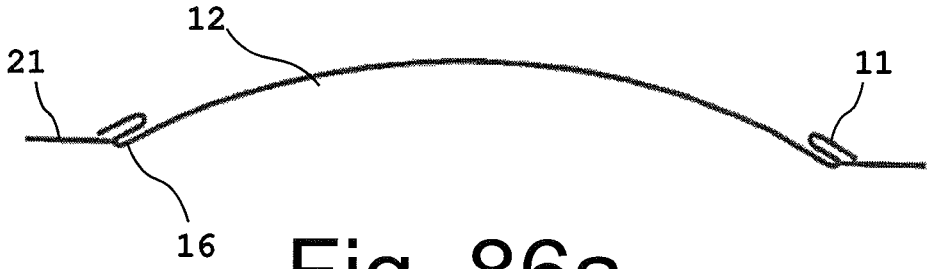
Figure 86B:
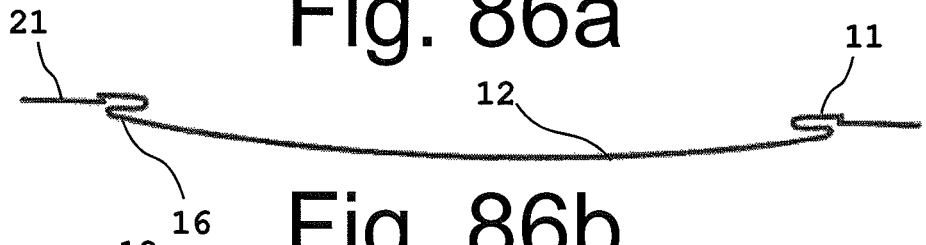
Figure 87A:
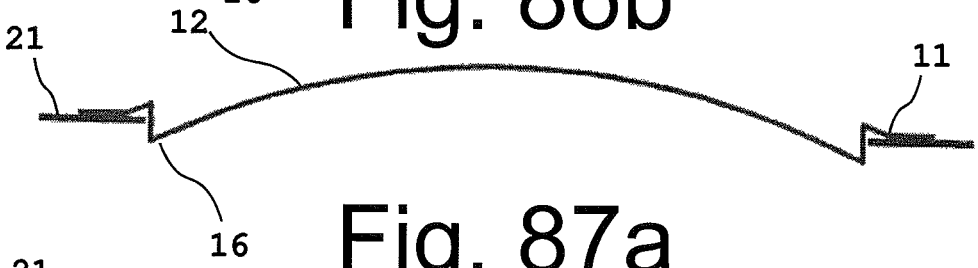
Figure 87B:
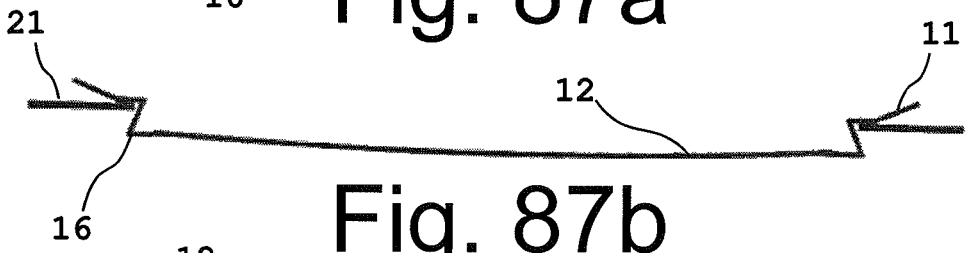
Figure 88A:
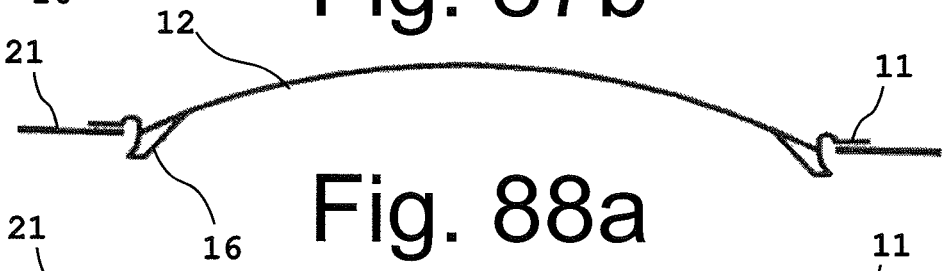
Figure 88B:
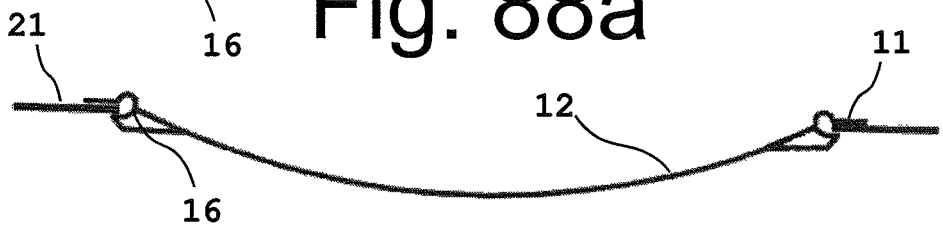

FIGS. 86 *a*) and *b*), 87 *a*) and *b*) and 88 *a*) and *b*) illustrate partial sectional views of alternative beverage can closure elements in a depiction according to FIG. 83 with a beverage can lid, with Figure a) depicting an unlocked state, and with Figure b) depicting the respective corresponding locked state.

Figure 89:
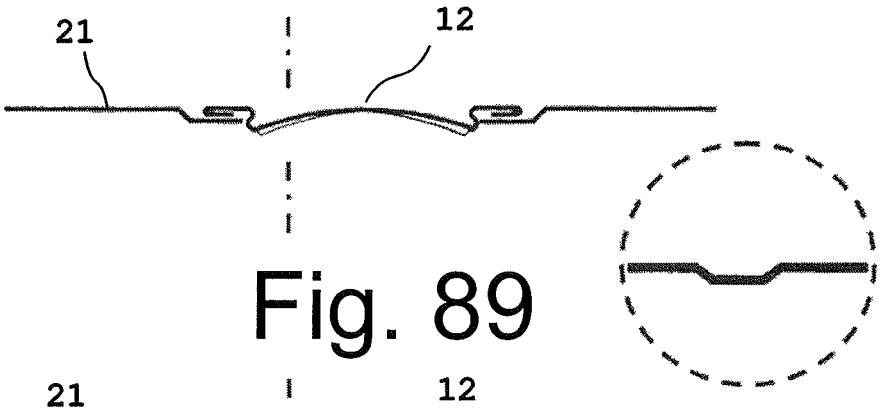
Figure 90:
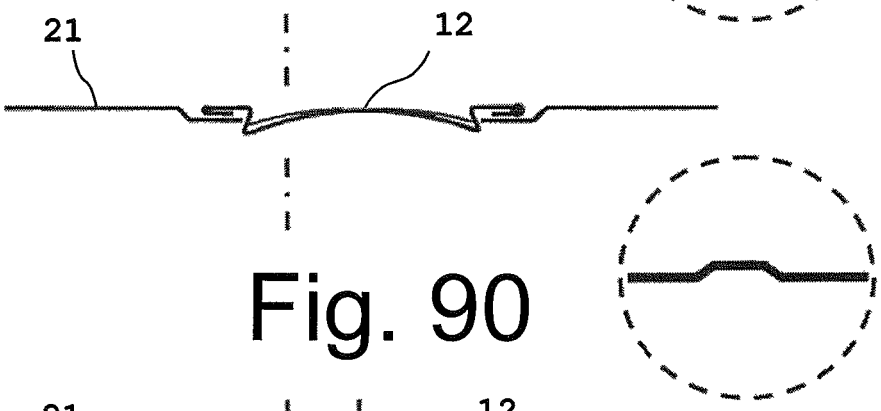
Figure 91:
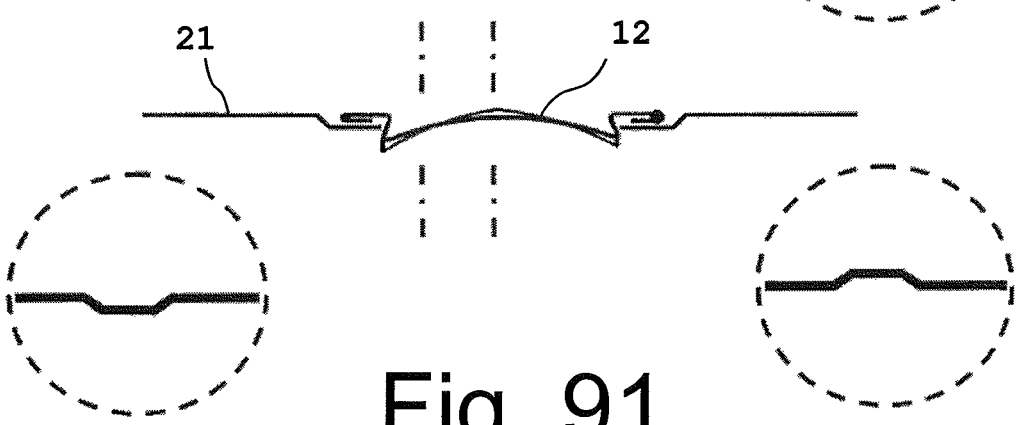

FIGS. 89 to 91 illustrate partial sectional views of alternative beverage can closure elements in a depiction according to FIG. 83 with a beverage can lid, with the respective partial sectional views of the ribs, grooves or beading along the dashed lines depicted in the circles.

Figure 92:
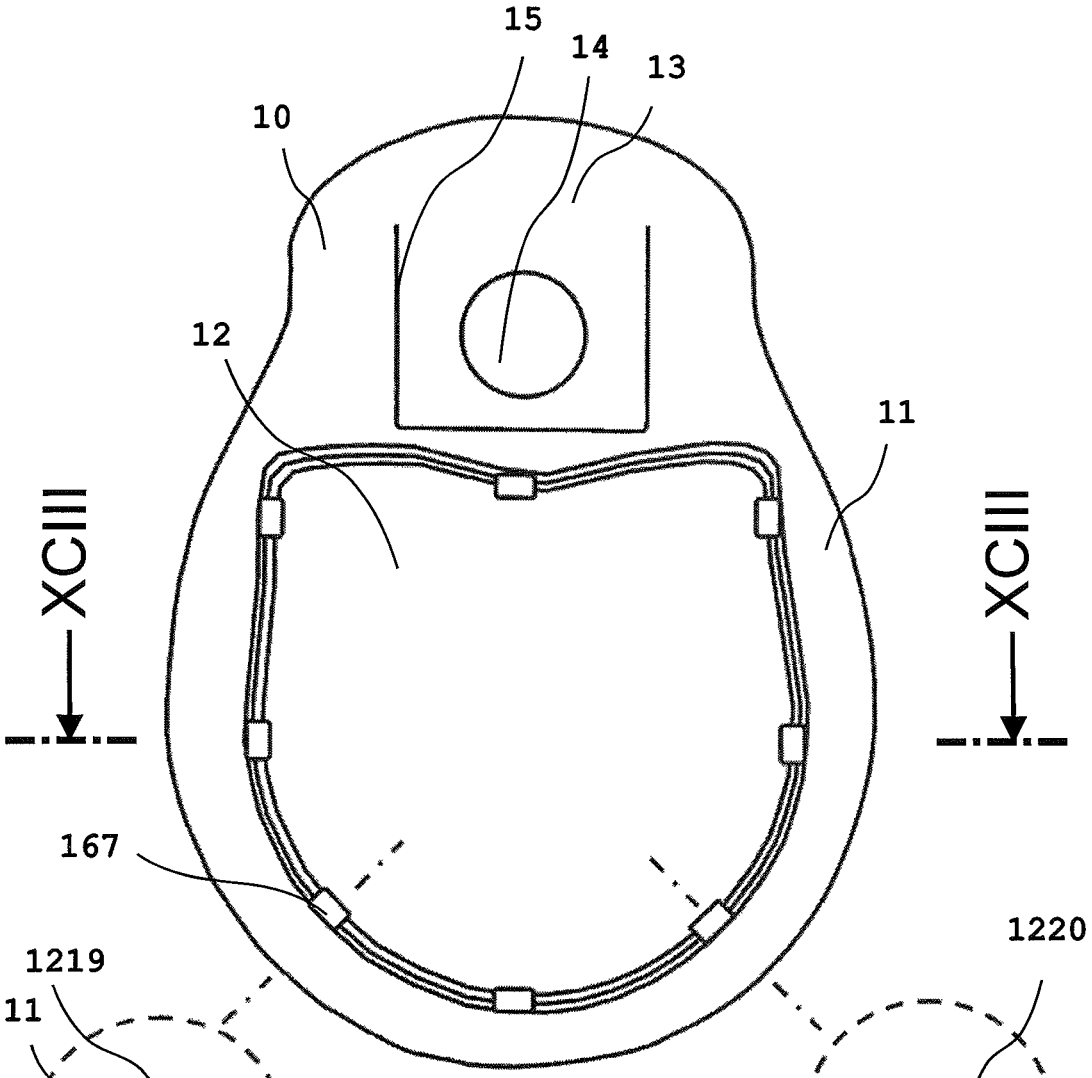

FIG. 92 illustrates a top view of a further embodiment example of a beverage can closure element according to the invention in an unlocked state, with an alternative embodiment of the locking element illustrated in the circle on the right which can be provided as an alternative or additionally to the locking element illustrated in the circle on the left.

Figure 93:
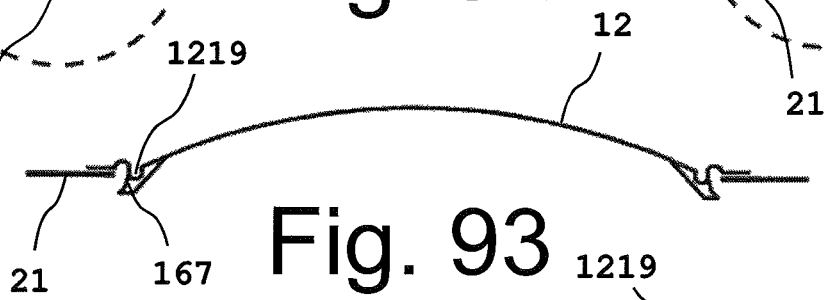

FIG. 93 illustrates a partial sectional view of the beverage can closure element from FIG. 92 with a beverage can lid along the line XCIII-XCIII from FIG. 92 in an unlocked state.

Figure 94:
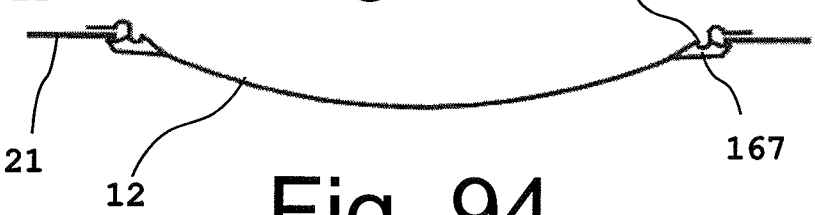

FIG. 94 illustrates a partial sectional view according to FIG. 93 of the beverage can closure element from FIG. 92 with a beverage can lid along the line XCIII-XCIII in a locked state.

Figure 95:
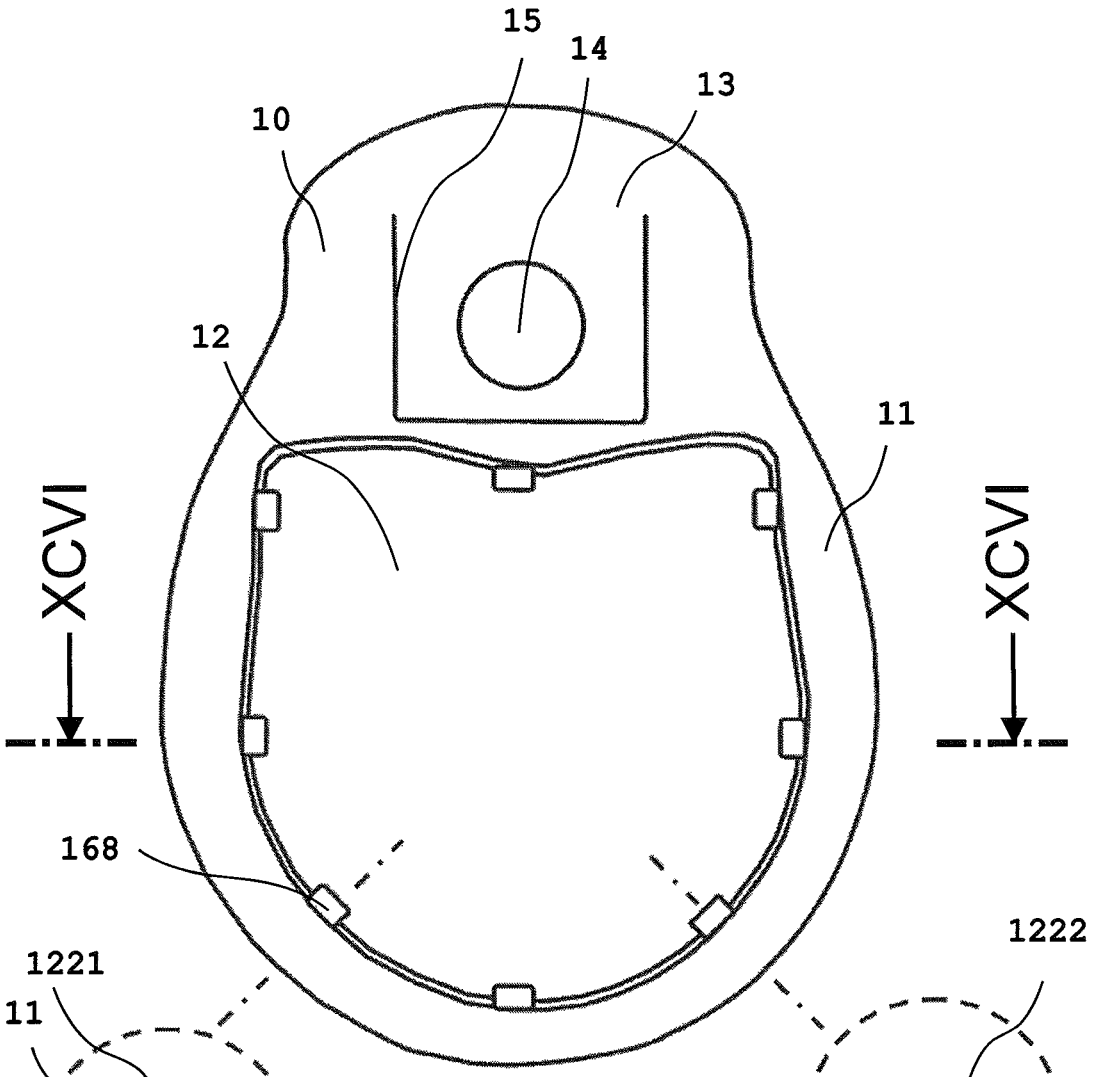

FIG. 95 illustrates a top view of a further embodiment example of a beverage can closure element according to the invention in an unlocked state, with an alternative embodiment of the locking element illustrated in the circle on the right, which can be provided as an alternative or additionally to the locking element illustrated in the circle on the left.

Figure 96:
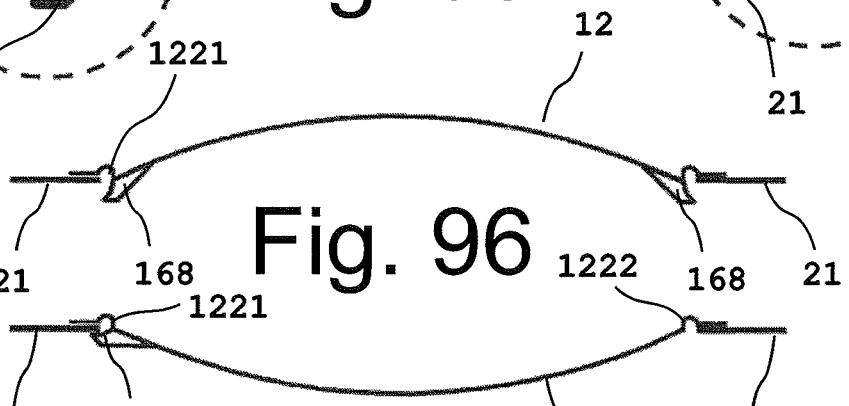

FIG. 96 illustrates a partial sectional view of the beverage can closure element from FIG. 95 with a beverage can lid along the line XCVI-XCVI from FIG. 95 in an unlocked state.

Figure 97:
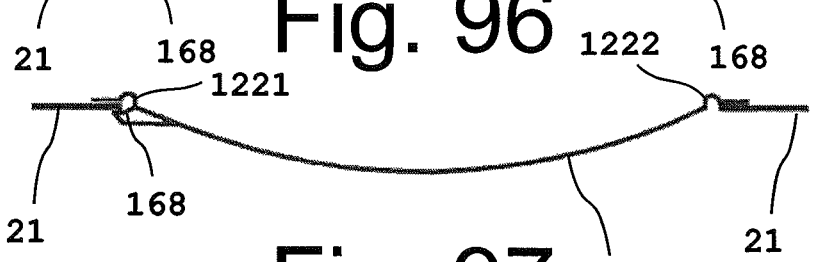

FIG. 97 illustrates a partial sectional view according to FIG. 96 of the beverage can closure element from FIG. 95 with a beverage can lid along the line XCVI-XCVI in a locked state.

Figure 98:
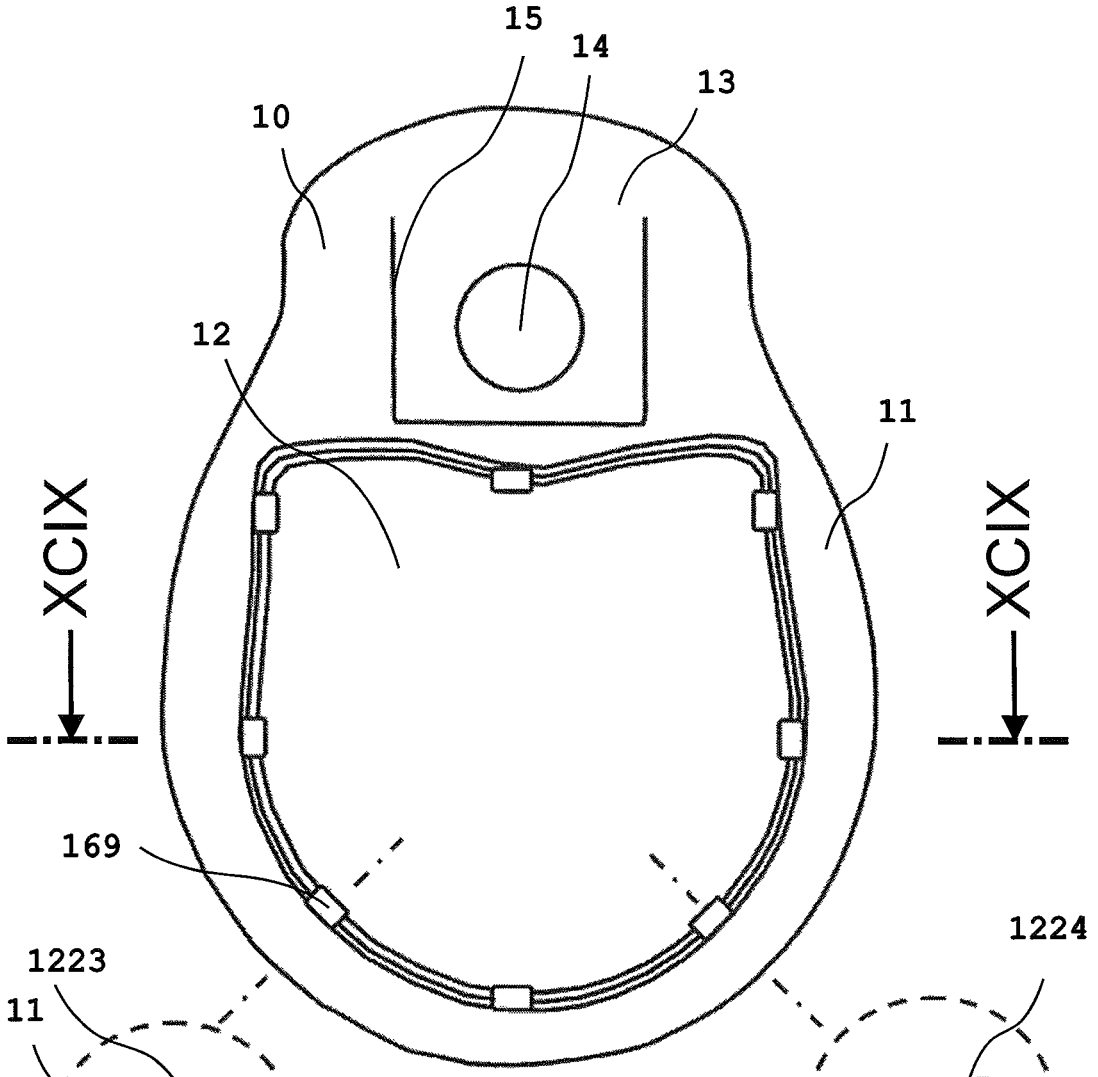

FIG. 98 illustrates a top view of a further embodiment example of a beverage can closure element according to the invention in an unlocked state, with an alternative embodiment of the locking element illustrated in the circle on the right, which can be provided as an alternative or additionally to the locking element illustrated in the circle on the left.

Figure 99:
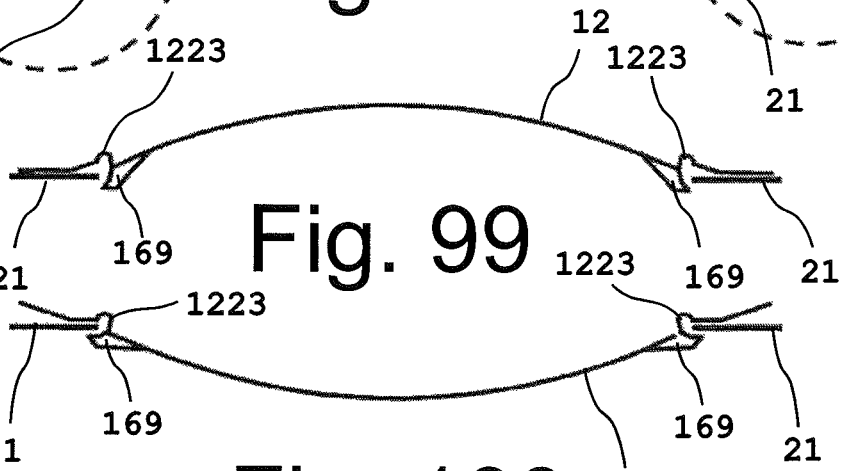

FIG. 99 illustrates a partial sectional view of the beverage can closure element from FIG. 98 with a beverage can lid along the line XCIX-XCIXI from FIG. 98 in an unlocked state.

Figure 100:
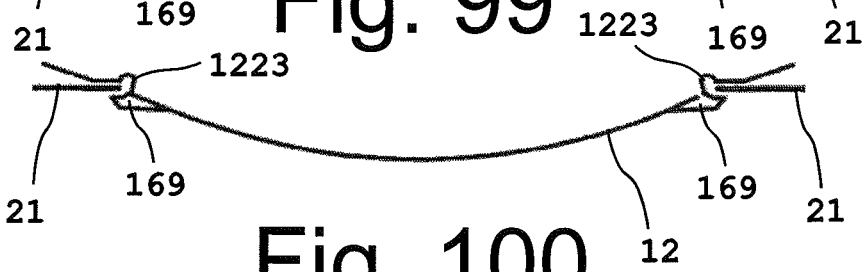

FIG. 100 illustrates a partial sectional view according to FIG. 99 of the beverage can closure element from FIG. 98 with a beverage can lid along the line XCIX-XCIX in a locked state.

FIGS. 101*a*) to *f*) illustrate possible partial sections of embellishing/reinforcing ribs or reinforcing beading, preferably for the embodiment examples of beverage can closure elements according to the invention illustrated in FIGS. 102*a*) to *l*).

FIGS. 102*a*) to *l*) illustrate embodiment examples of beverage can closure elements according to the invention.

The following reference signs are used in the description of the embodiment examples, with corresponding parts or equivalent parts designated with the same reference sign in the case of the different embodiment examples and, due to the description of the subsequent embodiment examples, reference is made to the previous embodiment examples (and vice versa where appropriate):

1 Finger
2 Finger
3 Drinking straw opening
10 Beverage can closure element
11 Rim area (support area)
12 Cover element

Figure 1:
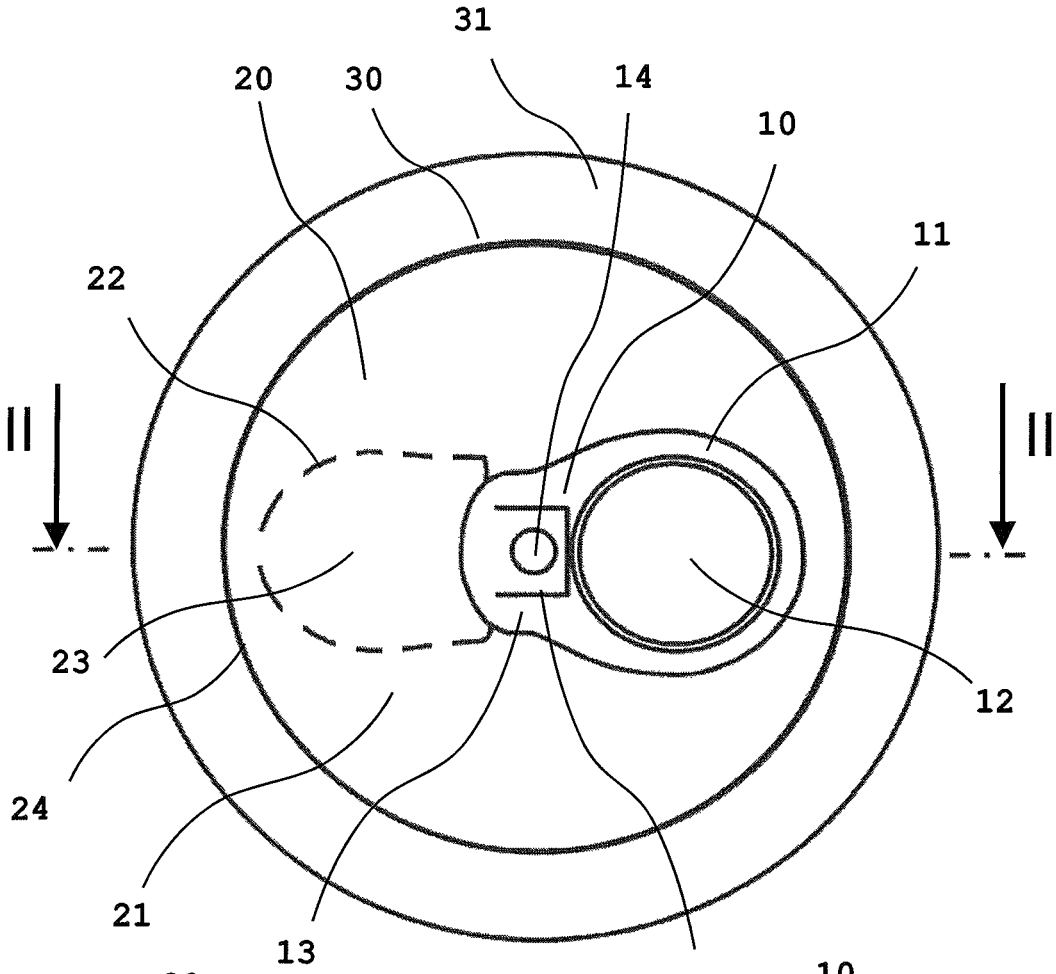
FIG. 1 illustrates a schematic top view of a beverage can with a beverage can lid and beverage can closure element according to an initial embodiment of the invention.

13 Extension
14 Rivet (preferably constitutes the pivoting axis of the beverage can closure element)
15 Penetration line
16 Locking element
17 Opening section
18 Reinforcing beading
19 Wing
20 Beverage can lid
21 Lid section
22 Rupture line
23 Opening section
24 Seam section
25 Groove
30 Beverage can
31 Tapered section
32 Cylindrical section
111 Recess
112 Graduation
121 Extension
122 Bead
123 Depression
124 Lug
125 Reinforcing beading
126 Reinforcing beading
127 Reinforcing rib
128 Depression
129 Indentation
1210 Straight surface section (essentially without curvature)
1211 Slot (preferably circumferential in transition area between rim 11 and cover element 12)
1212 Continuous rim with chamfer
1213 Continuous rim with fine fluting
1214 Continuous rim with coarse fluting
1215 Continuous rim with fine cut-out
1216 Continuous rim with coarse cut-out
1217 Continuous rim with coarse fluting without chamfer
1218 Slot (preferably circumferential in transition area between rim 11 and cover element 12)
1219 Slot (preferably circumferential in transition area between rim 11 and cover element 12)
1220 Slot (preferably circumferential in transition area between rim 11 and cover element 12)
1221 Rib (preferably circumferential in transition area between rim 11 and cover element 12)
1222 Rib (preferably circumferential in transition area between rim 11 and cover element 12)
1223 Rib (preferably circumferential in transition area between rim 11 and cover element 12)
1224 Rib (preferably circumferential in transition area between rim 11 and cover element 12)
161 Rounded circumferential rim
162 Straight circumferential rim
163 Circumferential seam (or encompassing lug)
164 Locking element
165 Locking element
166 Locking element
167 Locking element
168 Locking element
169 Locking element
211 Graduation
300 Additive FIG. 1 illustrates a schematic top view of a beverage can 30 with a beverage can lid 20 and beverage can closure element 10 according to an initial embodiment of the invention. The beverage can closure element 10 exhibits a rim area 11 and cover element 12 suitable for covering the opening in the beverage can 30 after the beverage can is opened.

Furthermore, the beverage can closure element 10 exhibits an extension 13, which extends the rim area 11 on one side. A rivet 14 is provided in the wider rim area created by the extension, which preferably forms a pivoting axis for the beverage can closure element 10. Furthermore, a penetration line 15 is provided in the extension 13, which allows the beverage can closure element to be folded upwards to open the beverage can 30.

The beverage can 30 is a two-part structure and exhibits a beverage can lid 20. The beverage can lid 20 encompasses an essentially level lid section 21 and opening section 23 enclosed by a rupture line 22. The opening section 23 is broken out of the lid section 21 along the rupture line 22 in a known manner when the beverage can is opened.

Furthermore, the beverage can lid 20 exhibits a seam section 24 with which the beverage can lid can be fitted to the body of the beverage can in a known manner.

Furthermore, the beverage can lid 20 exhibits a groove 25 between the lid section and the seam section 24 which collects any emerging liquid and prevents it flowing back into the beverage can.

The beverage can 30 is essentially a cylindrical structure and exhibits a cylindrical section 32 which transforms into a conical tapered section 31 in the upper area, thus enabling stacking of the beverage can 30 in the known manner.

Figure 2:
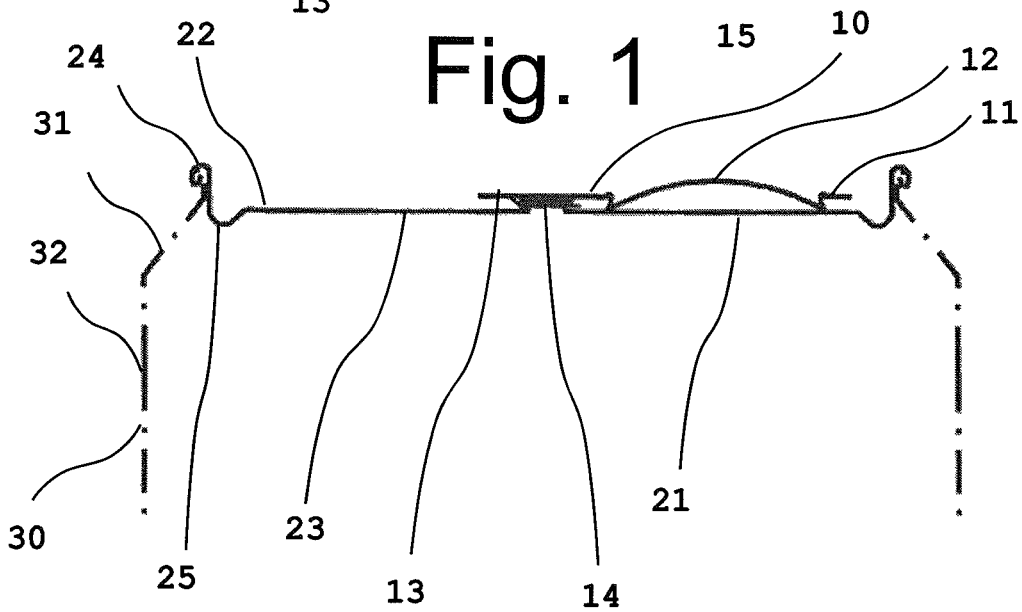
FIG. 2 illustrates a schematic partial sectional view of the beverage can from FIG. 1 along the line II-II from FIG. 1.

According to the embodiment examples of the invention illustrated in FIGS. 1 and 2, the embodiment of the cover element 12 of the beverage can closure element is an upwardly curving surfaced relative to the beverage can (whereby the top of the can is the side exhibiting the beverage can lid). The size and shape of said cover element 12 essentially corresponds to the opening section 23 of the beverage can lid 20 and the opening of the opened beverage can.

FIGS. 1 and 2 illustrate the beverage can prior to initial opening with the opening section 23 still contained in the beverage can lid 20, as can best be discerned in the sectional view from FIG. 2.

The body of the beverage can is only partially illustrated as a dashed line in the partial sectional view from FIG. 2.

Figure 3:
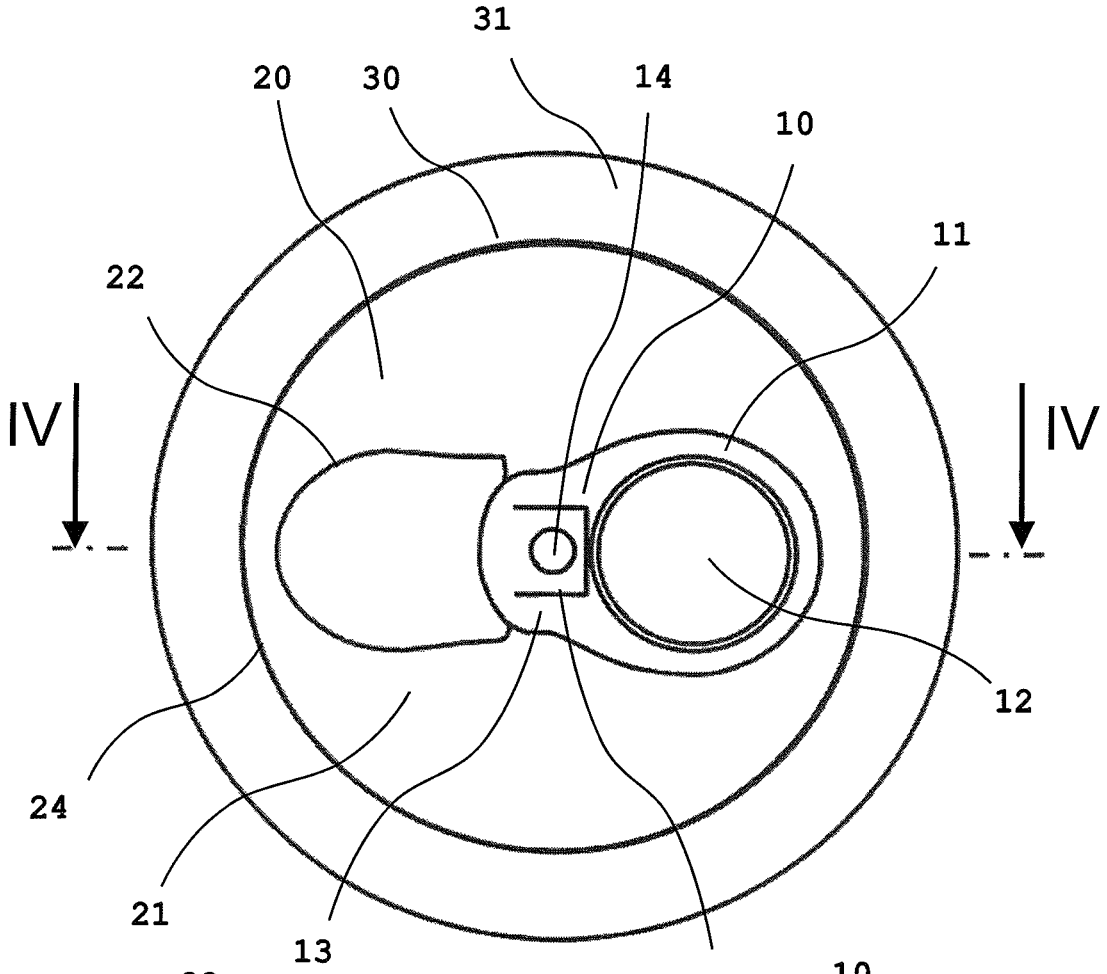
FIG. 3 illustrates a schematic top view of the beverage can from FIG. 1 with the punched-out opening section of the beverage can lid.
Figure 4:
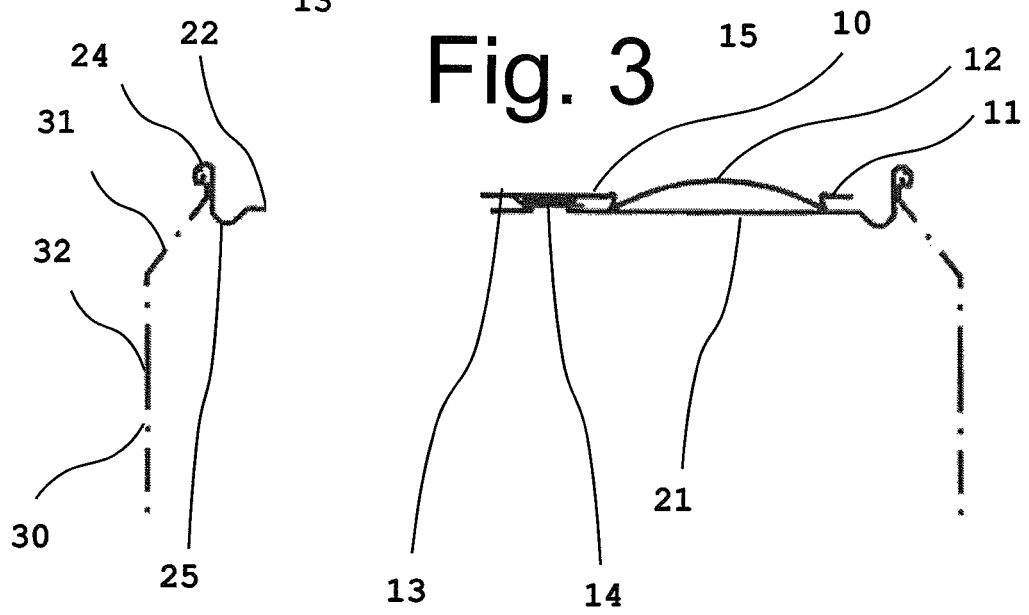
FIG. 4 illustrates a schematic partial sectional view of the opened beverage can from FIG. 1 along the line IV-IV from FIG. 3.

FIGS. 3 and 4 illustrate the beverage can illustrated in FIGS. 1 and 2 after opening, i.e. after the opening section 23 has been broken out of the beverage can lid 20 along the rupture line 22 in the known manner. Opening can, for example, be achieved by bending the beverage can closure element 10 upwards to press the opening section with the extension 13, and this opening section is then broken out of the beverage can lid 20 along the rupture line 22 as a consequence of the pressure exerted by the extension 13.

Naturally enough, another opening mechanism that is known in the art or more obvious can be provided according to the invention. For example, the beverage can closure element can also not be embodied as part of the opening mechanism. The penetration line 15 can be dispensed with in this case, as it is no longer necessary that the embodiment of the beverage can closure element should facilitate bending upwards.

Figure 5:
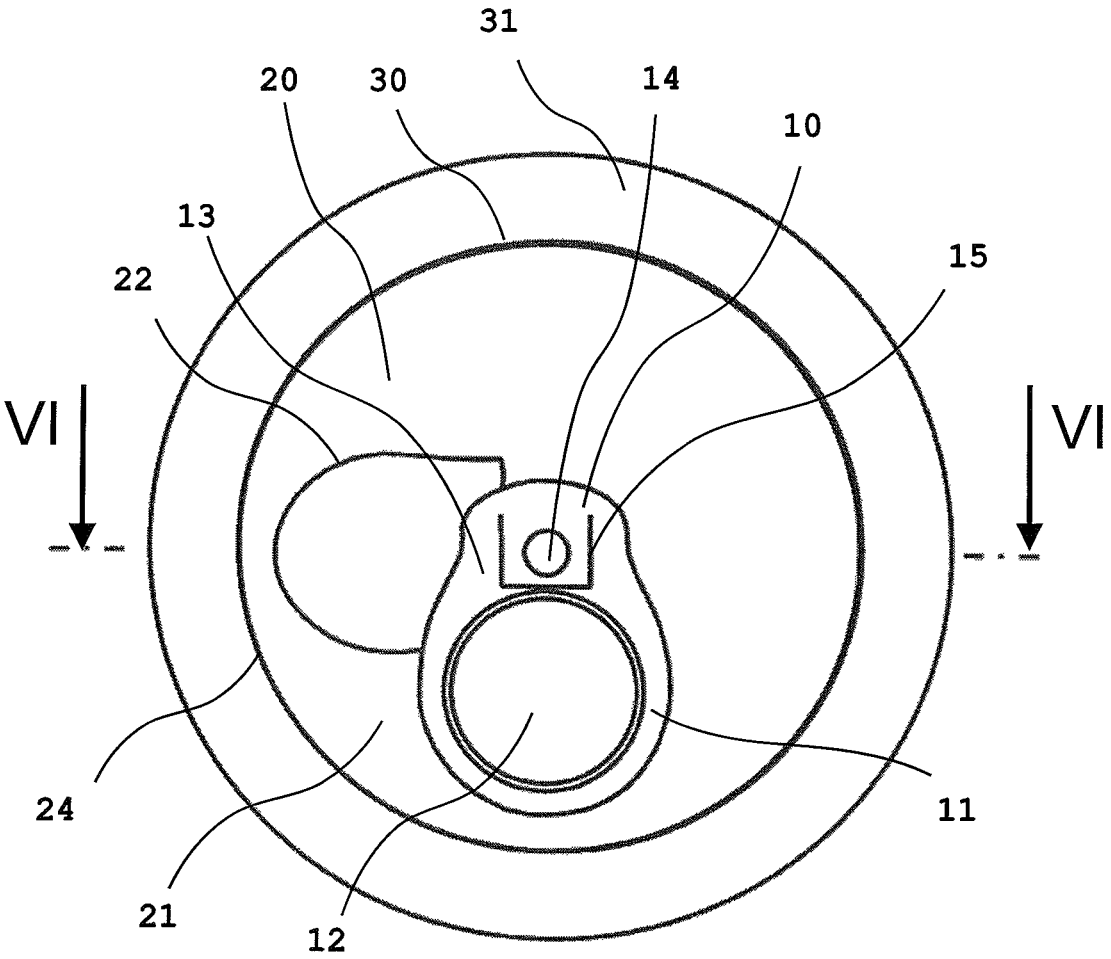
FIG. 5 illustrates a schematic top view of the beverage can from FIG. 1 with the punched-out opening section of the beverage can lid and the beverage can closure element pivoted to a central position.
Figure 6:
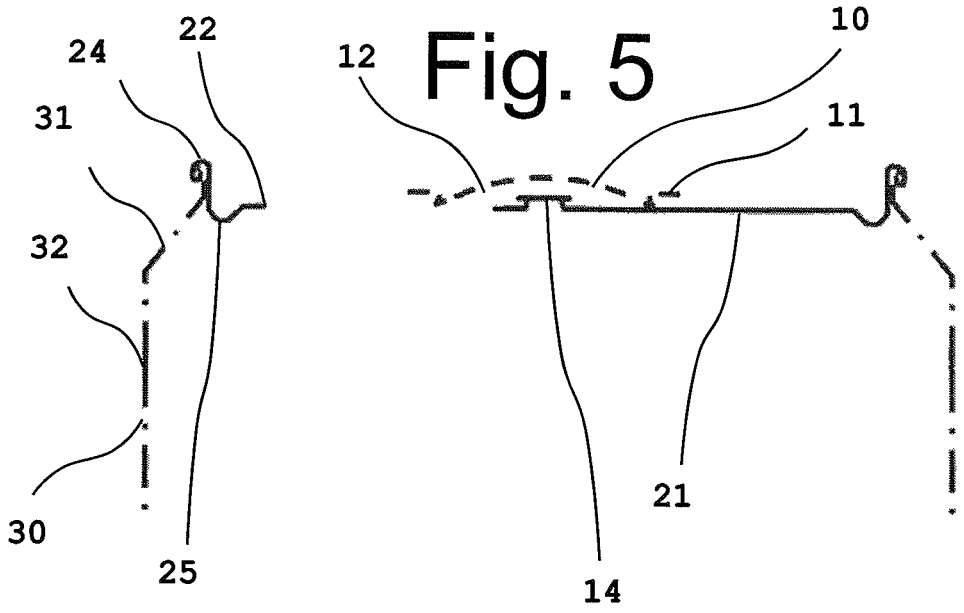
FIG. 6 illustrates a schematic partial sectional view of the beverage can from FIG. 5 along the line VI-VI from FIG. 5.

FIGS. 5 and 6 illustrate the embodiment example of the invention with a beverage can closure element 10 pivoted through approximately 90 degrees. The beverage can closure element 10 is configured to enable pivoting around the rivet 14, i.e. the rivet 14 defines a pivoting axis around which the beverage can closure element 10 can be pivoted. This pivotable configuration is known in the art from the familiar opening tabs articulated with a rivet on beverage can lids.

Figure 7:
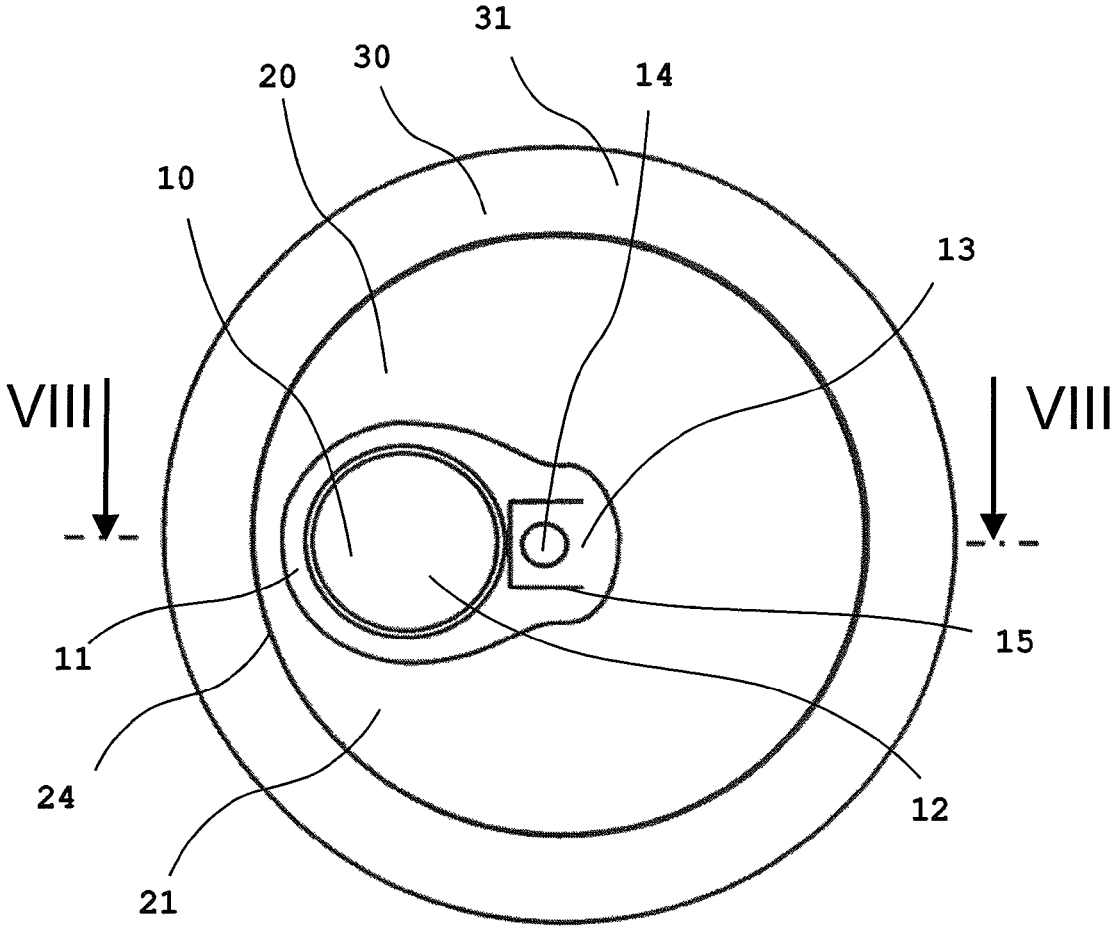
FIG. 7 illustrates a schematic top view of the beverage can from FIG. 1 with the punched-out opening section of the beverage can lid and the beverage can closure element pivoted over the beverage opening or area of the beverage can lid from which the opening section was punched.
Figure 8:
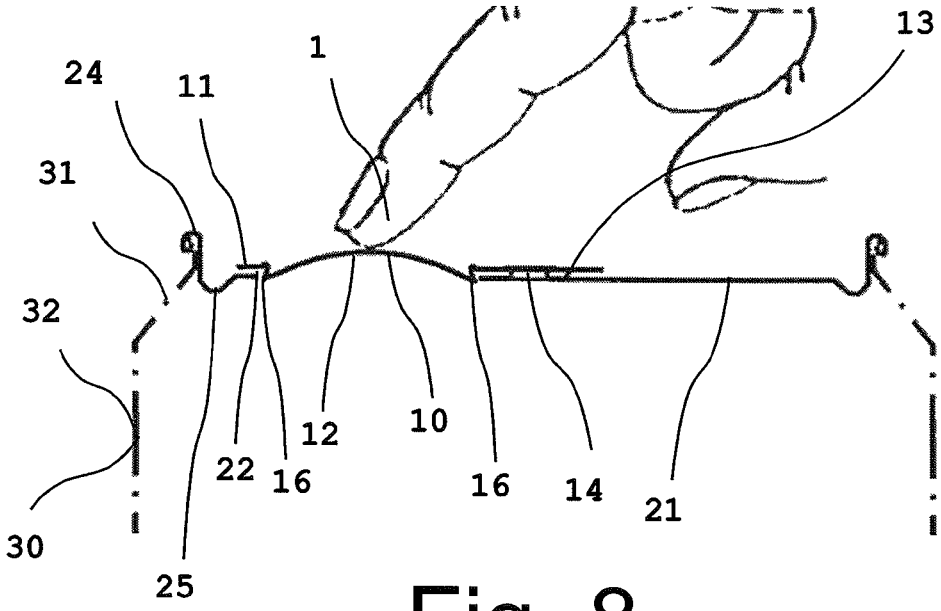
FIG. 8 illustrates a schematic partial sectional view of the beverage can from FIG. 7 along the line VIII-VIII from FIG. 7, with the finger of a user who wishes to close the opened beverage can again with the beverage can closure element depicted schematically.

FIGS. 7 and 8 illustrate the beverage can 30 from FIG. 1 with the opening section of the beverage can lid 20 broken out, and the beverage can closure element 10 is pivoted over the beverage opening or the area of the beverage can lid 20 from which the opening section 23 has been broken out along the rupture line 22. The hand 1 of a user who wishes to close the opened beverage can 30 again with the beverage can closure element 10 is depicted schematically in FIG. 8. Furthermore, locking elements 16 are schematically illustrated in FIG. 8 which engage under the lid section 21 of the beverage can lid 20 when the beverage can 10 is closed again, tightening the beverage can closure element 10 on the beverage can lid 20. In order to close the beverage can again, the user need only pivot the beverage can closure element 10 around the rivet 14 into the position illustrated in FIGS. 7 and 8 and press with one finger 1 on the cover element 12 of the beverage can closure element 10 to transform it into the state illustrated in FIGS. 9 and 10.

Figure 9:
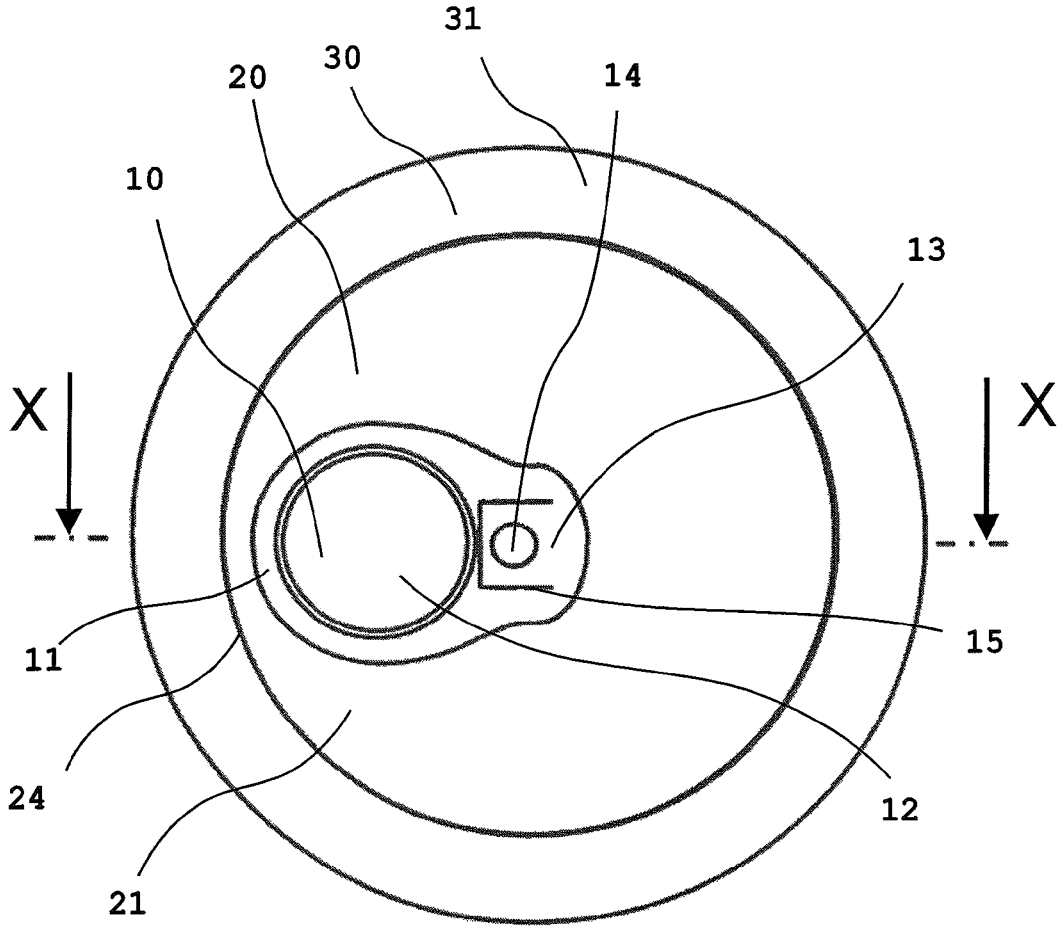
FIG. 9 illustrates a schematic top view of the beverage can from FIG. 1 with the punched-out opening section of the beverage can lid, with the beverage can closure element pressed over and into the beverage opening or area of the beverage can lid from which the opening section was punched to reclose the beverage can initially opened in this manner.
Figure 10:
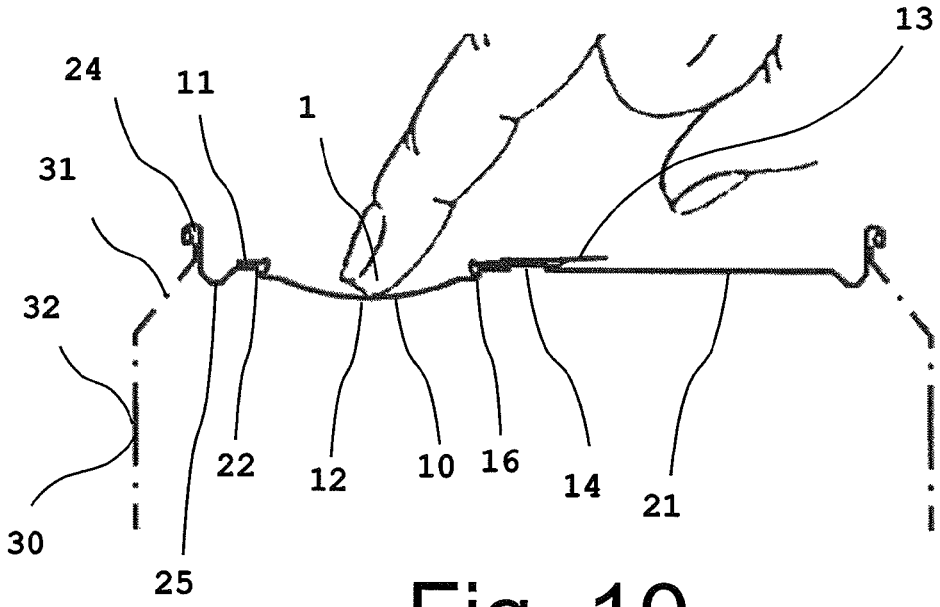
FIG. 10 illustrates a schematic partial sectional view of the beverage can from FIG. 9 along the line X-X from FIG. 9, with the finger of a user who has reclosed the opened beverage can again with the beverage can closure element depicted schematically.

FIGS. 9 and 10 illustrate the beverage can 30 from FIG. 1 with the punched-out opening section 23 of the beverage can lid 20, and the beverage can closure element 10 was pressed into the beverage opening or the area of the beverage can lid 20 out of which the opening section 23 was broken to reclose the beverage can 30 initially opened in this manner. The finger 1 of a user who has closed the opened beverage can 30 again with the beverage can closure element 10 is depicted schematically.

The cover element 12 of the beverage can closure element 10 is transformed from the upwardly curving shape illustrated in FIGS. 1 to 8 into the downwardly curving shape illustrated in FIGS. 9 and 10 through the pressure of the finger 1. In other words, the cover element is transferred from one stable equilibrium into another stable equilibrium. In the downwardly curving shape illustrated in FIGS. 9 and 10, the cover element 12 also tends to assume as relaxed a shape as possible, and the cover element is curved approximately as far downwards as it was previously curved upwards, as illustrated in FIGS. 1 to 8. The locking elements 16 are pushed upwards against the lid section 21 of the beverage can lid 20 as a result. The beverage can closure element is braced against the beverage can lid 20 by the locking elements 16, as the cover element 12 of the beverage can closure element 10 cannot completely assume the relaxed downwardly curving shape because the locking elements push against the cover element 21 of the beverage can lid 20.

Figure 11:
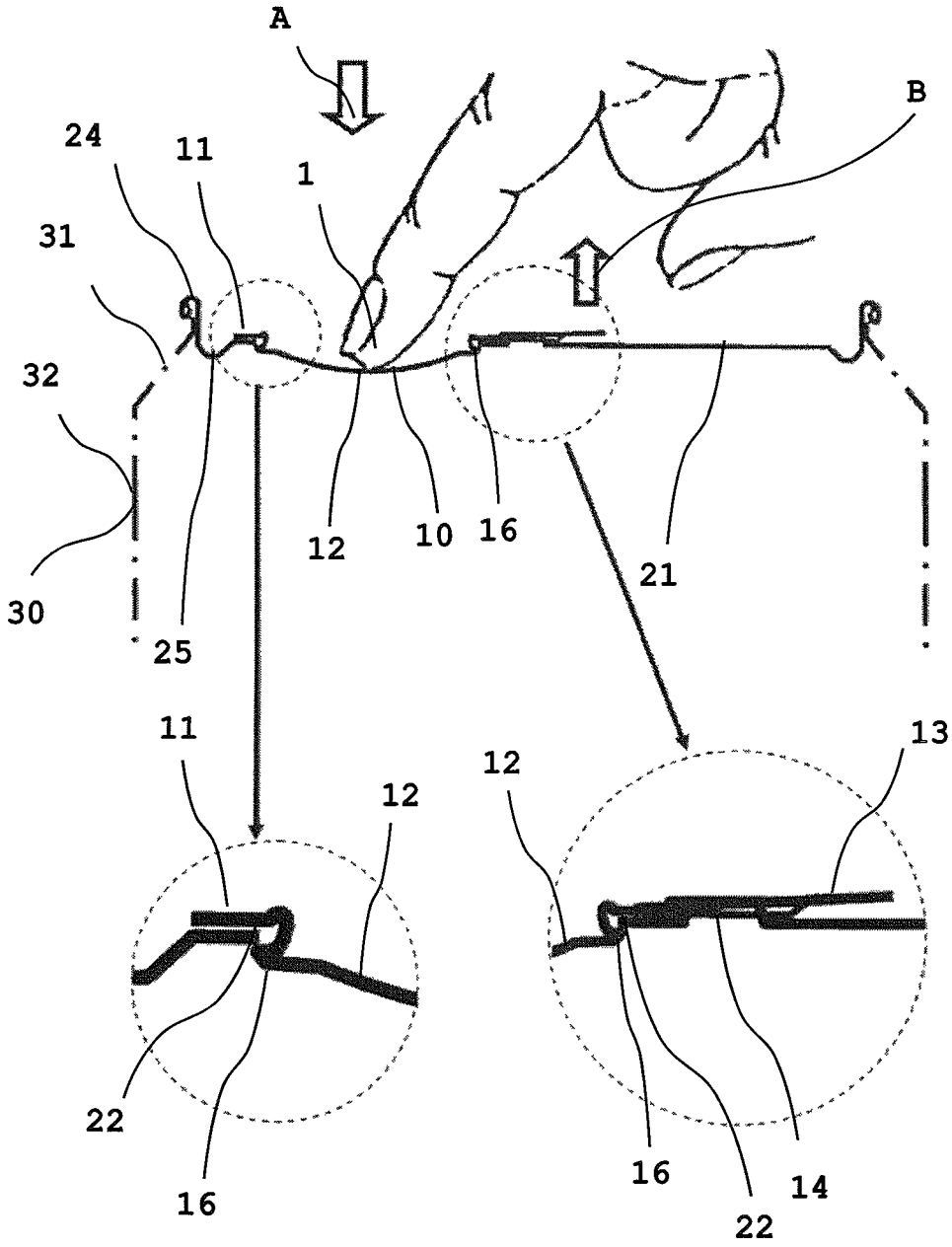
FIG. 11 illustrates a partial sectional view according to FIG. 10, with the circular segments drawn with dashed lines corresponding to the arrows illustrated again in greatly enlarged detail.

The manner in which the locking elements 16 brace the beverage can closure element 10 against the beverage can lid 20 on the opening rim defined by the rupture line 22 can be identified better in FIG. 11 and, particularly, in the greatly enlarged sections illustrated.

The user closes the opening by pressing with the finger 1 on the cover element 12 of the beverage can closure element 10 in the direction of arrow A. The extension 13 is also moved upwards in the direction of arrow B as a result.

Figure 12:
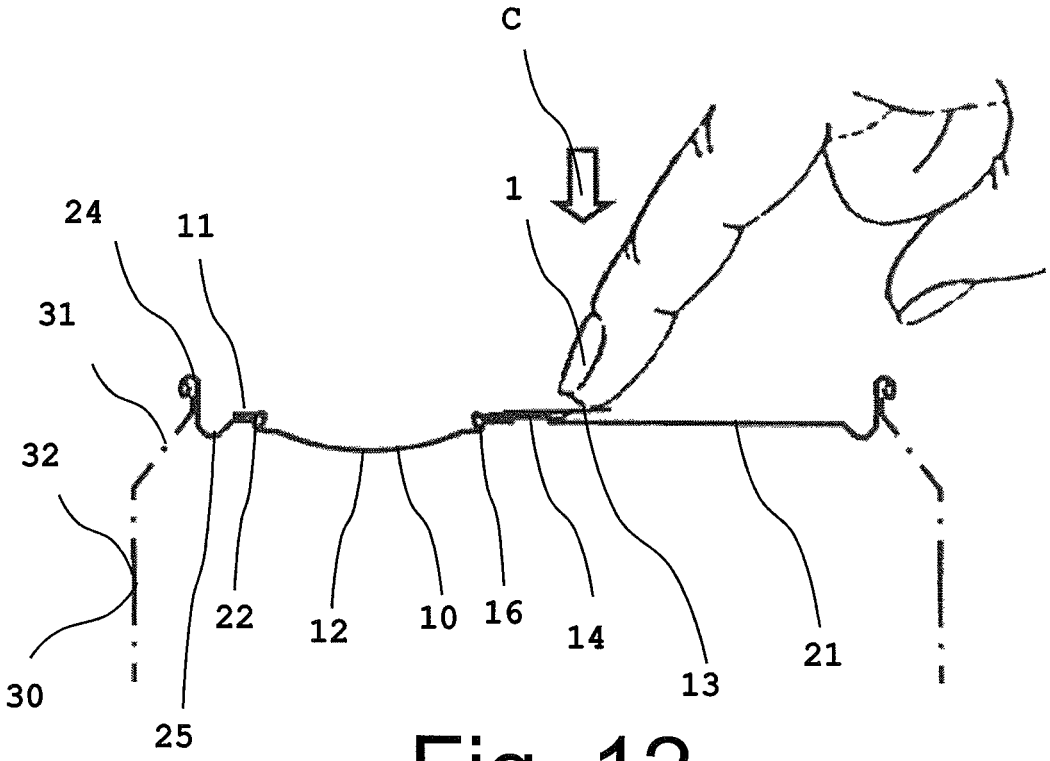
FIG. 12 illustrates a partial sectional view according to FIG. 10 which schematically illustrates how the beverage can closure element can be unlocked again by the user.
Figure 13:
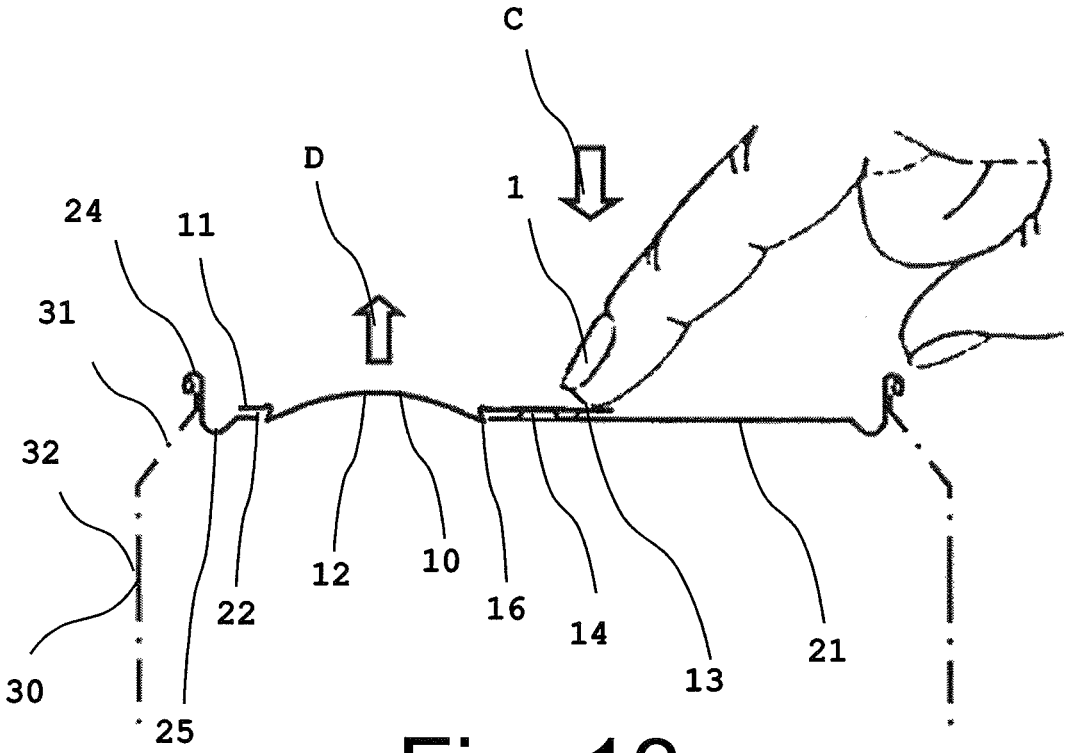
FIG. 13 illustrates a partial sectional view according to FIG. 10 which schematically illustrates the beverage can closure element in the unlocked positioned achieved by the user.
Figure 14:
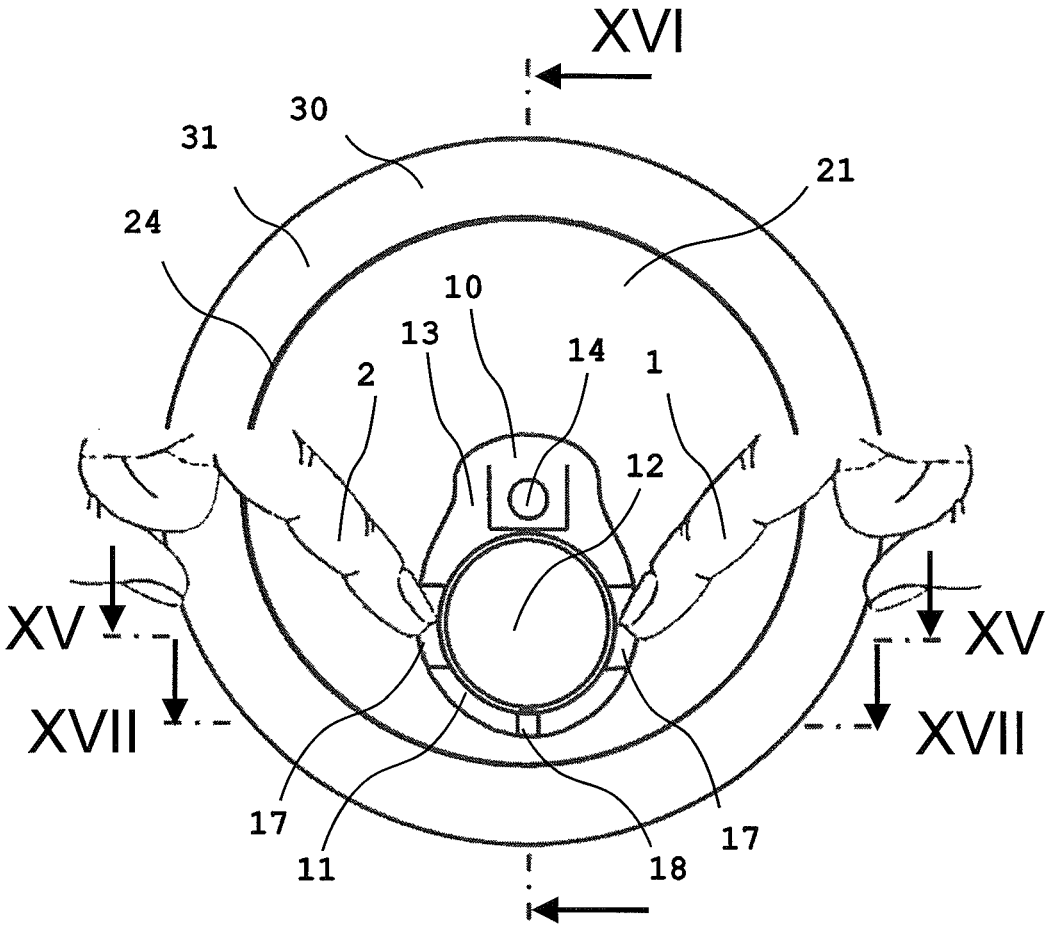
FIG. 14 illustrates a schematic top view of a beverage can with a beverage can lid and beverage can closure element according to a further embodiment of the invention.
Figure 15:
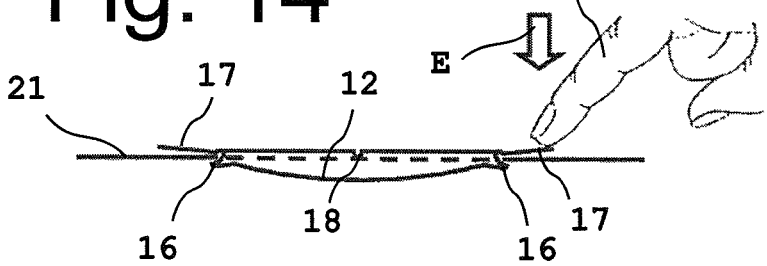
FIG. 15 illustrates a partial sectional view of the beverage can lid with the beverage can closure element of the beverage can from FIG. 14 along the line XV-XV.
Figure 16:
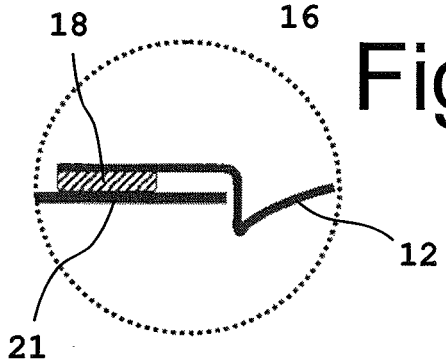
FIG. 16 illustrates a partial sectional view of the beverage can lid with the beverage can closure element of the beverage can from FIG. 14 along the line XVI-XVI.
Figure 17:
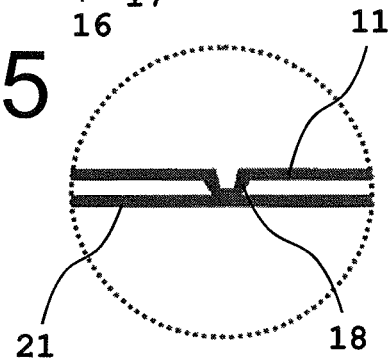
FIG. 17 illustrates a partial sectional view of the beverage can lid with the beverage can closure element of the beverage can from FIG. 14 along the line XVII-XVII.
Figure 18:
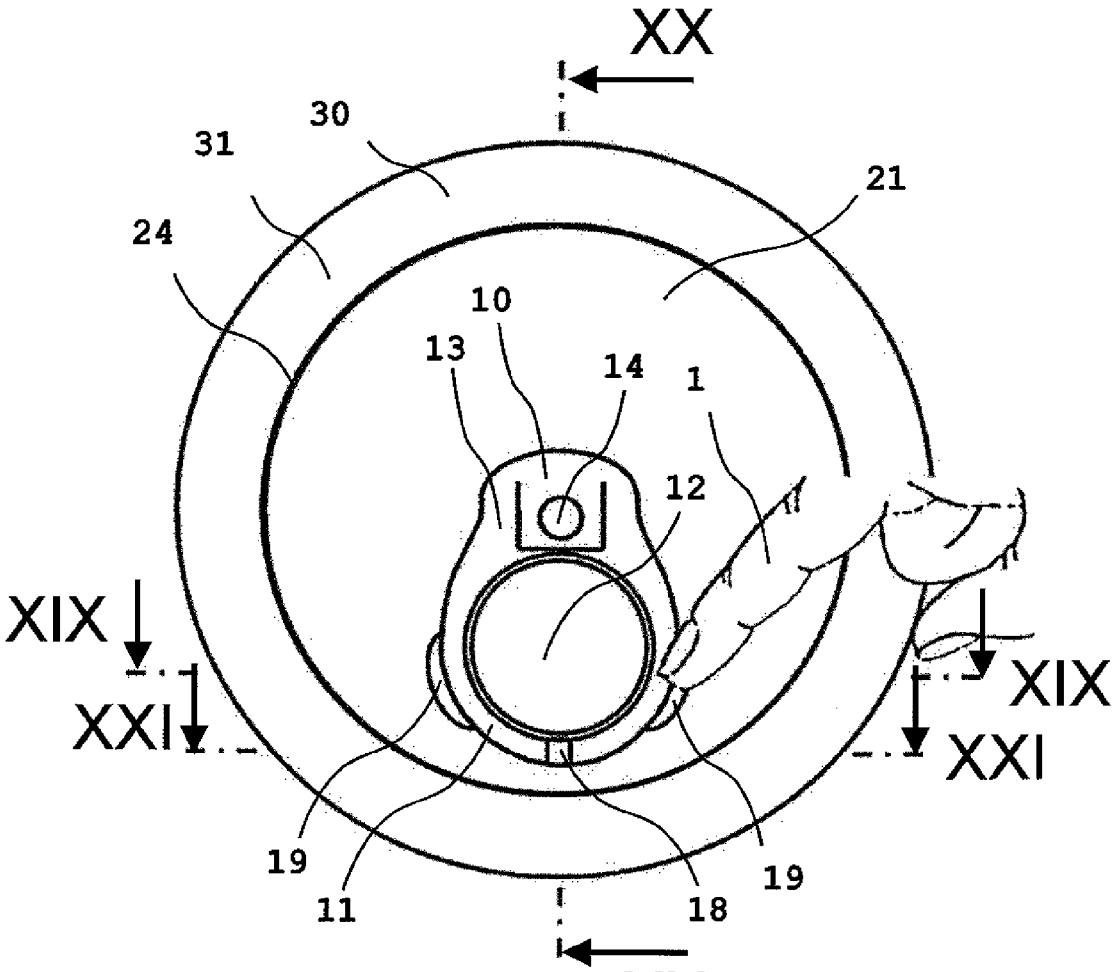
FIG. 18 illustrates a schematic top view of a beverage can with a beverage can lid and beverage can closure element according to a further embodiment of the invention.
Figure 19:
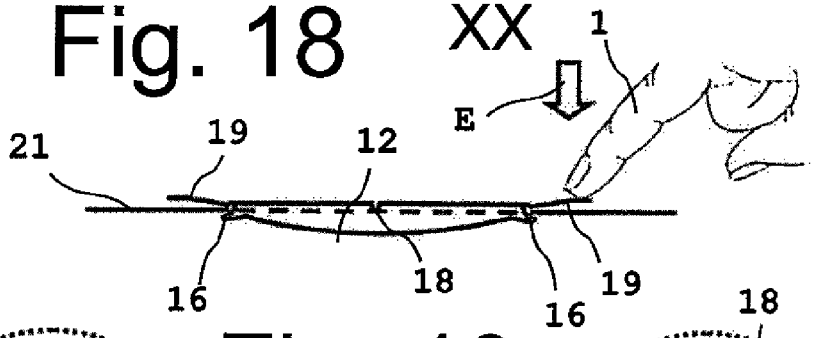
FIG. 19 illustrates a partial sectional view of the beverage can lid with the beverage can closure element of the beverage can from FIG. 18 along the line XIX-XIX.
Figure 20:
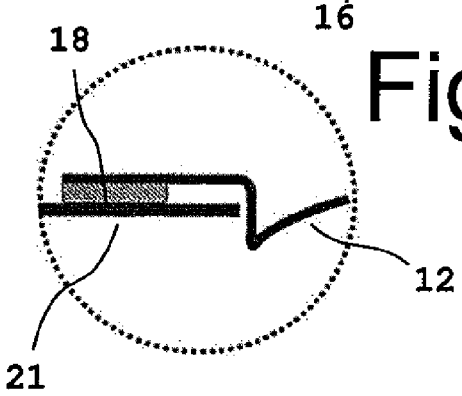
FIG. 20 illustrates a partial sectional view of the beverage can lid with the beverage can closure element of the beverage can from FIG. 18 along the line XX-XX.
Figure 21:
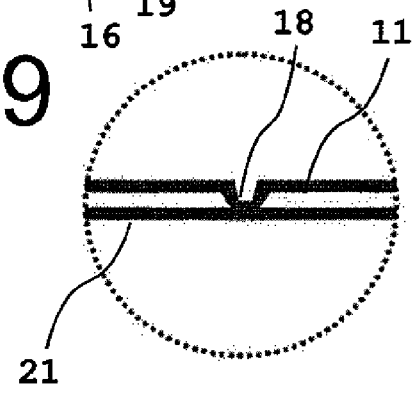
FIG. 21 illustrates a partial sectional view of the beverage can lid with the beverage can closure element of the beverage can from FIG. 18 along the line XXI-XXI.

Unlocking can be achieved if the user exerts force on the extension 13 in the direction of arrow C as illustrated in FIG. 12. This exerts force in the direction of arrow D (see FIG. 13) on the cover element 12 of the beverage can closure element in a manner which reverts the cover element from its downwardly curving shape into its upwardly curving shape again, as illustrated in FIG. 13. As a consequence of the upwardly curving shape, the locking elements fitted to the cover element are offset inwards in a radial direction relative to the cover element and, as a result, no longer engage under the rim of the lid section 21, permitting pivoting of said cover element back into the position illustrated in FIG. 1 or the position illustrated in FIG. 5 in which the opening for drinking or dispensing of the liquid is cleared again.

FIGS. 14 to 17 illustrate a further embodiment of the invention that essentially corresponds to the embodiment in FIGS. 1 to 13. Identical reference signs are used to designate identical components. Reference is made to the description of the previous embodiment examples. Only the differences to the previous embodiment example are described below.

The beverage can 30 is illustrated in FIGS. 14 to 17 in a position in which the opening in the beverage can lid 20 which has already been opened at least once has been closed again using the beverage can closure element 10 pivoted over the opening and brought into a locked position by pressing the cover element 12 of the beverage can closure element.

The beverage can closure element 10 exhibits two opening sections 17 and reinforcing beading 18 in the rim area 11. The user can unlock the beverage can closure element 10 again by exerting a force in the direction of arrow E on the opening sections 17 with the fingers 1, 2, enabling clearing of the opening again through pivoting of the beverage can closure element 10 around the axis defined by the rivet 14.

FIGS. 18 to 23 illustrate a further embodiment of the invention that essentially corresponds to the embodiment in FIGS. 1 to 13 and 14 to 17. Identical reference signs are used to designate identical components. Reference is made to the description of the previous embodiment examples. Only the differences to the previous embodiment example are described below.

The beverage can closure element 10 exhibits two wings 19 and reinforcing beading 18 in the rim area 11. The user can unlock the beverage can closure element 10 again by exerting a force in the direction of arrow E on the wings 19 with at least one finger 1, enabling clearing of the opening again through pivoting of the beverage can closure element 10 around the axis defined by the rivet 14.

FIGS. 7 to 11 illustrate how the opening tab or beverage can closure element 10 is pressed into the dispensing opening and how the rim of the opening tab or beverage can closure element 10 is snapped into and locks the dispensing opening. A force is exerted on the cover element 12 in the direction of arrow A for this purpose, raising the extension 13 in the direction of arrow B. The locking element 16 clamps behind the rim of the dispensing opening defined by the rupture line 22 during this.

FIGS. 12 and 13 illustrate how the opening tab or beverage can closure element 10 is released from the dispensing opening so that the dispensing opening can be cleared again by pivoting or folding back the opening tab or beverage can closure element.

FIGS. 14 to 17 illustrate a variant of the opening mechanism according to FIGS. 12 to 13, which can also be used as an auxiliary opening mechanism.

FIGS. 18 to 21 illustrate a variant of the embodiment of FIGS. 14 to 17, with two wings 19 strengthening the lever action of the opening mechanism.

Figure 22:
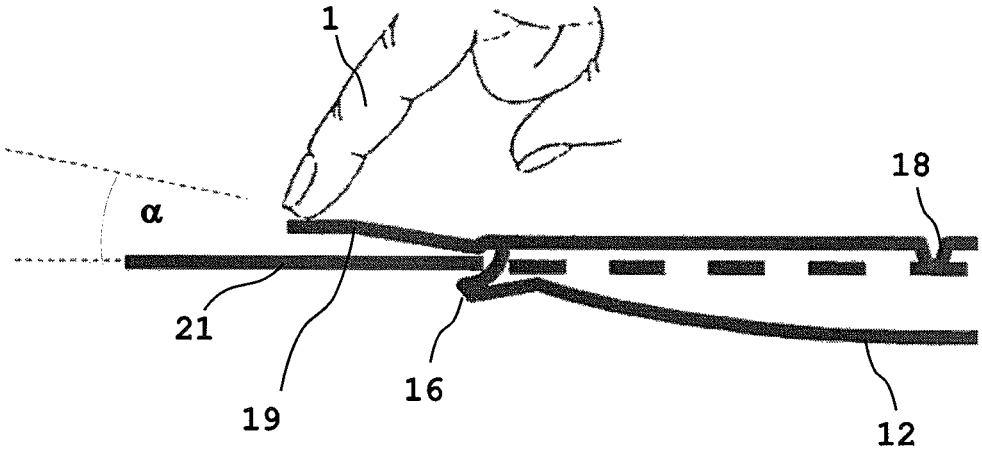
FIG. 22 illustrates an enlarged section of the partial sectional view from FIG. 19.
Figure 23:
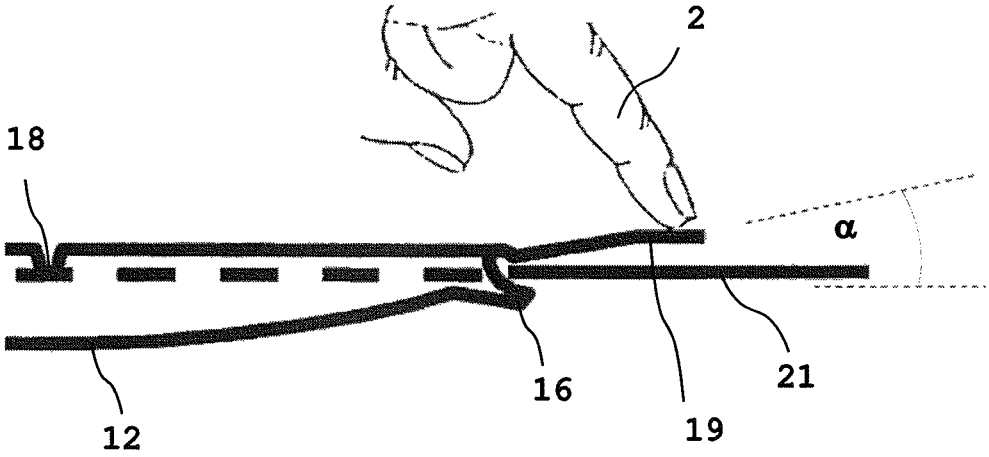
FIG. 23 illustrates an enlarged section of the partial sectional view from FIG. 19.

FIGS. 22 and 23 illustrate sections through the wings 19 illustrated in FIGS. 18 to 21.

FIGS. 28*a* and 28*b* illustrate a variant of the opening tab or beverage can closure element with a drinking straw hole or holes.

FIGS. 29 to 32 illustrate a variant of the embodiment of the invention illustrated in FIGS. 7 to 10, with preferably the same material as that of the beverage can or a combination of different materials used.

FIGS. 33 to 61 illustrate further locking mechanism designs, which can be used as variants of the embodiments illustrated in FIGS. 7 to 10.

FIG. 64 illustrates further variants of different lug shapes to the lug shapes illustrated in the other figures.

It is known in the art from FIGS. 65 to 71 that different shapes of lid openings can be combined with different shapes of the curved surface of the opening tab or beverage can closure element 10.

FIGS. 72 to 75 illustrate possible cross section shapes, which can match the embodiments of FIGS. 65 to 71.

FIGS. 76 to 81 illustrate further variants of the embodiments of FIGS. 65 to 75 in section and plan views.

FIGS. 82 to 84 illustrate how the rivet 14, which acts as the fixing and pivoting axis for the opening tab or beverage can closure element, is stamped out of the lid material.

FIG. 1 illustrates a plan view of a beverage can manufactured as a cylindrical container from an aluminium material. The beverage can 10 exhibits a lid 20 with an opening tab or beverage can closure element 10. A rupture line 22 is provided in the can lid 20 which marks out a dispensing opening. The opening tab or beverage can closure element 10 is preferably located in a horizontally pivotable configuration in the middle of the can lid 20 in the area of the rupture line 22 around a rivet 14 which foils an axis. The rivet 14 is preferably stamped out of the same material as the lid.

The opening tab or beverage can closure element 10 exhibits a rupture lever (extension 13) in the area of the rupture line 22 overlaying and at least partially penetrating into the area of the subsequent dispensing opening.

FIG. 8 illustrates that the opening tab or beverage can closure element 10 exhibits an upwardly curving surface (cover element 12) and a circumferential rim (locking element 16) extending downwards.

FIGS. 1 to 13 illustrate how opening and reclosing of the can lid 20 functions. Vertical upwards movement of the opening tab or beverage can closure element 10 causes the rupture lever to press on the part of the lid marked by the rupture line 22, the rupture line 22 breaks open, and a dispensing opening is created.

The dispensing opening is closed by pivoting the opening tab or beverage can closure element 10 by 180° around the axis defined by the rivet 14, and the opening tab or beverage can closure element 10 comes to rest over the dispensing opening. The upwardly curving surface is then pressed downwards into the dispensing opening, and the curvature is reversed downwards. The locking elements are moved outwards in a radial direction as a result, relative to the cover element, and the opening tab or beverage can closure element 10 snaps into the dispensing opening and locks the lid 20. Opening, reclosing and locking of the dispensing opening can be repeated as often as desired.

FIGS. 7 to 13 illustrate the functional principle of opening, locking and reopening the lid. The rupture lever moves upwards 13, as apparent in FIG. 11, if the opening tab or beverage can closure element 10 is pressed downwards, as illustrated in FIG. 8, and the rim 16 is snapped into the dispensing opening. FIG. 12, which corresponds to the locked state according to FIG. 11, illustrates how the lid is opened again. The rupture lever 13 is pressed, as illustrated in FIG. 12, the opening tab or beverage can closure element 2 curves upwards again, the locked rim 16 is released, and the dispensing opening can be cleared again (e.g. using the rupture lever 13).

A support can be provided under the lever to be used as a fulcrum for the lever action to increase the lever action during reopening. A support of this nature can be stamped out of the lid or rupture lever material or fixed to either the lid or rupture lever as a separate part. The support can also consist of two parts, with one part on the lid and one on the rupture lever.

An additional auxiliary opening mechanism, as illustrated in FIGS. 14 to 23, can be provided in case the rupture lever is, as a result of damage, no longer capable of reopening the opening, or if the rupture lever has broken off partially or completely. This auxiliary opening mechanism is configured on the other side of the opening tab or beverage can closure element opposite the rupture lever and preferably has one of the forms implied in FIGS. 14 to 21, but can also have any other desired form.

The auxiliary opening mechanism can also be used as the main opening mechanism. If the opening mechanism is used (as an auxiliary or main opening mechanism), one or both of the sides 17 implied in FIGS. 14 to 17 is pressed, or one or both of the wings implied in FIGS. 18 to 21 is pressed. The opening mechanism acts like a support here for the lever arm. FIGS. 22 and 23 illustrate that the wings 19 are partially directed upwards at an angle of, for example, 5 to 35°. However, it is equally possible to direct the entire wing upwards at this angle, or to direct part of the wing or the entire wing upwards inclined at another angle.

FIG. 1 illustrates a plan view of a lid shape, whereby the surface or partial surface curved upwards is illustrated in a round configuration. Further possible shapes are illustrated in FIGS. 24 to 26, and FIG. 27 illustrates possible cross section shapes. The shapes illustrated in FIGS. 24 to 26 can be combined as desired with the cross section shapes of FIG. 27. Aside from the shapes illustrated here, other shapes can also be used.

Figure 27:
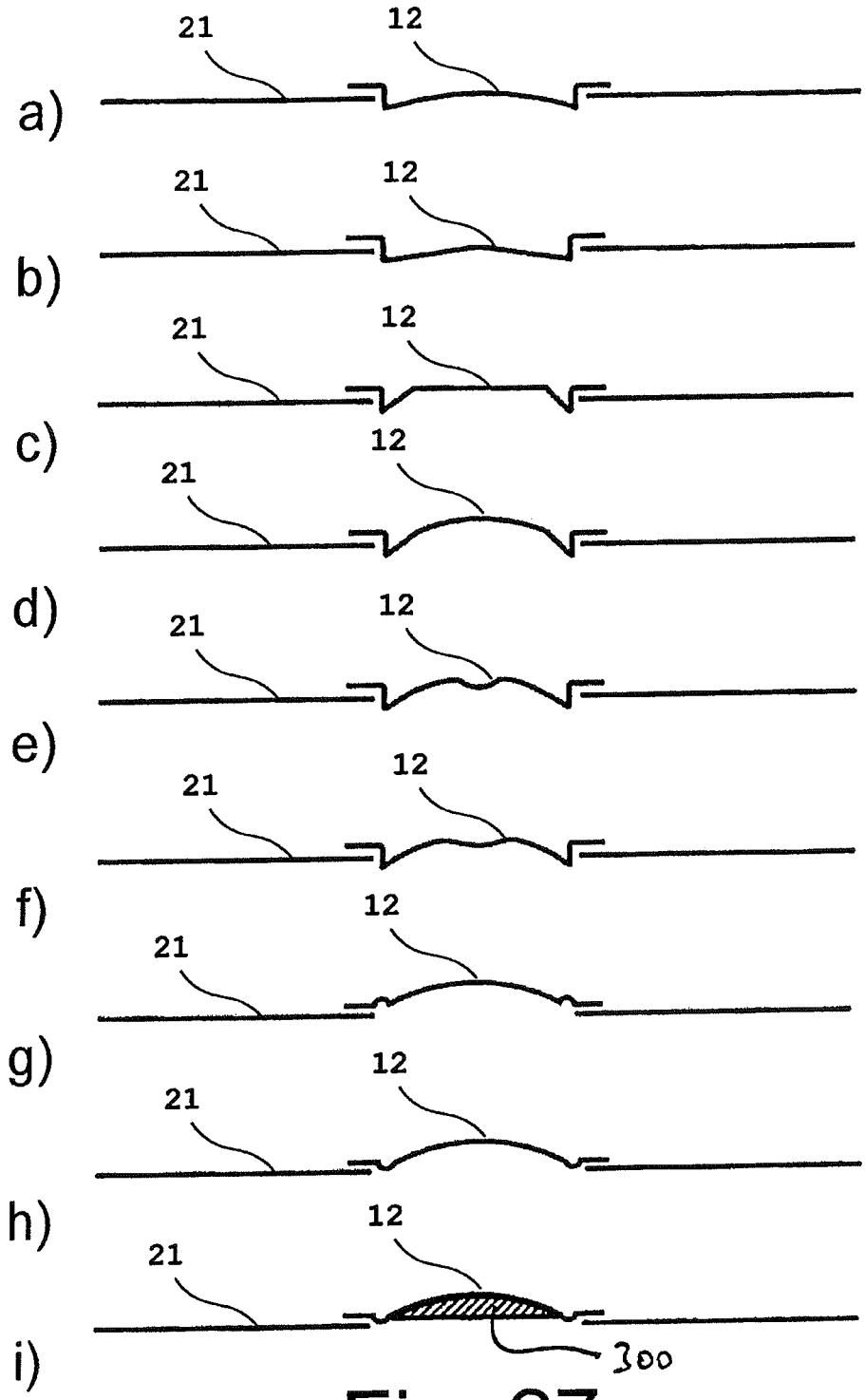

FIGS. 27 *g*), 27 *h*) and 27 *i*) illustrate cross section shapes with a reinforcing groove which is depicted as an elevation or depression. FIG. 27 *i*) illustrates that an additive 300 can be configured below the opening tab or beverage can closure element, e.g. in the form of a powder, a liquid or a tablet and, preferably, an effervescent tablet. The additive can be contained by a film A liquid seal is also possible if a powder or tablet is involved, and a food adhesive, such as starch or similar, can also be used in the case of a tablet.

FIGS. 28*a* and 28*b* illustrate variants in which the opening tab or beverage can closure element exhibits one or three drinking straw holes. However, one or more drinking straw holes can also be provided. Another option would be to configure the drinking straw holes in the can lid instead of the opening tab or beverage can closure element, or even in both the opening tab or beverage can closure element and the can lid.

FIGS. 29 to 32 illustrate an embodiment in which, in addition to the preferred embodiment in which materials of the beverage can are used, composite materials can also be utilised. All conceivable metals and plastics can be used, but preferably aluminium, sheet steel, rubber or substances similar to rubber in any conceivable combination. The surfaces of the materials used can be completely or partially anodised. FIGS. 29 to 32 illustrate an embodiment in which the opening tab or beverage can closure element is, for example, an upwardly bent cover element with four extensions 121 (or legs). The cover element can, under practical circumstances, be a plastic or metal part, and one or more legs can be provided. If the opening tab or beverage can closure element are pressed into the dispensing opening to close the opening, these legs move outwards in a radial direction and press into the corresponding slots 111 of the opening tab or beverage can closure element. Thus, the opening tab or beverage can closure element is locked in the dispensing opening. The corresponding slots 111 in the opening tab or beverage can closure element are as wide as broader tapered extensions 121 to achieve a good sealing effect when pressing them in. Alternatively, the legs can also exhibit another shape (e.g. rectangular). The respective width of the slots should then be preferably somewhat larger than the width of the legs. The legs 16 are preferably somewhat longer than illustrated in FIG. 17 to ensure that the extensions 121 are positioned there where the corresponding slots 111 are located, and the extensions 121 already extend in part into the corresponding slots 111 in the start position. Alternatively, other locking options can be provided.

FIGS. 33 to 61 illustrate different locking options as variants to those illustrated in FIGS. 7 to 10. The locking elements consist of one or more lugs or a completely or partially circumferential rim.

FIGS. 33 to 36 illustrate a locking design consisting of three lugs 122. One or more lugs can be provided instead of the illustrated lugs, or the same profile can also be configured as a complete or partial circumferential rim. FIG. 34 is a section without lugs, FIG. 35 is a section with lugs 122 and FIG. 36 illustrates the locked state. FIG. 33 also illustrates the corresponding opening tab or beverage can closure element 10, but the opening tab or beverage can closure element 10 can have any shape. The upper part of the opening tab or beverage can closure element is illustrated in FIG. 33 as rectangular with rounded corners, but it can have any other form, e.g. curved, rectangular without rounded corners, triangular, polygonal, elliptical, etc. In addition to the snapping-in effect, a clamping effect also occurs in the case of this locking design. During snapping-in of the lugs, the inclined rim 8 is drawn somewhat downwards and clamped firmly in the dispensing opening.

FIGS. 37 to 40 illustrate a variant as compared to the embodiment in FIGS. 33 to 36. The circumferential seam also exhibits a reinforcing groove 112, e.g. in the form of an offset, as clearly evident in the circled detail, which contributes to the sealing and reinforcing of the opening tab or beverage can closure element.

FIGS. 41 to 44 are similar to FIGS. 37 to 40, but also illustrate a detail of a variant with an extended lug 124 to enable better fixing of the opening tab or beverage can closure element during locking. This extended lug 124 is illustrated as a round projection, but it can have any other shape, including rectangular, triangular, etc., and one or more extended lugs can be provided. FIGS. 41 to 44 illustrate the extended lug 124 in combination with the offset illustrated in FIGS. 37 to 40, but it can also be used in conjunction with the circumferential rim without an offset (see FIGS. 33 to 36).

FIGS. 45 to 47 illustrate an alternative option for locking the dispensing opening. The upwardly curving surface is pressed downwards into the dispensing opening and extends practically horizontally or is only slightly curved downwards. This is achieved because the circumferential rim of the opening tab or beverage can closure element 10 is only slightly smaller than the dispensing opening (i.e. that the circumferential rim and dispensing opening are so coordinated that a clamping effect of this kind is achieved in the horizontal position or the slightly downwards curvature which prevents a complete downwards curvature). An adequate lock is achieved through this clamping effect. FIG. 46 illustrates the position where the opening tab or beverage can closure element is in the dispensing opening, but not yet locked. FIG. 47 illustrates the locked position based on the clamping effect, and the opening tab or beverage can closure element 10 is in the horizontal position. The offset and/or the extended lug 121 can also be used in the case of this embodiment according to FIGS. 45 to 47 and all other embodiments.

FIGS. 48 to 50 illustrate an embodiment corresponding to the embodiment in FIGS. 45 to 47 with additional reinforcing grooves 126 provided.

FIGS. 51 to 53 illustrate an embodiment corresponding to the embodiment in FIGS. 45 to 47 with additional reinforcing ribs 127 provided.

FIGS. 54 to 57 illustrate a further option for locking the dispensing opening. The opening tab or beverage can closure element 10 in this embodiment has an upwardly curving surface and a downwardly curving surface 128 configured in the middle (this surface can also be configured outside the middle). The opening tab or beverage can closure element is therefore an undulated form. Locking in this embodiment also consists of the opening tab or beverage can closure element being pressed downwards, but it functions here in that the undulated form reverses when it is pressed downwards (i.e. the upwardly curving surface curves downwards and the downwardly curving surface configured in the middle 128 curves upwards, as evident in FIG. 57. Reopening can be achieved here by pressing on the upwardly curving surface 128 (FIG. 57).

FIGS. 58 to 59 illustrate a variant as compared to the embodiment in FIGS. 54 to 57, with one or more encompassing lugs or a completely or only partially circumferential rim encompassing the dispensing opening when the rim is pressed in. The one or more encompassing lugs or completely or only partially circumferential rim are assigned the reference number 163 in FIGS. 58 and 59. This lock is a type of snap-in effect, and a clamping effect can occur under certain circumstances.

FIGS. 60 and 61 and FIGS. 62 and 63 illustrate a similar locking mechanism as in FIGS. 58 and 59. FIGS. 60 and 61 illustrate a downwardly curving surface, which reverses completely during locking. In contrast to this, FIGS. 62 and 63 illustrate that the upwardly curving surface partially contains a horizontal surface 1210 (the horizontal surface can be as large or small as desired), and the opening tab or beverage can closure element does not extend as far downwards in the locked position.

FIG. 64 illustrates further variants with different lug shapes when compared to the lug shapes illustrated in FIGS. 33 to 53.

Figure 73:
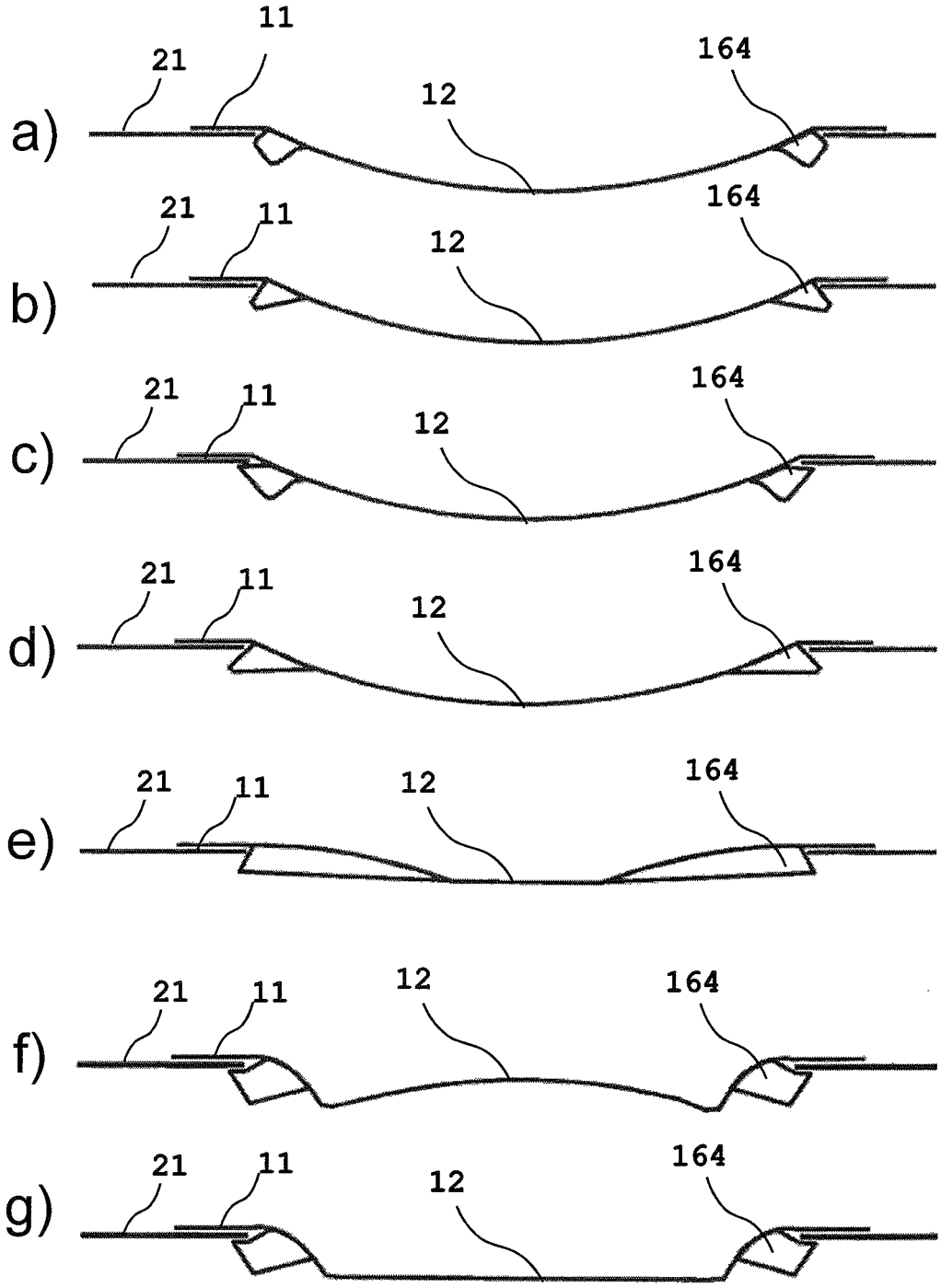

FIGS. 65 to 71 illustrate that different shapes of dispensing openings can be combined with different shapes of the curved surface of the opening tab or beverage can closure element. The dashed line in FIGS. 65 to 71 illustrates a possible dispensing opening in the lid. FIGS. 69 and 71 additionally illustrate a cross section of the unlocked and locked position respectively. FIGS. 72 to 75 illustrate the corresponding cross section shape options, and FIG. 73 illustrates the locked state. FIG. 74 *a*) illustrates a continuous rim, whereas the remaining cross section shapes in FIGS. 74 *b*) to 74 *e*) exhibit a fluted or stamped out rim.

FIGS. 76 to 81 illustrate section and plan views of further variants as compared to those illustrated in FIGS. 65 to 75.

FIGS. 82 to 84 illustrate how the rivet 14, which acts as the fixing and pivoting axis for the opening tab or beverage can closure element is stamped out of the lid material. Part of the lid material is shaped and then pressed downwards, thus creating the rivet 14.

FIGS. 85 to 91 illustrate further cross section shapes, in part also in the locked state.

FIGS. 92 to 100 illustrate section and plan views of further variants further variants as compared to those illustrated in FIGS. 76 to 81. These figures illustrate both the unlocked and locked state in this respect.

Figure 101:
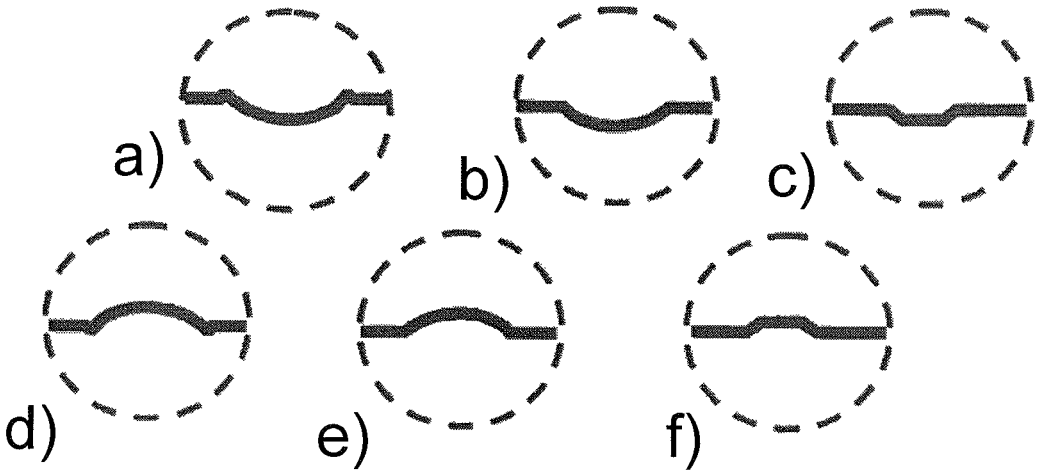
Figure 102:
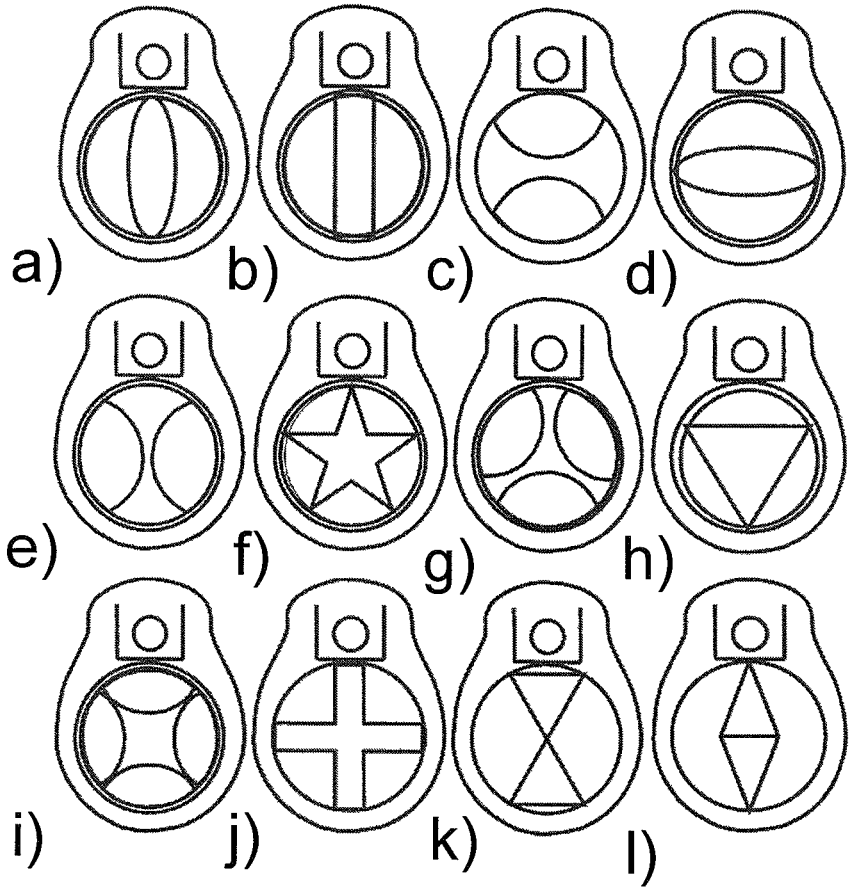

Finally, FIGS. 101 to 102 illustrate further variants of the embodiment of the opening tab or beverage can closure element. The shapes illustrated in FIG. 102 can be practically combined with the cross sections illustrated in FIG. 101 as desired.

As already indicated above, the opening tab or beverage can closure element 10 can be moved by 180° around the axis of the rivet 14 to lock the dispensing opening, and the opening tab or beverage can closure element 10 comes to rest over the dispensing opening. It is automatically discernible when the 180° position is reached, because the circumferential rim or the projections provided instead of the circumferential rim then sink into the dispensing opening. In addition, one or more stops can be configured to exactly define the 180° position. The stops can be configured so that they define the 180° position in the case of pivoting to the right and/or the left.

The dispensing opening is usually round, but it can also have another shape, such as the shape implied with the dashed line in FIGS. 65 to 67 or any other shape (e.g. oval, trapezoidal with rounded corners, etc.).

All variants and embodiment examples can be combined and varied with each other as desired.

The embodiment example illustrated in FIGS. 48 to 50 essentially corresponds to the embodiment example illustrated in FIGS. 45 to 47. The locking mechanism in this embodiment is configured as a straight circumferential rim 162, which is clamped against the rim of the opening in the beverage can lid 20 in the locked state. A frictional clamping lock is therefore achieved. The reinforcing beading 126 is flush with the straight circumferential rim 162.

The embodiment example illustrated in FIGS. 51 to 53 essentially corresponds to the embodiment example illustrated in FIGS. 48 to 50. Reinforcing ribs 127 are provided instead of reinforcing beading in this embodiment. Both reinforcing ribs and reinforcing grooves can, of course, be included in an embodiment example. The locking mechanism is also configured as a straight circumferential rim 162, which is clamped against the rim of the opening in the beverage can lid 20 in the locked state. A frictional clamping lock is therefore achieved. The reinforcing ribs 127 are configured flush with the straight circumferential rim 162.

FIGS. 54 to 57 correspond to FIGS. 33 to 36.

FIGS. 58 and 59 illustrate a further embodiment example of a beverage can closure element 10 according to the invention. A circumferential seam 163 or one or more encompassing lugs with a shape corresponding to the illustration are provided. A type of snap-in effect occurs in this lock, and a clamping effect can occur under certain circumstances. An indentation 129 is provided approximately in the middle of the cover element 12 which can reverse during locking, as illustrated in FIG. 59.

The embodiment example illustrated in FIGS. 60 and 61 differs from that in FIGS. 58 and 59 to the extent that the cover element 12 of the beverage can closure element 10 exhibits an upwardly curving surface, which curves downwards during locking.

The embodiment example illustrated in FIGS. 62 and 63 differs from the embodiment example illustrated in FIGS. 58 and 59 and in 60 and 61 to the extent that the cover element 12 of the beverage can closure element 10 exhibits an upwardly curving surface, which preferably exhibits an essentially straight surface in the middle. The size of the middle straight surface can be selected as desired. The cover element in this embodiment does not extend as far downwards in the direction of the beverage can contents in the locked state.

The section in FIG. 75 applies for all variants in FIGS. 74 *a*) to *e*).

It is obvious that the specialist can find obvious alternatives and equivalent solutions when studying the documents, including those, which fall within the scope of protection of the claims.

For example, alternative configurations are conceivable. For example, the principle of the beverage can closure element according to the invention can also be applied to other containers in the food industry. For example, it is conceivable that closure elements according to the invention could be used on packaging for milk or fruit juice made of a composite material. The embodiment of the closure element according to the invention can, in this respect, be preferably made of a plastic material which could preferably correspond to the material out of which, for example, the dispensing opening is manufactured.

All variants and embodiment examples can be combined and varied with each other as desired.

The invention claimed is:

1. A beverage can closure element comprising:

a cover element for removable receipt in an opening in a beverage can;

a locking mechanism on the cover element for locking the cover element in the opening of the beverage can, wherein the cover element is elastically deformable between at least two states with the locking mechanism in one state of the cover element of the at least two states of the cover element extending further inwards in a radial direction relative to the cover element than in another one of the at least two states of the cover element;

a rim area extending circumferentially around the cover element, with an extension provided in the rim area;

a rivet provided in the extension and defining a first pivot axis, with the cover element pivotable about the first pivot axis between a first position with the cover element over the opening and a second position with the rivet intermediate the opening and the cover element; and a beading formed in the rim area opposite to the extension and adjacent to the locking mechanism, with the beading and the rivet defining a second pivot axis generally perpendicular to the first pivot axis for removing the locking mechanism from the opening of the beverage can when the cover element is in the first position.

2. The beverage can closure element according to claim 1, wherein the cover element is elastically deformed through working of an external force between the at least two states.

3. The beverage can closure element according to claim 1, wherein the cover element is elastically deformed through interaction with the beverage can between the at least two states.

4. The beverage can closure element according to claim 1, wherein the locking mechanism is on an underside of the cover element.

5. The beverage can closure element according to claim 1, wherein the locking mechanism is on an upper side of the cover element.

6. The beverage can closure element according to claim 1, wherein the cover element is a disc spring design.

7. The beverage can closure element according to claim 1, wherein the cover element exhibits a surface section curved upwards in the one of the at least two states and curved downwards in the other one of the at least two states.

8. The beverage can closure element according to claim 1, wherein the locking mechanism includes at least one locking element in the form of a circumferential rim that runs around the cover element.

9. The beverage can closure element according to claim 1, wherein the locking mechanism comprises one extension configured on the cover element.

10. The beverage can closure element according to claim 1, wherein the locking mechanism is unlocked through elastic deformation of the cover element in the one of the at least two states.

11. The beverage can closure element according to claim 1, further comprising one or more wings extending from the rim area intermediate the rivet and the beading.

12. The beverage can closure element according to claim 1, wherein the cover element includes a curved surface of a round, oval, trapezoidal with rounded corners, rectangular, square, triangular, or polygonal shape.

13. The beverage can closure element according to claim 1, wherein the cover element includes a curved surface or partial surface directed downwards, or includes an upwardly curving surface, which in part encompasses a surface directed downwards.

14. The beverage can closure element according to claim 1, wherein the rim area encompasses one or more projecting parts.

15. The beverage can closure element according to claim 1, wherein the cover element includes a completely or partially circumferential reinforcing groove and/or reinforcing rib in the form of an offset.

16. The beverage can closure element according to claim 1, wherein the rim area includes one or more lugs.

17. The beverage can closure element according to claim 1, wherein the cover element includes a level surface or a surface protruding from a level surface, wherein the surface protruding from the level surface is a curved surface or a surface with multiple curves.

18. The beverage can lid with a beverage can closure element according to claim 1, with a rupture line defining the opening for dispensing contents of the beverage can.

19. The beverage can lid according to claim 18, wherein the extension opens the beverage can by pressing in the beverage can lid on the rupture line when the cover element is in the second position.

20. The beverage can lid according to claim 18, wherein, following opening of the opening, the cover element is positioned in the first position over the dispensing opening by pivoting about the first pivot axis to cover and close the opening again.

21. The beverage can lid according to claim 18, wherein the locking mechanism snaps into the opening when closing the opening and, is clamped tightly in the opening or engages in said opening.

22. The beverage can lid according to claim 18, wherein the beading is a depression extending radially relative to the first pivot axis.

23. A beverage can closure comprising:

a lid including a seam section adapted to be fitted to a body of a beverage can, with the lid including an opening enclosed by a rupture line;

a cover element for removable receipt in the opening in the lid;

a locking mechanism on the cover element for locking the cover element in the opening of the lid, wherein the cover element is elastically deformable between at least two states with the locking mechanism in one state of the cover element of the at least two states of the cover element extending further inwards in a radial direction relative to the cover element than in another one of the at least two states of the cover element;

a rim area extending circumferentially around the cover element, with an extension provided in the rim area;

a rivet provided in the extension and the lid, with the cover element, the locking mechanism, and the rim pivotal about the rivet defining a first pivot axis to engage the extension in the opening enclosed by the rupture line of the lid, with the cover element, the locking mechanism, and the rim area pivotable about the first pivot axis between a first position with the cover element over the opening and a second position with the rivet intermediate the opening and the cover element; and a beading formed in the rim area opposite to the extension and adjacent to the locking mechanism, with the beading and the rivet defining a second pivot axis generally perpendicular to the first pivot axis, with the cover element and the locking mechanism received in the opening and with the beading engaging the lid outside of the opening and opposite to the rivet, the cover element and the locking mechanism are removed from the opening of the lid by pivoting the cover element, the locking mechanism, and the rim area about the second pivot axis when the cover element is in the first position.

* * * * *